US007609843B2

(12) United States Patent
Hatano et al.

(10) Patent No.: US 7,609,843 B2
(45) Date of Patent: Oct. 27, 2009

(54) SOUND COLLECTOR

(75) Inventors: Hajime Hatano, Fujisawa (JP); Yoshihito Tamanoi, Tokyo (JP); Shinsuke Terashima, Tokyo (JP)

(73) Assignees: Hajime Hatano, Fujisawa (JP); Yamatake Corporation, Tokyo (JP)

( * ) Notice: Subject to any disclaimer, the term of this patent is extended or adjusted under 35 U.S.C. 154(b) by 470 days.

(21) Appl. No.: 10/968,363

(22) Filed: Oct. 20, 2004

(65) Prior Publication Data

US 2005/0157901 A1 Jul. 21, 2005

(30) Foreign Application Priority Data

Oct. 20, 2003 (JP) ..... 2003-358961
Oct. 20, 2003 (JP) ..... 2003-358962
Oct. 20, 2003 (JP) ..... 2003-358963

(51) Int. Cl.
*H04R 9/08* (2006.01)
*H04R 19/04* (2006.01)
*H04R 21/02* (2006.01)
*H04R 17/02* (2006.01)
*H04R 11/04* (2006.01)

(52) U.S. Cl. ..... 381/356; 381/355; 381/361; 381/368; 381/375; 181/131

(58) Field of Classification Search ..... 381/304, 381/305, 307, 308, 67, 26, 336, 122, 355, 381/359, 360, 361, 365; 181/158, 171, 175, 181/131
See application file for complete search history.

(56) References Cited

U.S. PATENT DOCUMENTS 3,895,188 A * 7/1975 Ingraham ..... 381/160
4,522,283 A * 6/1985 Smith ..... 181/175
5,692,060 A * 11/1997 Wickstrom ..... 381/361
6,148,089 A * 11/2000 Akino ..... 381/356
6,438,238 B1 * 8/2002 Callahan ..... 381/67
2004/0114778 A1 * 6/2004 Gobeli et al. ..... 381/356

(Continued)

FOREIGN PATENT DOCUMENTS

JP 59-101585 7/1984

(Continued)

OTHER PUBLICATIONS

Japanese Office Action, Decision of Rejection in corresponding Japanese Patent Application 2002-358962, dated Oct. 19, 2007.

(Continued)

*Primary Examiner*—Wayne R Young
*Assistant Examiner*—Dionne H Pendleton

(57) ABSTRACT

The present invention provides a sound collector preferably applicable to an acoustic analysis with a high degree of accuracy and includes a sound collection hood having an opening at the front end and a sound reflective inner wall shaped like a rotating surface having a focus behind the opening at least provided on the opening side, thus forming an inner space, a microphone placed inside the sound collection hood with at least a sound receiving face oriented forward for receiving a sound wave entering the sound collection hood and an acoustical absorbent body formed in front of the sound receiving face so as to form an incident path for sound to enter the sound receiving face and in a shape surrounding the incident path.

12 Claims, 37 Drawing Sheets

U.S. PATENT DOCUMENTS

| | | | | |
|---|---|---|---|---|
| 2005/0157901 | A1* | 7/2005 | Hatano et al. | 381/356 |
| 2005/0163335 | A1* | 7/2005 | Hatano et al. | 381/368 |
| 2006/0269089 | A1* | 11/2006 | Gieson | 381/361 |
| 2008/0212804 | A1* | 9/2008 | Watanabe | 381/120 |

FOREIGN PATENT DOCUMENTS

| | | | |
|---|---|---|---|
| JP | 63-22498 | | 6/1988 |
| JP | 1-163810 | | 11/1989 |
| JP | 8-154288 | | 6/1996 |
| JP | 9-84171 | | 3/1997 |
| JP | 10-042385 | | 2/1998 |
| JP | 10-42385 | | 2/1998 |
| JP | 10042385 | A * | 2/1998 |
| JP | 11-331977 | | 11/1999 |
| JP | 2001-201490 | | 7/2001 |
| JP | 2001-330595 | | 11/2001 |
| JP | 2002-333437 | | 11/2002 |

OTHER PUBLICATIONS

Toshio Shinokawa et al., "Developing Inspection System of Impact Acoustic for Tunnel Lining", Inspection Engineering, vol. 7, No. 7, 2002, pp. 41-45.

K. Yamashita et al., "1-8-4 Parabolic Sound Collector with Internal Absorber", Proceedings of Spring Meeting in 2003 of The Institute of Electronics, Information and Communication Engineers I, Mar. 18, 2003, pp. 599-600.

Kuroudo Yamashita et al., "1-5 Development of Parabolic Sound Collector with Internal Absorber", 10$^{th}$ Collected Papers of Symposium for Non-Destructive Evaluation by Ultrasound, Jan. 30, 2003, pp. 15-16.

Toshio Shinokawa et al., "Development of Tunnel Lining Hammering Test System", Jul. 2002, pp. 1-12.

Japanese Patent Office Action, mailed Jul. 31, 2007 and issued in corresponding Japanese Patent Application No. 2003-358961.

Japanese Patent Office Action, mailed May 13, 2008 and issued in corresponding Japanese Patent Application No. 2003-358963.

* cited by examiner

Fig. 14(a)
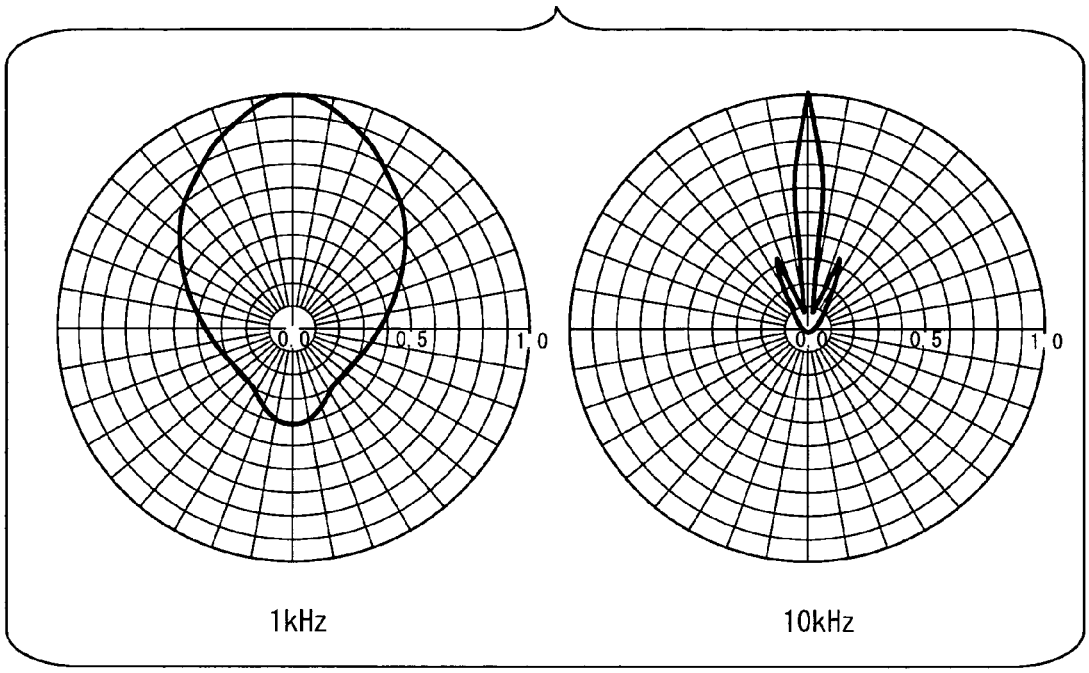
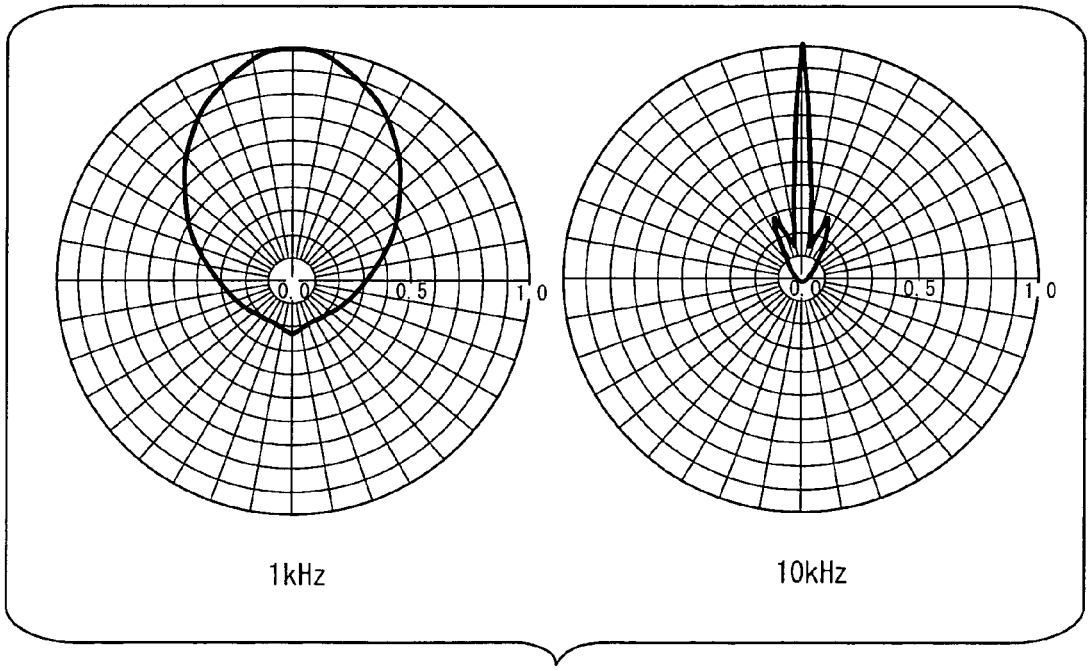
Fig. 14(b)

9kHz

11kHz

13kHz

9kHz

11kHz

13kHz

9kHz

11kHz

13kHz

Fig. 25(a)
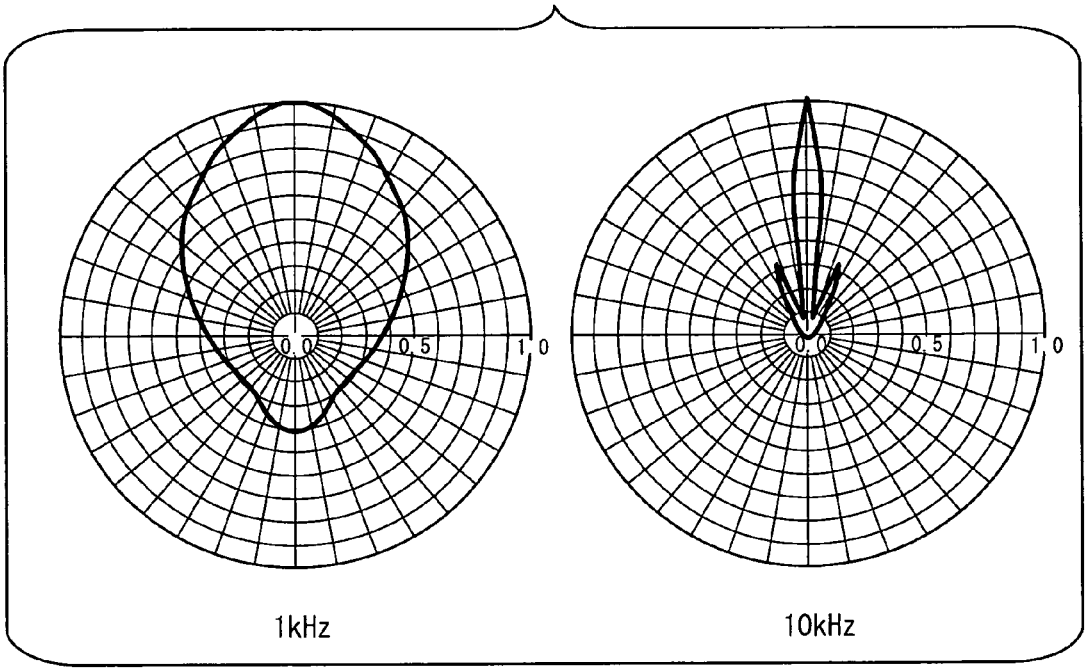
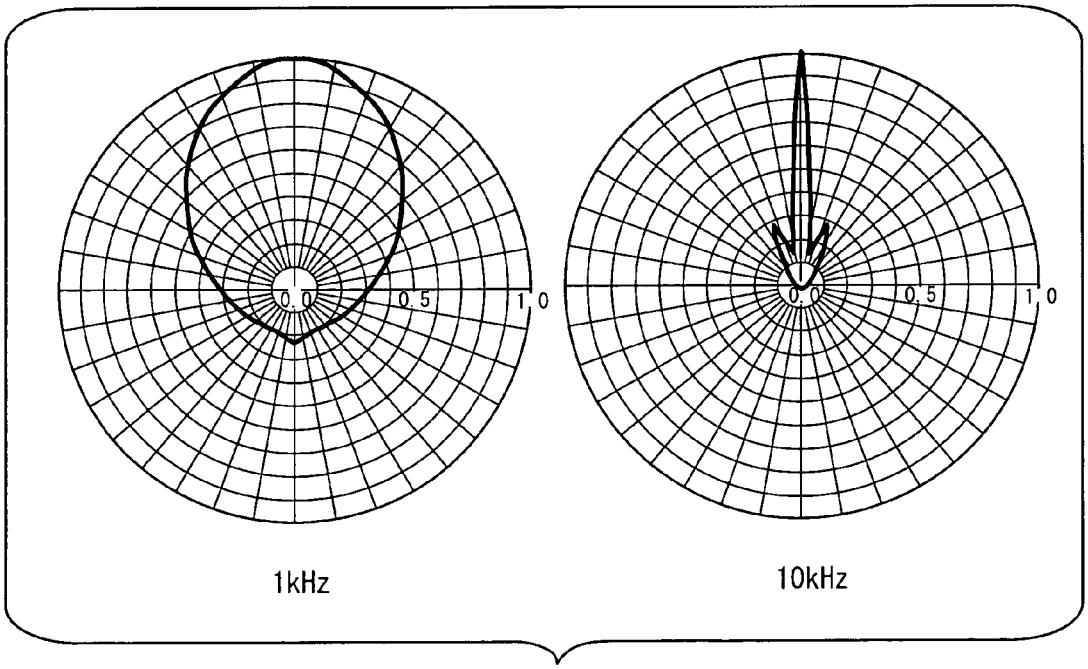
Fig. 25(b)

Fig. 37(a)
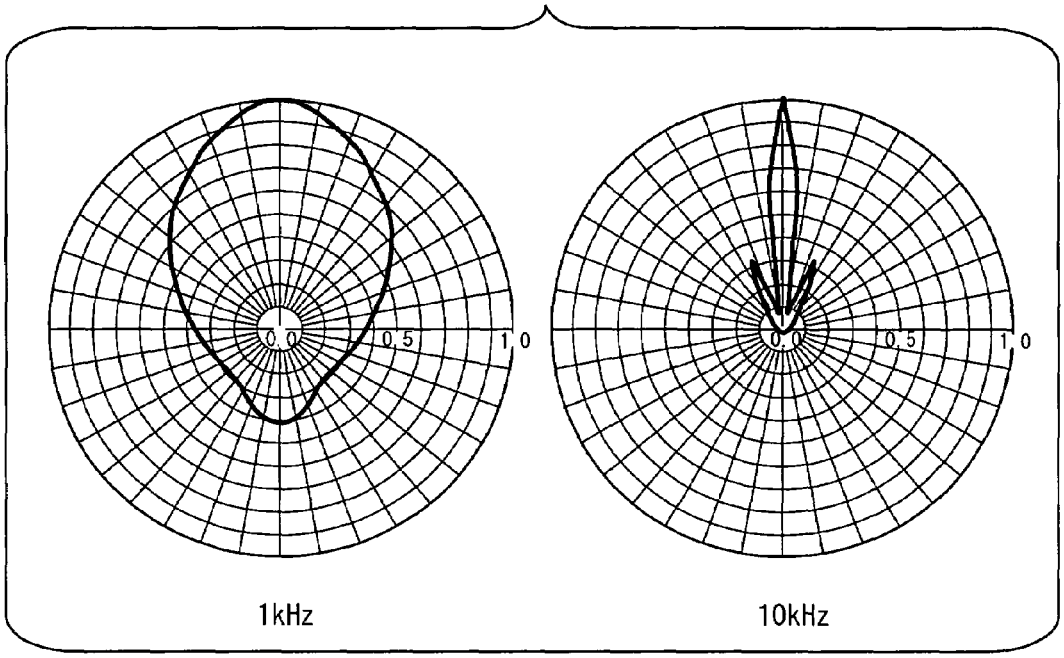
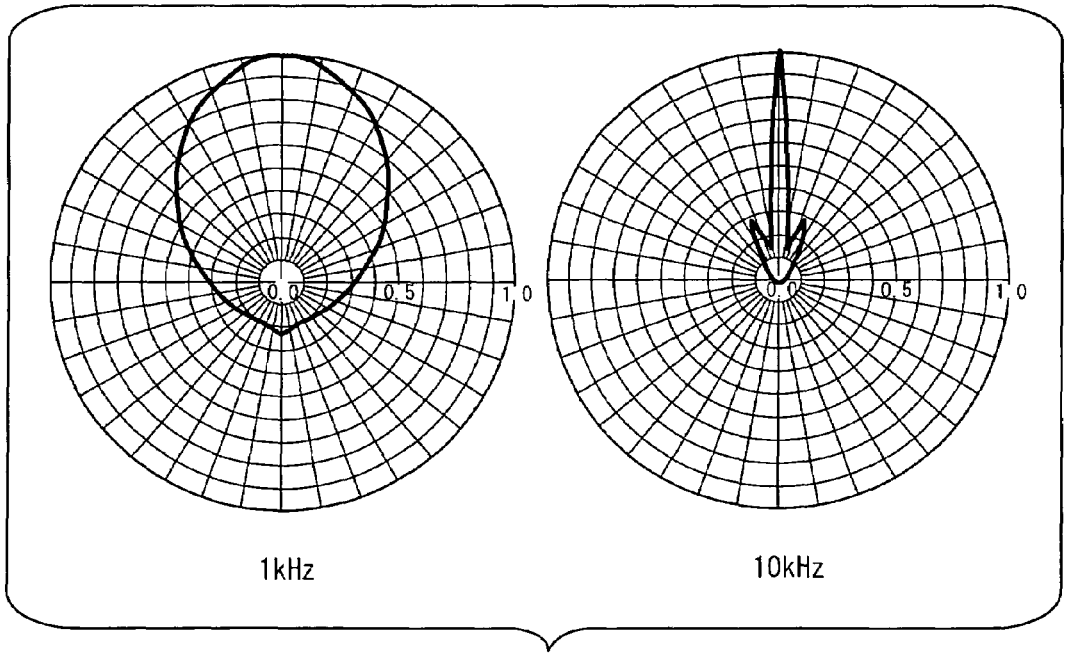
Fig. 37(b)

SOUND COLLECTOR

BACKGROUND OF THE INVENTION

1. Field of the Invention

The present invention relates to a sound collector which collects sound using a microphone placed inside a hood.

2. Description of the Related Art

Conventionally, a hammering tone test system is known which hits a surface to be tested using a striking tool such as a hammer, collects sound (hereinafter referred to as "hammering tone") generated by the hammering using a microphone and analyzes the sound to detect defects such as cavities in the test object (e.g., see Non-Patent Document 1).

In the hammering tone test system described in the Non-Patent Document 1, the sound generated in the hammering test is collected by a sound collector provided with a microphone placed in the center and a stethoscope type sound collection hood for shutting off surrounding sound.

Here, since impulse sound produced by a hammering test, etc., is not continuous sound, it is necessary to collect an acoustic signal in a short time and accurately.

However, in the case of an acoustic diagnosis of impulse sound, sound is reflected (including diffuse reflection) and reaches the sound collector instantaneously, and therefore it is sometimes difficult to realize accurate acoustic diagnosis.

Therefore, it is possible to adopt a sound collector already proposed by the present inventor (see Patent Document 1) which places an acoustical absorbent at the back in the collection hood and absorbs a sound wave produced from a test object and reflected on an inner wall surface of the sound collection hood to thereby prevent interference among sound waves.

FIG. 1 is a cross-sectional view of the sound collector having already proposed by the present inventor.

FIG. 1 shows a sound collector 100 provided with an acoustical absorbent 130 inside a sound collection hood and the acoustical absorbent 130 of this sound collector 100 is placed in the sound collection hood facing an opening surface 114 of the sound collection hood.

(Non-Patent Document 1)

"Testing Technology", July 2002 issue, pp 41-45 (technological topics/architecture, civil engineering) (Patent Document 1)

Japanese Patent Publication No. 3223237

SUMMARY OF THE INVENTION

The present invention is intended to improve sound collection performance by improving the sound collector already proposed by the present inventor and in view of the aforementioned circumstances, it is an object of the present invention to provide a sound collector suitable for an accurate acoustic analysis.

Of sound collectors of the present invention to attain the above object, a first sound collector includes a sound collection hood having an opening at the front end and a sound reflective inner wall shaped like a rotating surface having a focus behind the opening at least provided on the opening side, thus forming an inner space, a microphone placed inside the sound collection hood with at least a sound receiving face oriented forward for receiving a sound wave entering this sound collection hood, and an acoustical absorbent body formed in front of the sound receiving face so as to form an incident path for sound to enter this sound receiving face and shaped so as to surround this incident path.

Since the first sound collector of the present invention is provided with an acoustical absorbent body shaped so as to surround the incident path of sound entering the sound receiving face of the microphone placed inside the sound collection hood, the acoustical absorbent body has a large cross-section and an increased volume of the acoustical absorbent. Therefore, the first sound collector of the present invention can prevent sound waves which directly reach the microphone from being blocked and absorb more sound waves reflected on the sound reflective inner wall of the sound collection hood than the conventional sound collector. Therefore, it is possible to reduce the possibility of generating interference among sound waves compared to the conventional sound collector and contribute to a more accurate acoustic analysis.

Furthermore, it is a preferable mode in which at least one of the front of the acoustical absorbent body and the surface contacting the sound collection hood is formed uneven so as to reflect sound waves diffusely.

By so doing, it is possible to also exclude sound waves which have not attenuated despite being absorbed by the acoustical absorbent body, are reflected on the sound reflective inner wall surface and directed to the sound receiving face of the microphone again, thus further decreasing the possibility of interference among sound waves.

Furthermore, it is also a preferable mode in which the acoustical absorbent body is provided with an acoustical absorbent member and a cover which spreads over the surface of this acoustical absorbent member and covers this acoustical absorbent member in such a way that the shape of this acoustical absorbent member remains.

Having the acoustical absorbent member covered with a cover and blocked in this way can simplify alignment in the case of replacement and suppress exfoliation of the acoustical absorbent member.

Furthermore, the cover is preferably made of a jersey cloth.

Thus, a jersey cloth having relatively high acoustical absorbing performance can be used as the cover.

Here, the acoustical absorbent body preferably consists of two longitudinally detachable portions.

Adopting such a structure allows only the portion of the opening side of the absorbent body whose secular deterioration advances faster than other parts to be replaced, which is economical.

Of the sound collectors of the present invention attaining the above described object, a second sound collector includes a sound collection hood having an opening at the front end and a sound reflective inner wall similar to a rotating surface having a focus behind the opening at least provided on the opening side, thus forming an inner space, a microphone placed inside the sound collection hood with at least a sound receiving face oriented forward for receiving a sound wave entering this sound collection hood, an acoustical absorbent member placed inside the sound collection hood so as to surround the sound receiving face of the microphone and a partition wall which is placed ahead of the sound receiving face and separates at least the posterior area of the inner space including the sound receiving face from the outside of the sound collection hood.

In the case of a sound collector provided with no acoustical absorbent surrounding the sound receiving face of the microphone, providing a partition wall for preventing soiling of the microphone closer to the opening side of the sound collection hood than the sound receiving face of the microphone would provoke deterioration of sound collecting accuracy due to a standing wave generated by multiple reflections of sound waves between the inner wall surface of the sound collection hood and partition wall. Therefore, the conventional art would prevent standing waves from being generated by using a slack sheet-like material on the sound collection hood closer to the opening than the sound receiving face of the microphone instead of a partition wall, but on the contrary there has been a problem that fluttering of the sheet-like material due to wind would cause acoustic noise. The same problem is believed to also occur with a sound collector whose sound collection performance has been improved by providing an acoustical absorbent which surrounds the sound receiving face of the microphone. The present invention has been implemented by discovering that when an acoustical absorbent which surrounds the sound receiving face of the microphone is provided, using a tensioned material such as a partition wall instead of a sheet-like slack material will suppress standing waves and the second sound collector of the sound collectors of the present invention is provided with not only the acoustical absorbent surrounding the sound receiving face of the microphone but also a partition wall located closer to the opening of the sound collection hood than the sound receiving face of the microphone. Therefore, the second sound collector of the present invention can perform an acoustic analysis at a high degree of accuracy while preventing soiling of the microphone.

Here, the sound collection hood of the first sound collector and second sound collector of the sound collectors of the present invention is preferably provided with an acoustical absorbent along the perimeter of the opening.

Thus, arranging the acoustical absorbent along the perimeter of the opening can attenuate a sound wave arriving from the side of or behind the hood, diffracted at the edge of the opening of the hood and entering the hood, thus contributing to the suppression of the very penetration of a sound wave between the inner wall surface of the sound collection hood and the partition wall.

Furthermore, the partition wall is preferably made of a sound-penetrable sheet.

Thus, if the partition wall has sound penetrability, a sheet may be used for the partition wall.

Furthermore, the partition wall is preferably detachable from the sound collection hood.

Adopting such a partition wall is convenient because this facilitates replacement of the partition wall when it is soiled.

The sound collector of the present invention can contribute to an acoustic analysis at a high degree of accuracy.

BRIEF DESCRIPTION OF THE DRAWINGS

FIG. 14(*a*) and FIG. 14(*b*) show graphs showing directional characteristics of the sound collector;

FIG. 25(*a*) and FIG. 25(*b*) are graphs showing directional characteristics of the sound collector;

FIG. 37(*a*) and FIG. 37(*b*) are graphs illustrating directional characteristics of the sound collector.

DETAILED DESCRIPTION OF THE INVENTION

Embodiments of the present invention will be explained below.

Figure 1:
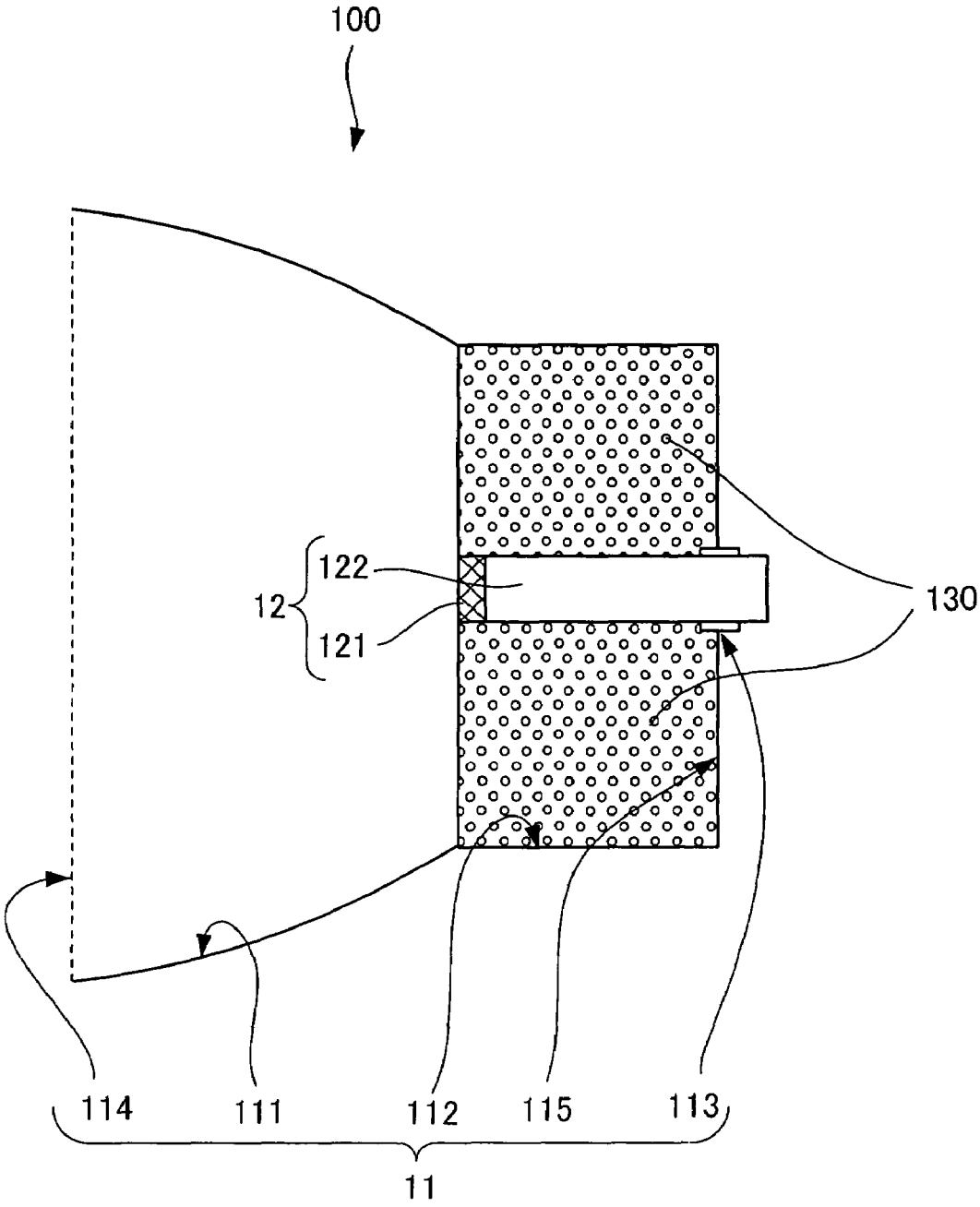
FIG. 1 is a cross-sectional view of a sound collector already proposed by the present inventor.
Figure 2:
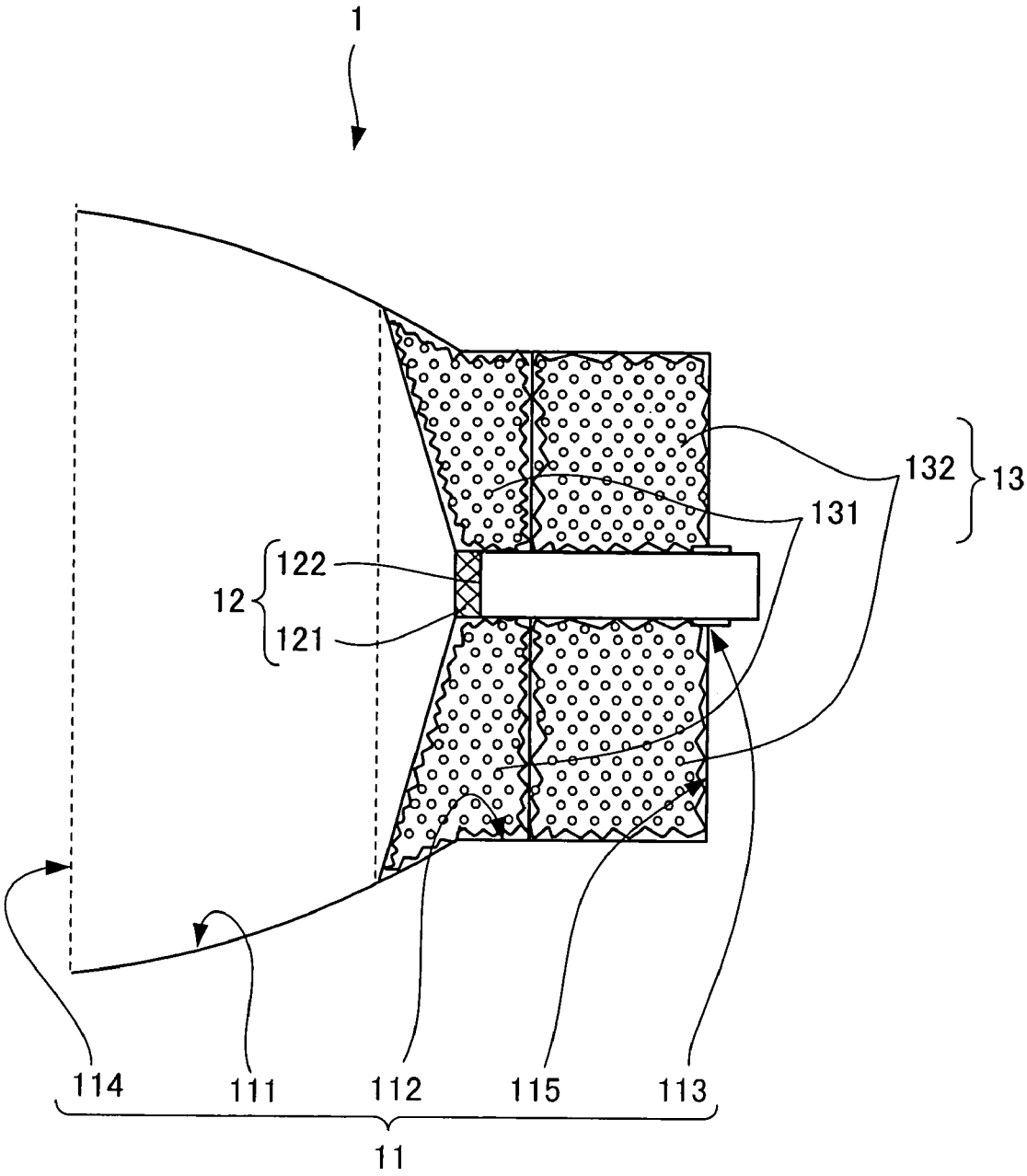
FIG. 2 is a cross-sectional view of an embodiment of a first sound collector of the present invention.

FIG. 2 is a cross-sectional view of an embodiment of a first sound collector of the present invention. The components shown in FIG. 2 of the same types as those shown in FIG. 1 are assigned the same reference numerals as those in FIG. 1.

A sound collector 1 of this embodiment shown in FIG. 2 is constructed of a sound collection hood 11 which collects sound, a microphone 12 inserted in a hole 113 made in the center at the back in the collection hood and a acoustical absorbent 13 having a mortar-shaped front fitted between the microphone 12 and the inner wall surface of the sound collection hood 11.

The sound collection hood 11 is constructed of a sound reflective inner wall 111 shaped like a rotating surface which has a focus behind the opening and a cylindrical acoustical absorbent housing wall 112, and a hole 113 for allowing the microphone 12 to insert is made in the center at the back in the collection hood 11 opposite to an opening 114.

The microphone 12 is constructed of a main unit 122 and a sound receiving face 121.

The acoustical absorbent 13 is constructed of a front section 131, in which an insertion hole for passing a microphone to be disposed in the center of sound collection hood on the opening 114 side when fitted into the sound collection hood, is provided and a rear section 132 disposed at the back in the collection hood in contact with a rear face 115. The acoustical absorbent 13 is made divisible into the front section 131 on the opening side and the rear section 132 on the back side of the sound collection hood 11 because aged deterioration of the front section 131 disposed in the sound collection hood 11 on the opening side facing the sound receiving face 121 of the microphone 12 advances faster than that of the rear section 132 and requires periodic replacements. Therefore eliminating the necessity for disposing the rear section 132 whose deterioration advances slower than that of the front section 131 together with the front section 131 can improve economical efficiency.

Figure 3:
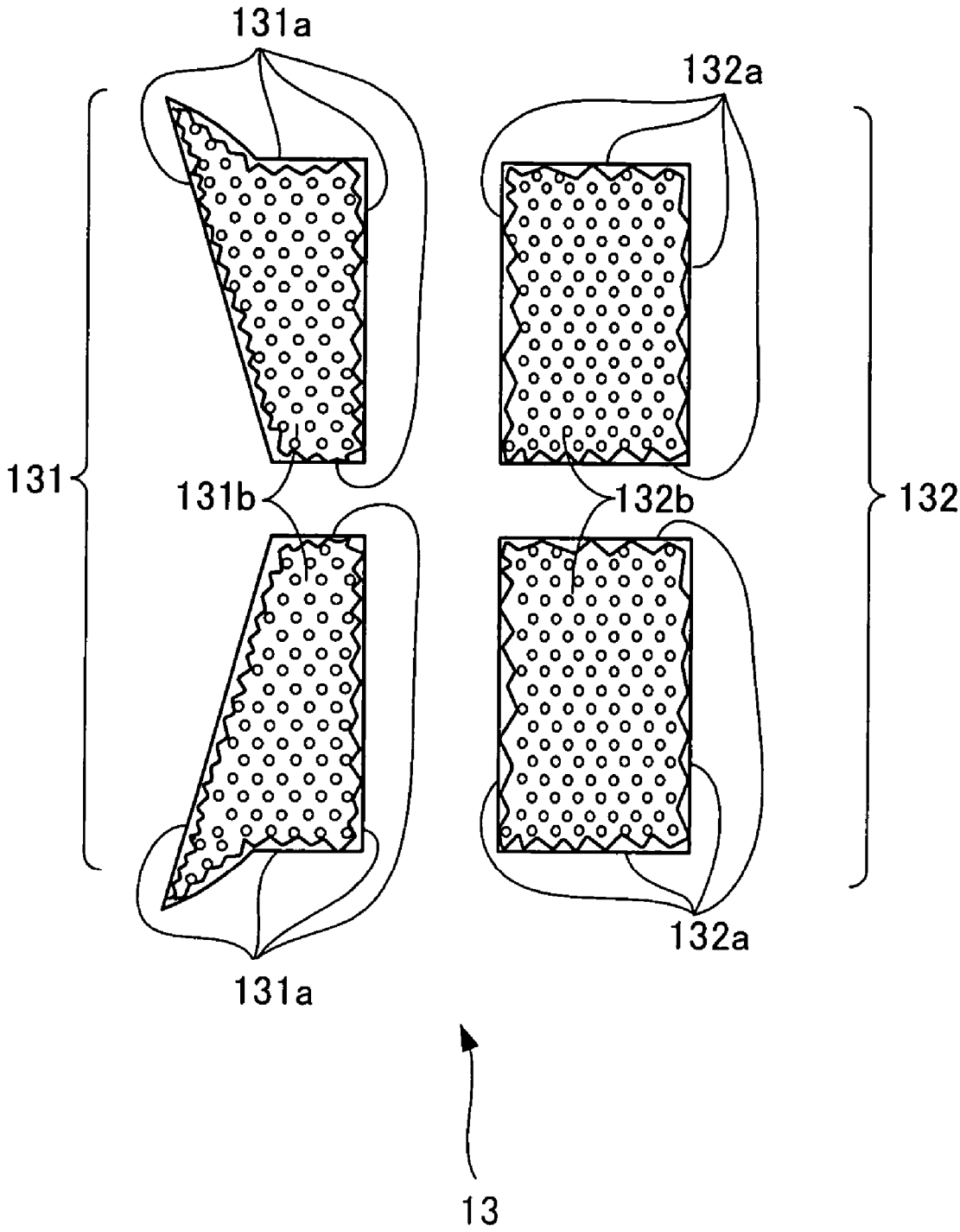
FIG. 3 is a cross-sectional view of the front section and rear section constituting an acoustical absorbent.

FIG. 3 is a cross-sectional view of the front section and rear section constituting the acoustical absorbent.

FIG. 3 shows a detailed inner structure of the acoustical absorbent and the front section 131 of the acoustical absorbent 13 has a mortar shape having the sound receiving face 121 of the microphone as a central bottom unlike the conventional type acoustical absorbent 130 (see FIG. 1). Thus, the sound collector 1 of this embodiment has a greater area of the surface of the acoustical absorbent facing the opening of the sound collection hood 11 than the conventional acoustical absorbent, and therefore the sound collector 1 of this embodiment can absorb more sound waves reflected on the sound reflective inner wall of the sound collection hood than the conventional one and thereby reduce the possibility of sound waves interfering with one another compared to the conventional one.

The surfaces of the front section 131 and rear section 132 constituting the acoustical absorbent 13 of the sound collector 1 of this embodiment are covered with jersey cloths 131*a*, 132*a* having a relatively high sound wave absorption factor and the interior of the jersey cloths 131*a*, 132*a* is filled with glass wool 131*b*, 132*b*. Furthermore, projections and depressions are formed on the surfaces of the glass wool 131*b*, 132*b* so as to reflect sound waves diffusely.

In the sound collector 1 of this embodiment, the glass wool 131*b*, 132*b* are wrapped with the jersey cloths 131*a*, 132*a* so as to prevent the glass wool 131*b*, 132*b* from scattering due to a sound pressure. Furthermore, the projections and depressions are provided on the surfaces of the glass wool 131*b*, 132*b* to reflect absorbed sound waves diffusely, and can thereby attenuate sound waves once absorbed but advancing toward the sound receiving face 121 of the microphone again without attenuation.

Figure 4:
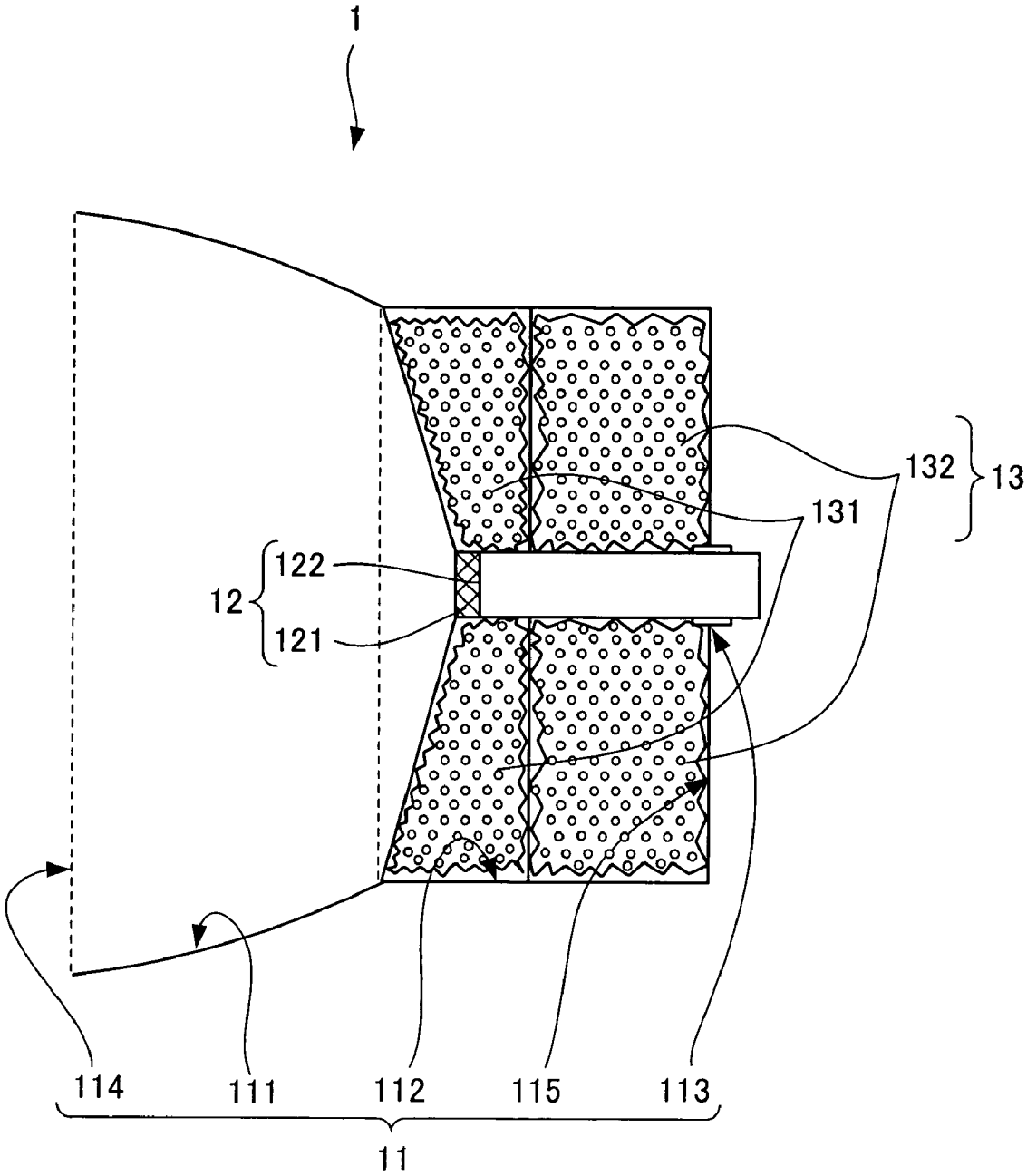
FIG. 4 is a cross-sectional view of a sound collector provided with a sound collection hood having a large-diameter cylindrical area in which an acoustical absorbent is housed.
Figure 5:
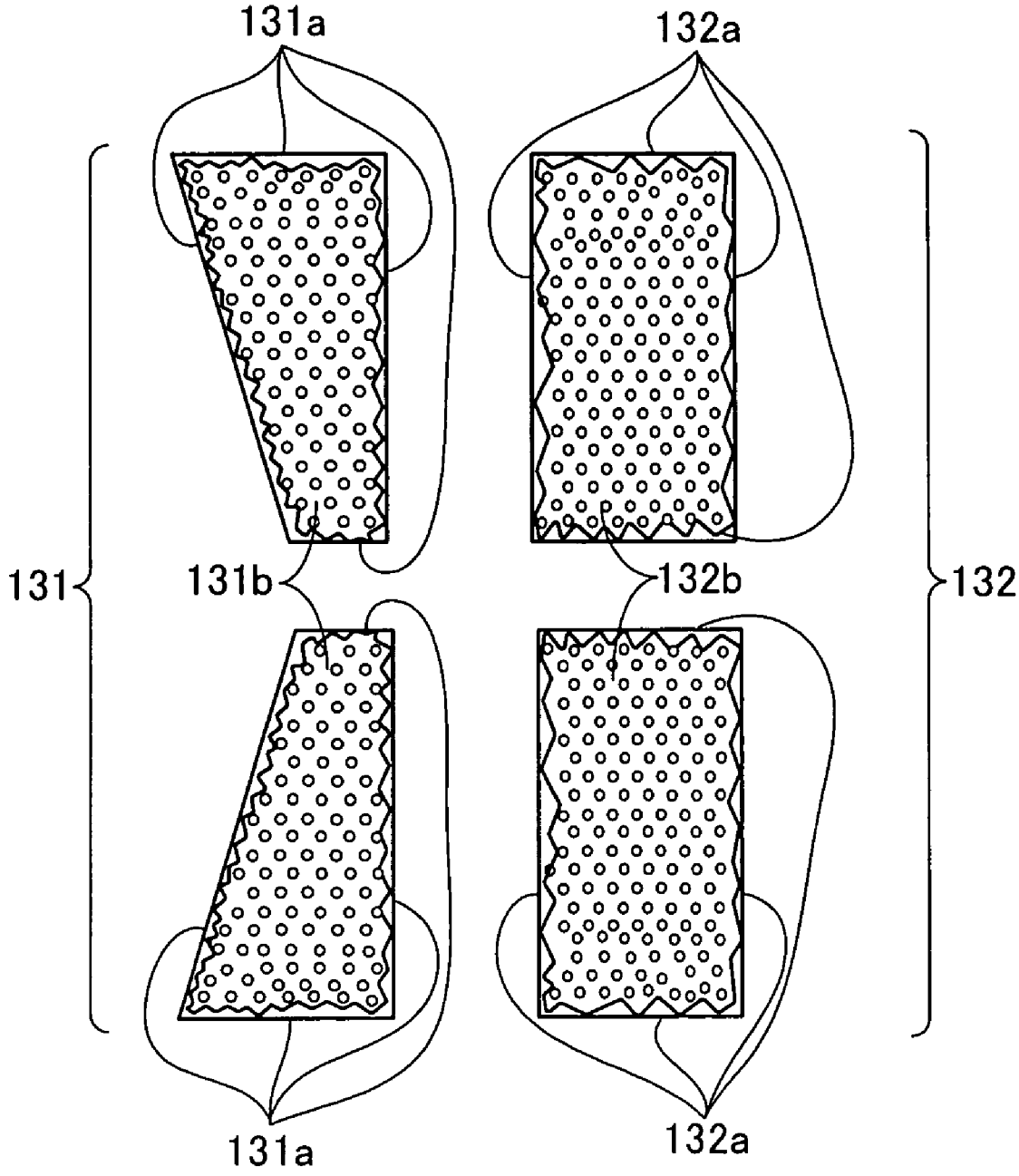
FIG. 5 is a cross-sectional view of the front section and rear section constituting the acoustical absorbent housed in the sound collector shown in FIG. 4.

FIG. 4 is a cross-sectional view of a sound collector provided with a sound collection hood having a larger-diameter cylindrical area in which an acoustical absorbent is housed compared to FIG. 2. FIG. 5 is a cross-sectional view of the front section and rear section constituting the acoustical absorbent housed in the sound collector shown in FIG. 4.

Adopting the structures shown in FIG. 4 and FIG. 5 reduces the possibility of sound waves interfering with one another.

Figure 6:
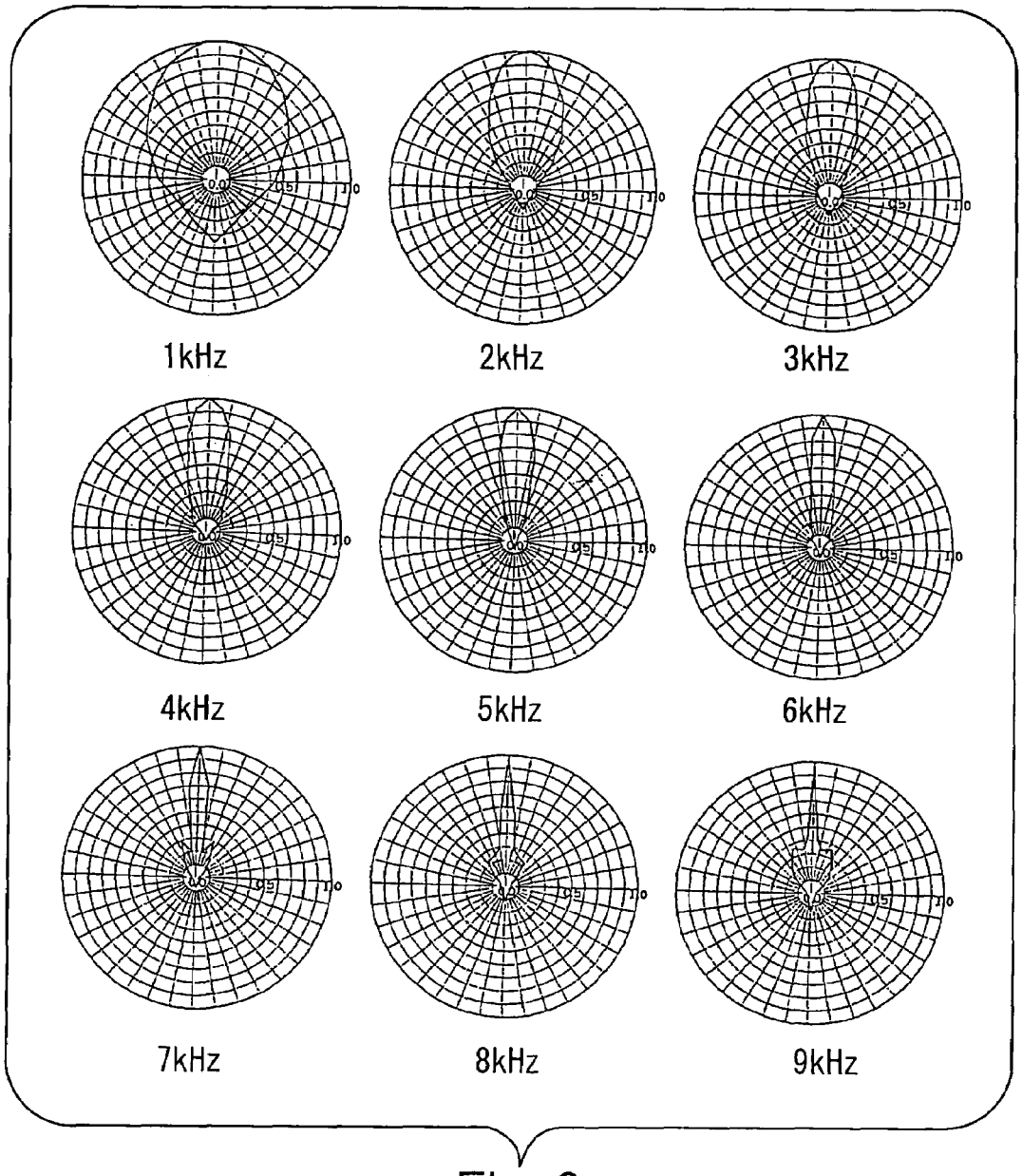
FIG. 6 illustrates a sound-collectable range using the sound collector of this embodiment.
Figure 7:
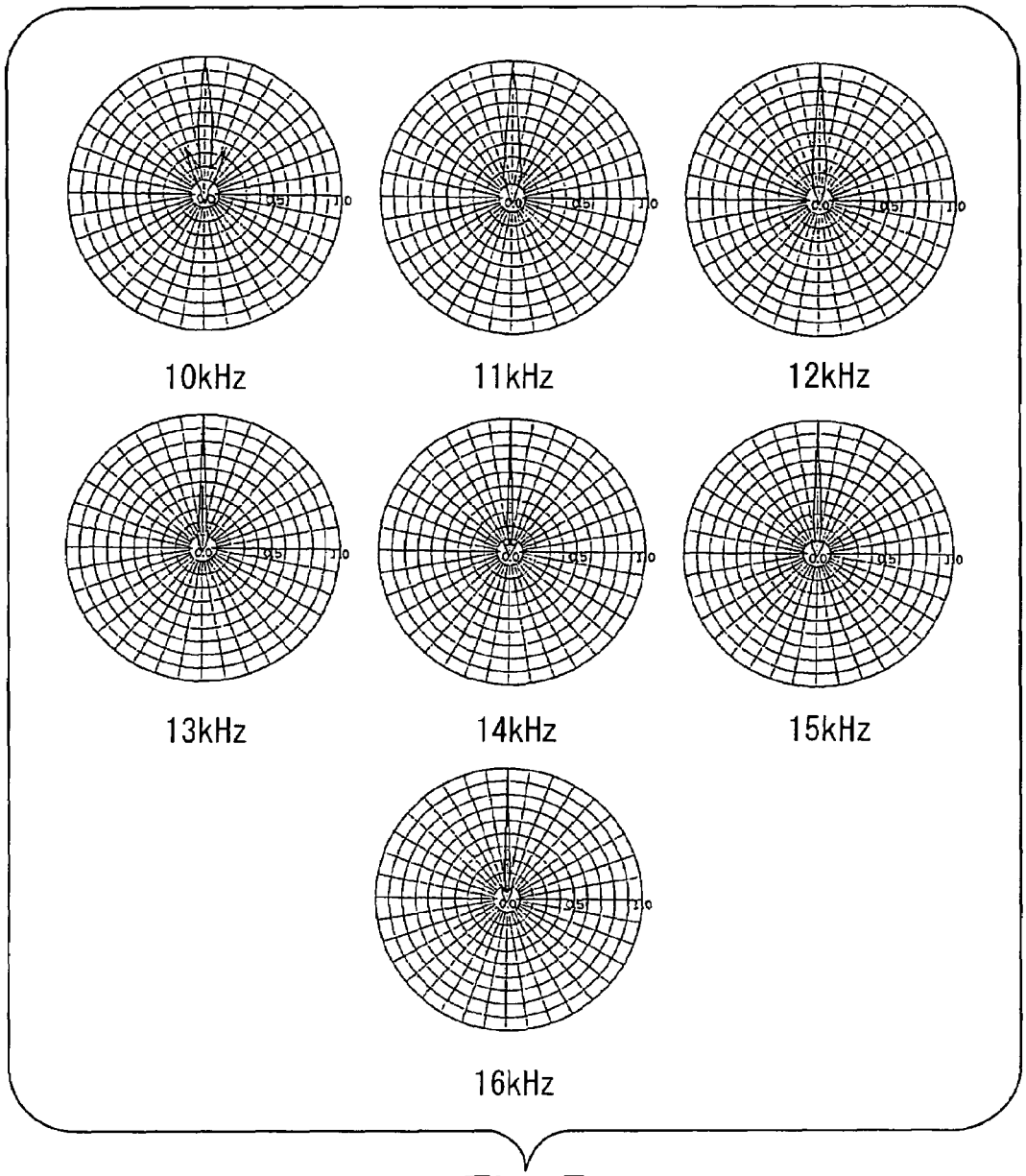
FIG. 7 illustrates a sound-collectable range using the sound collector of this embodiment.

Here, FIG. 6 and FIG. 7 show sound-collectable ranges using the sound collector of this embodiment.

FIG. 6 and FIG. 7 show directivity at each frequency (1 kHz to 16 kHz) of the sound collector 1 of this embodiment.

Figure 8:
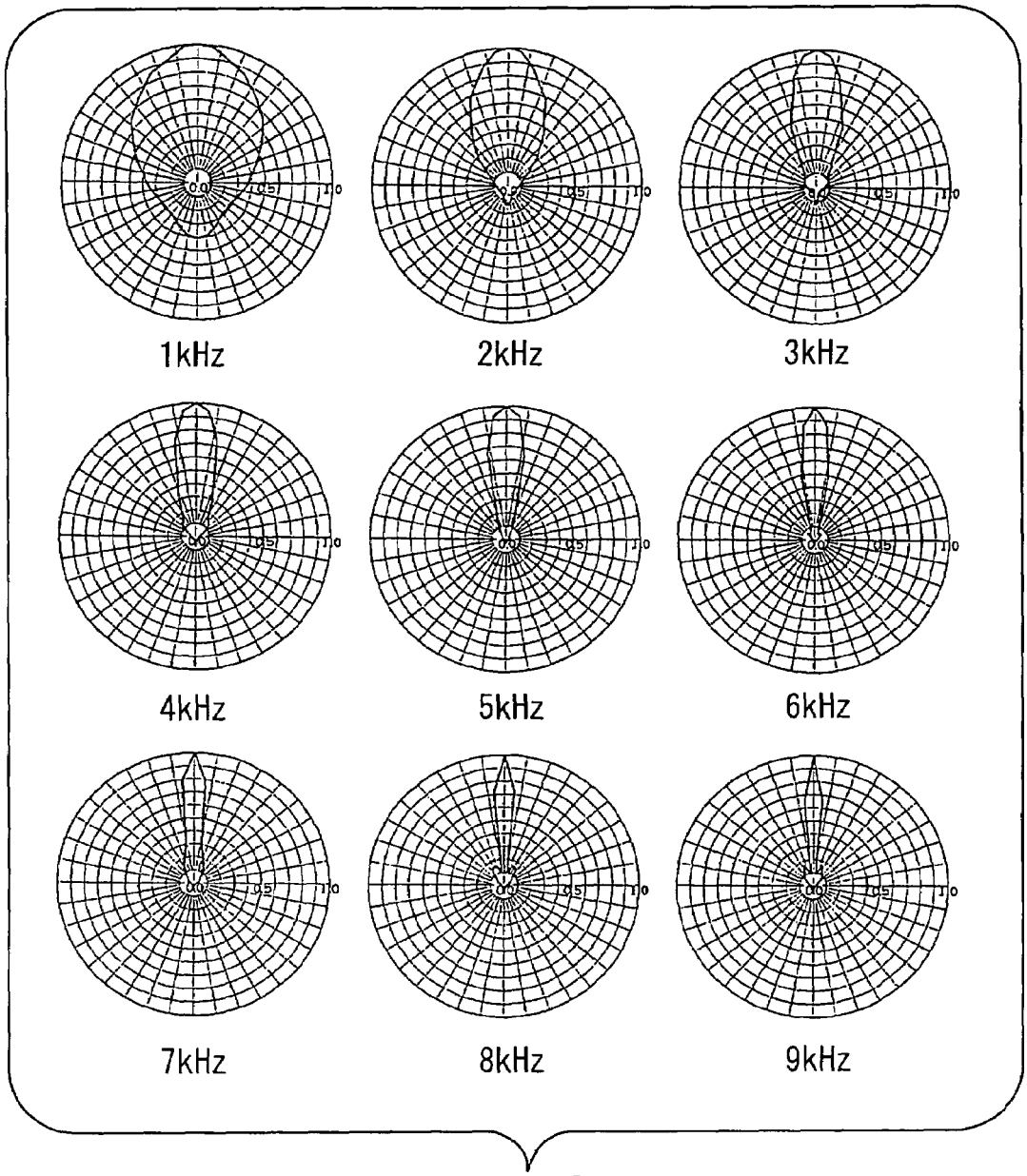
FIG. 8 illustrates a sound-collectable range using the conventional type sound collector shown in FIG. 1.
Figure 9:
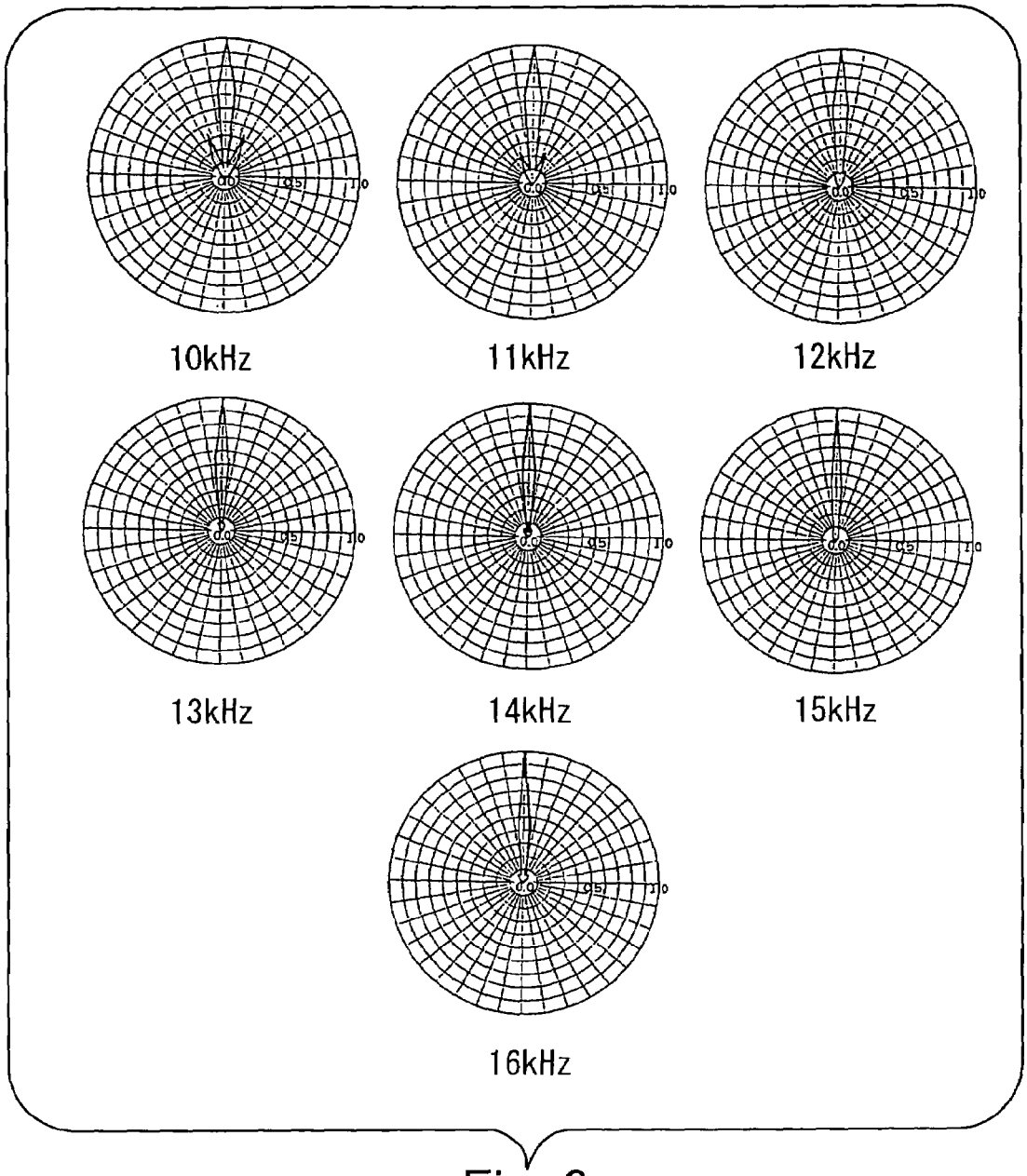
FIG. 9 illustrates a sound-collectable range using the conventional type sound collector shown in FIG. 1.

Furthermore, FIG. 8 and FIG. 9 illustrate sound-collectable ranges using the conventional type sound collector shown in FIG. 1.

FIG. 8 and FIG. 9 illustrate directivity at each frequency (1 kHz to 16 kHz) of the conventional type sound collector 100.

FIG. 6, FIG. 7, FIG. 8 and FIG. 9 show that directivity becomes sharper than the conventional directivity in a high frequency band with a frequency of approximately 7 kHz or higher and the sharpness becomes prominent at 10 kHz or higher.

That is, the sound collector 1 of this embodiment not only sets a larger diameter of the acoustical absorbent than the conventional proposal but also adopts a mortar shape with the sound receiving face of the microphone as the central bottom for the acoustic absorbent 13 facing the opening side of the sound collection hood. Therefore the area of the surface facing the opening of the sound collection hood is expanded, making it possible to absorb more sound waves reflected on the inner wall of the sound collection hood than the conventional sound collector, resulting in improved directivity.

Figure 10:
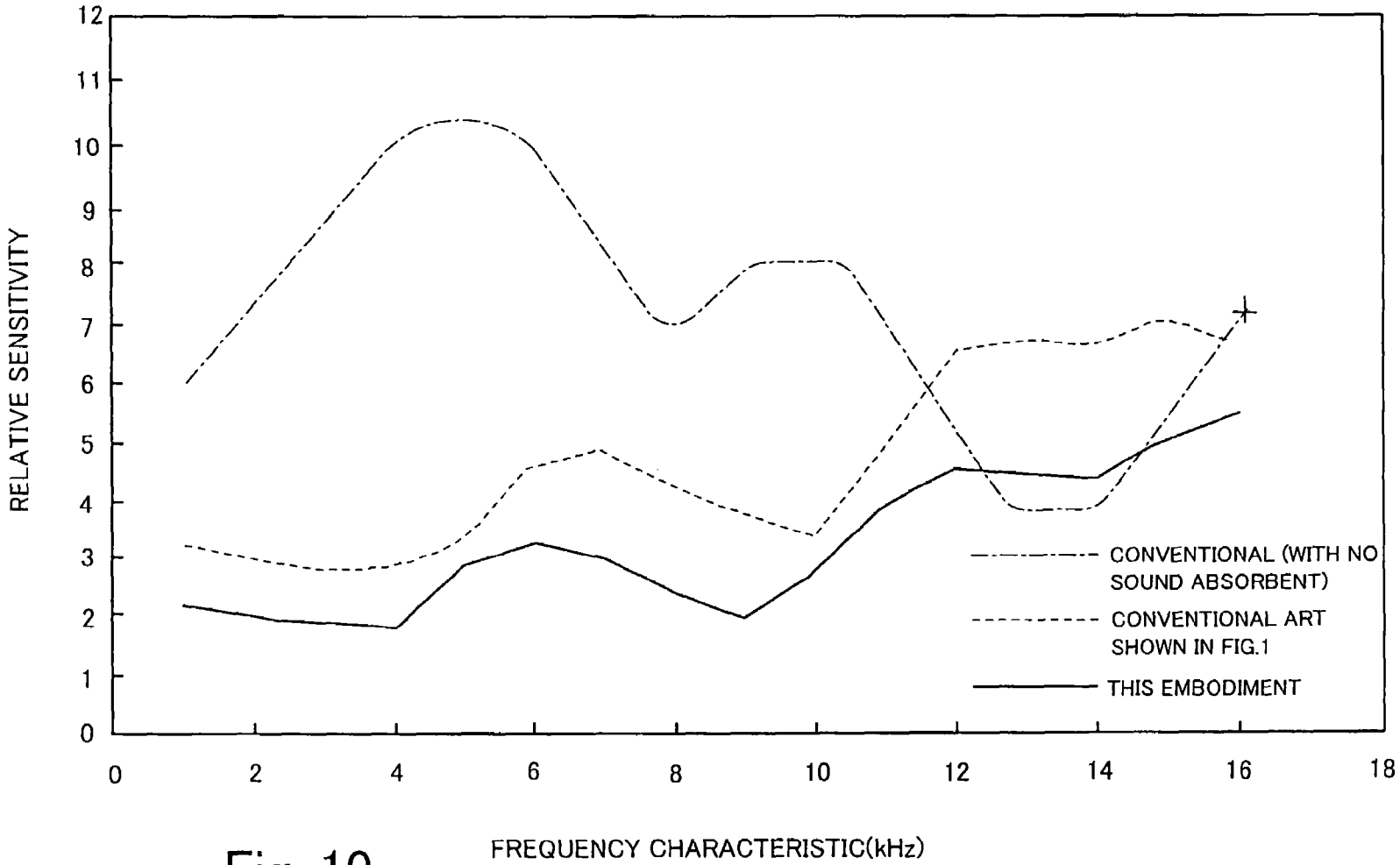
FIG. 10 is a graph showing frequency characteristics of the sound collector of this embodiment and the conventional type sound collector.

FIG. 10 is a graph showing frequency characteristics of the sound collector of this embodiment and the conventional type sound collector shown in FIG. 1.

FIG. 10 shows relative sensitivity at various frequencies and shows that adopting the shape of the acoustical absorbent capable of absorbing more sound waves reflected on the inner wall of the sound collection hood than the conventional sound collector levels out the sensitivity of the microphone more than the conventional one shown in FIG. 1 by a dotted line and also flattens the frequency characteristic. FIG. 10 shows the frequency characteristic of the conventional type sound collector shown with the acoustical absorbent removed by a single-dot dashed line.

As described above, the sound collector 1 of this embodiment adopts a shape of the acoustical absorbent disposed inside the sound collection hood different from the conventional shape shown in FIG. 1, which surrounds the incident path of the sound receiving face 121 of the microphone 12. Therefore it is possible to suppress interference among sound waves without blocking sound waves directly reaching the microphone compared to the conventional one and contribute to an acoustic analysis with a high degree of accuracy.

This embodiment has explained the case where the interior of the acoustical absorbent is filled with glass wool as an example, but the present invention is not limited to glass wool and any other material is applicable if it at least has a sound absorbing action. Furthermore, this embodiment has explained the case of a hermetic cover which wraps the entire glass wool as an example, but the present invention is not limited to this and glass wool wrapped with a mesh type cover can also be used.

Figure 11:
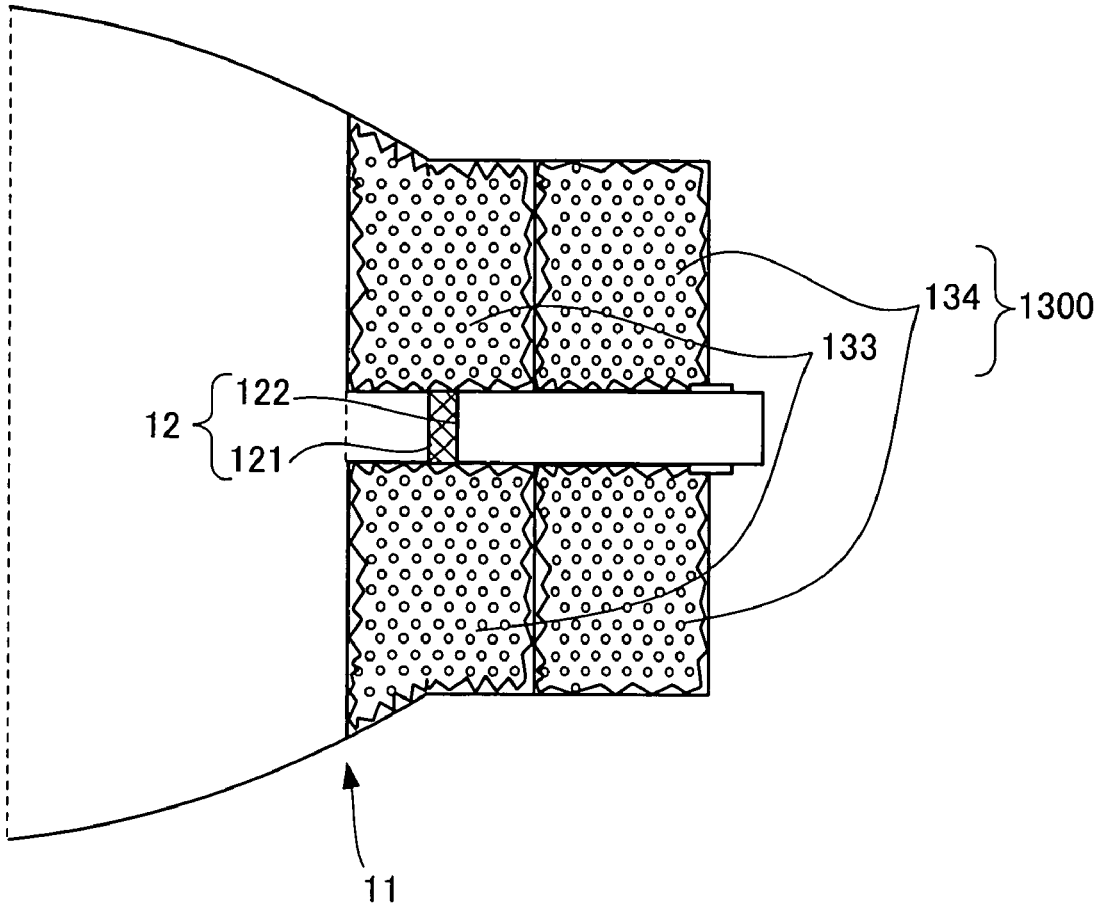
FIG. 11 illustrates another mode of this embodiment.

FIG. 11 illustrates another mode of this embodiment.

FIG. 11 shows an acoustical absorbent 1300 having a front section 133 which is different in shape from the front section 131 shown in FIG. 2, which surrounds the incident path of sound of the sound receiving face 121 of the microphone 12. Here, the figure shows the front section 133 protruding toward the opening side from the sound-receiving section 121 of the microphone 12. For the sound collector of the present invention, it is possible to adopt any acoustical absorbent having the shape shown in FIG. 11 if it is at least formed so as to surround the path of sound incident upon the sound receiving face of the microphone disposed within the sound collection hood.

Figure 12:
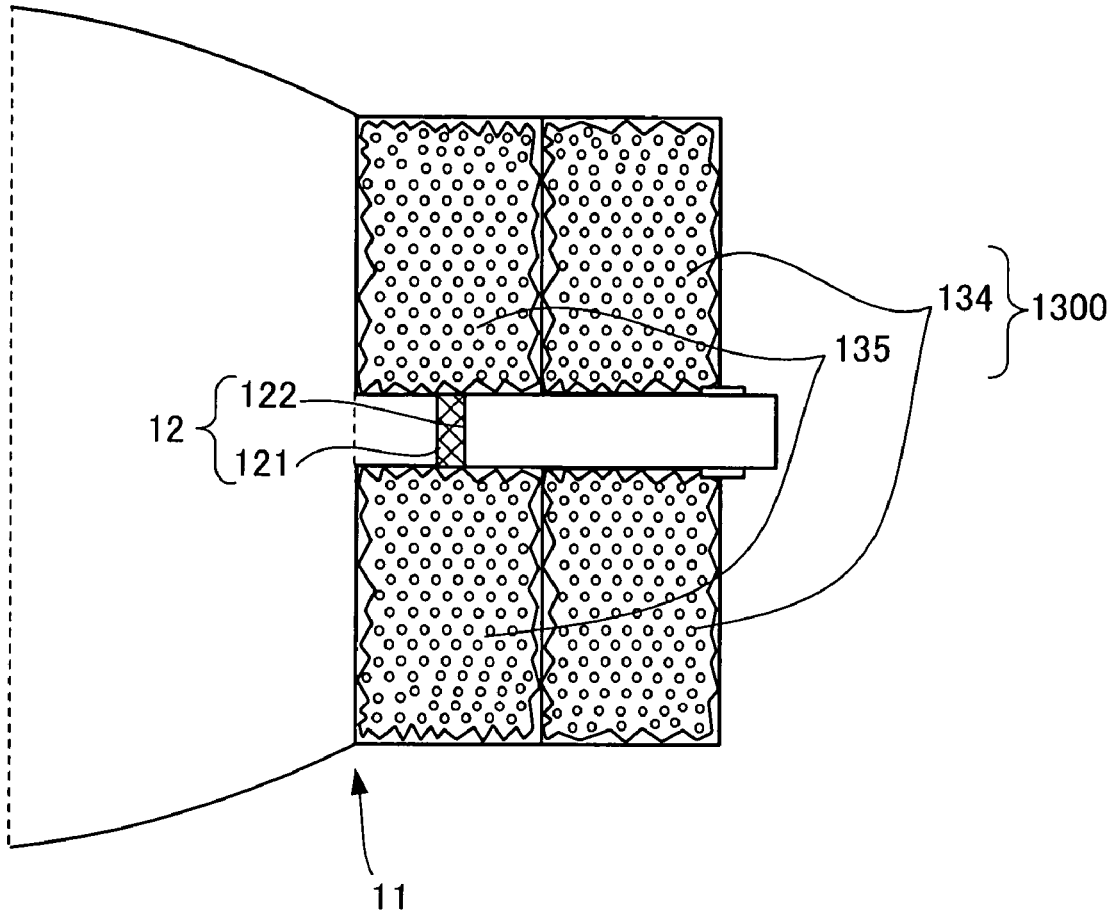
FIG. 12 is a cross-sectional view of a sound collector provided with a sound collection hood having a large-diameter cylindrical area in which an acoustical absorbent is housed.

Furthermore, FIG. 12 is a cross-sectional view of a sound collector provided with a sound collection hood having a large-diameter cylindrical area in which an acoustical absorbent is housed compared to FIG. 11.

Adopting the structure shown in FIG. 12 can further contribute to acoustic analysis with a high degree of accuracy.

The above described embodiment has explained the case where the acoustical absorbent is disposed around the microphone in the sound collection hood of the sound collector as an example, but by also disposing this acoustical absorbent around the perimeter of the opening of the sound collection hood, it is possible to attenuate sound waves arriving from the side of or behind the sound collection hood, diffracted at the edge of the opening and entering the hood, thereby suppress interference among sound waves and contribute to acoustic analysis with a high degree of accuracy.

Figure 13:
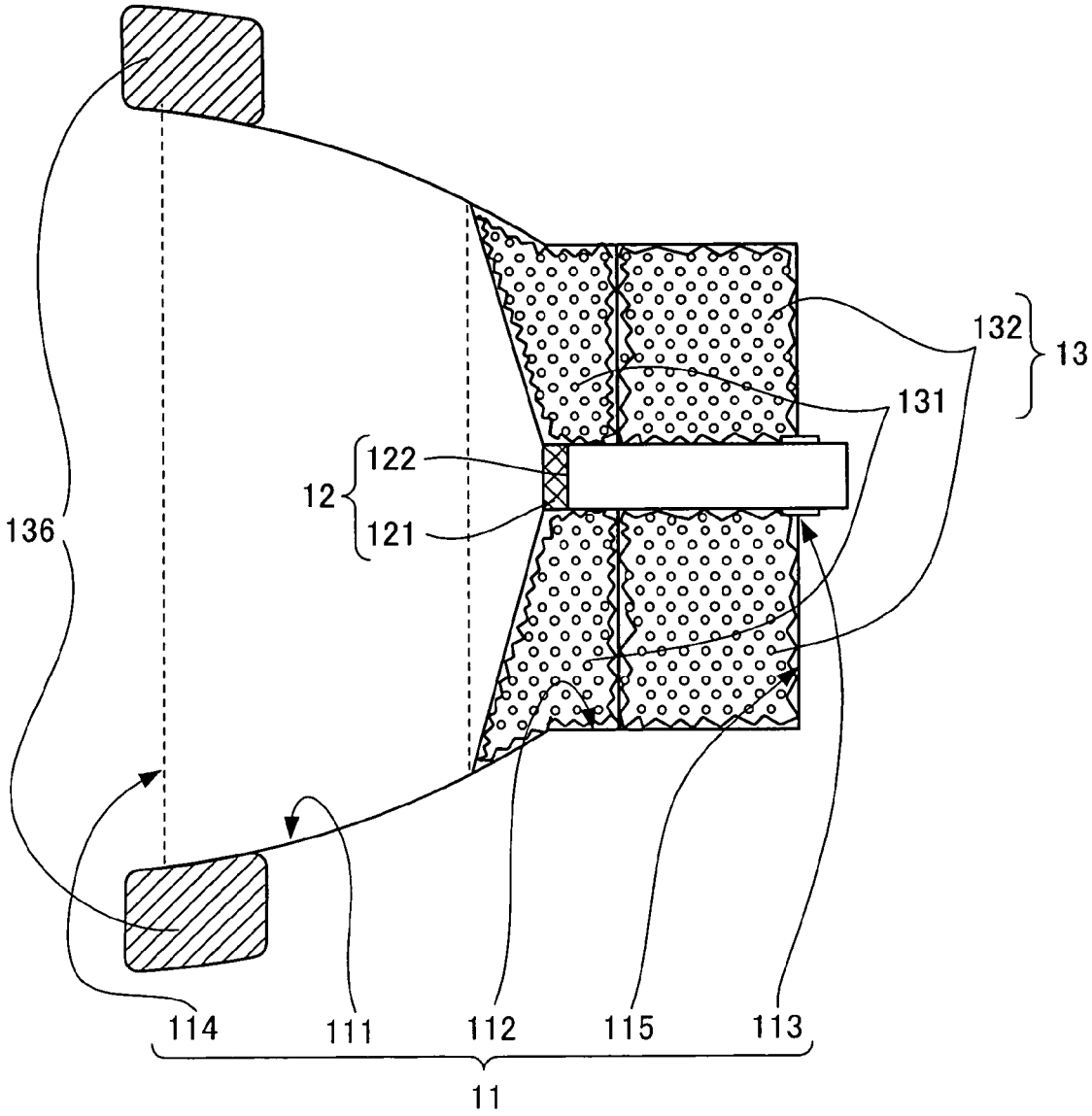
FIG. 13 is a cross-sectional view of an example of the sound collection hood with an acoustical absorbent disposed around the perimeter of the opening of the sound collection hood.

FIG. 13 is a cross-sectional view of an example of the sound collection hood with an acoustical absorbent also disposed around the perimeter of the opening of the sound collection hood. The components of the same types as those shown in the above described embodiment are assigned the same reference numerals as those assigned in the above described embodiment.

In the sound collection hood 11 shown in FIG. 13, as described above, the glass wool 136 which is an acoustical absorbent is disposed all around the perimeter of the opening in addition to the perimeter of the microphone 12. The glass wool 136 around the perimeter of the opening is not limited to that disposed all around the perimeter as shown in FIG. 13, but may also be detachable.

Furthermore, by disposing the glass wool 136 around the perimeter of the sound collection hood opening 114 in addition to the perimeter of the microphone 12 and attenuating sound waves diffracted at the edge of the opening of the hood and entering the hood, it is possible to suppress deterioration of directivity.

FIG. 14(*a*) and FIG. 14(*b*) are graphs showing directional characteristics of the sound collector.

FIG. 14(*a*) shows a directional characteristic of the sound collector for which the acoustical absorbent is disposed only around the microphone and FIG. 14(*b*) shows a directional characteristic of the sound collector according to a mode of the above described embodiment for which the acoustical absorbent is disposed around the perimeter of the opening of the sound collection hood in addition to the perimeter of the microphone at various frequencies.

From FIG. 14(*a*), FIG. 14(*b*), it is evident that disposing the acoustical absorbent around the perimeter of the opening of the sound collection hood in addition to the perimeter of the microphone improves the directional characteristic sideward or behind the sound collector at 1 kHz and noticeably improves the directivity right behind in particular, and improves the directivity in the direction close to the front of the sound collector at 10 kHz.

Furthermore, disposing the acoustical absorbent around the perimeter of the opening of the sound collection hood also lessens the impact when the opening of the sound collector contacts the test object, and can thereby provide the effect of preventing breakage of the two.

Furthermore, the above described embodiment has explained the case where the acoustical absorbent is disposed outside the perimeter as an example, but the acoustical absorbent of the present invention can also be disposed inside the perimeter. Also the case where the acoustical absorbent is constructed of two sections separable into the opening side and rear face of the sound collection hood covered with a cover and projections and depressions are formed on the entire surface of the glass wool for reflecting sound waves diffusely has been explained as an example, but the present invention is not limited to this; the acoustical absorbent need not be made separable into two sections or the sound collection hood need not be covered, and projections and depressions may be provided only on the surface of the glass wool facing the opening side of the sound collection hood or only on glass wool surfaces other than that facing the opening side or on even neither surface; any of these cases does not reduce the basic effects of the present invention.

Next, an embodiment of a second sound collector of the present invention will be explained.

Here, before explaining the second sound collector of the present invention, a conventional sound collector in general use without any acoustical absorbent in the sound collection hood will be explained using FIG. 15.

Figure 15:
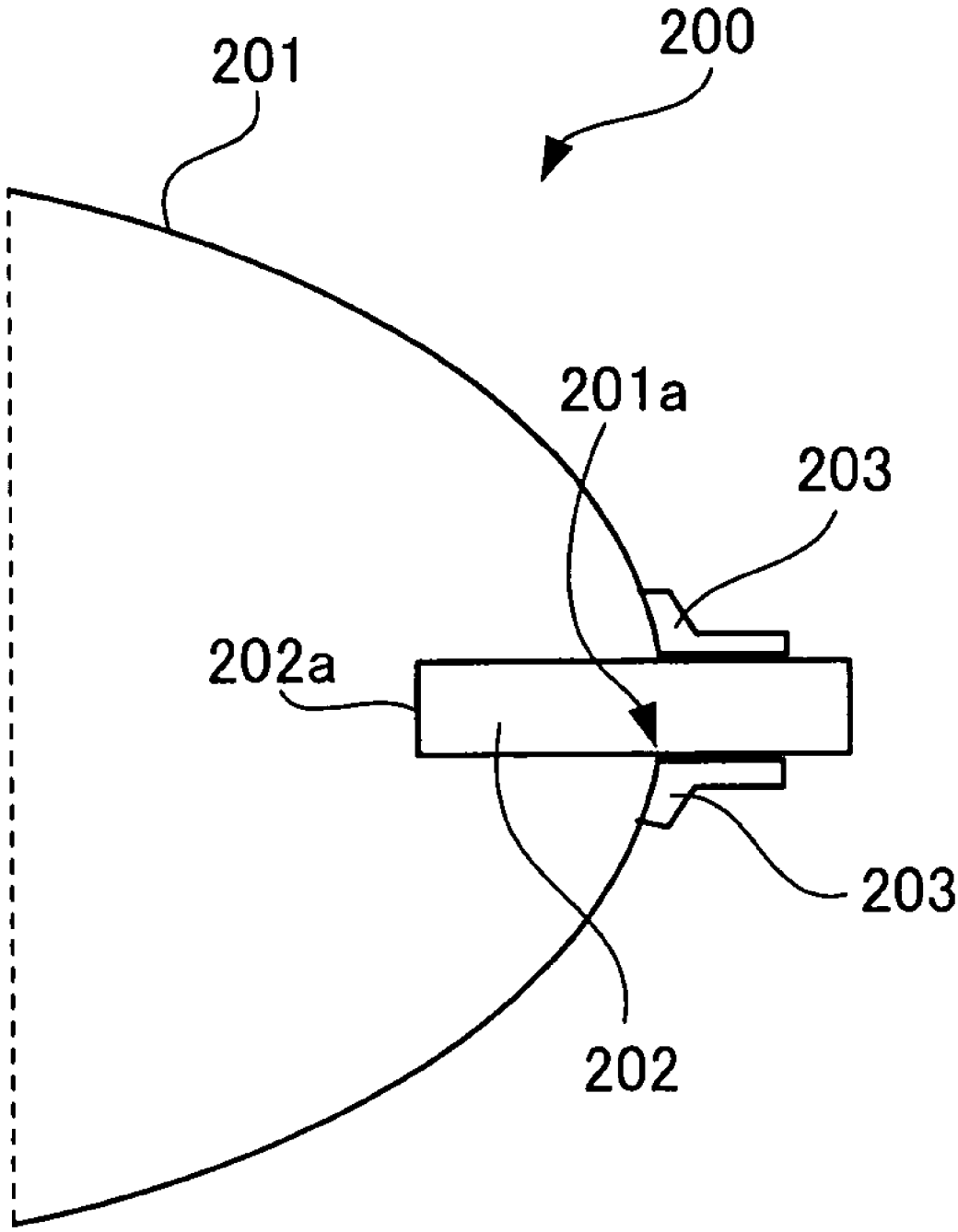
FIG. 15 is a cross-sectional view of a conventional sound collector in general use.

A sound collector 200 shown in FIG. 15 is constructed of a sound collection hood 201, a microphone 202 and a fixture 203 for fixing the microphone 202 inserted in a hole 201*a* which is provided at the back end of the sound collection hood 201 to the sound collection hood.

Figure 16A:
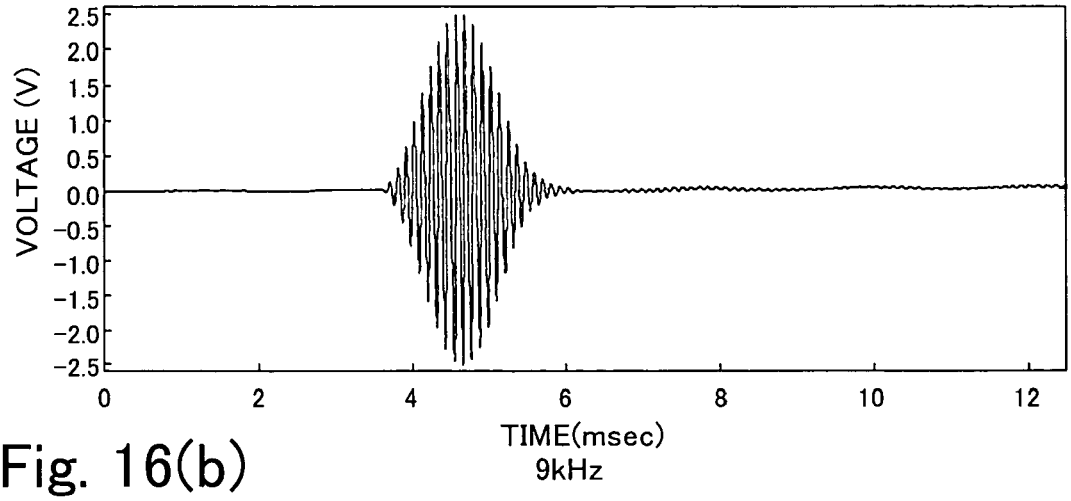
FIG. 16(*a*), FIG. 16(*b*) and FIG. 16(*c*) illustrate voltage waveforms output from the sound collector when a tone burst having a duration of 2 ms is collected using the sound collector shown in FIG. 15.
Figure 16B:
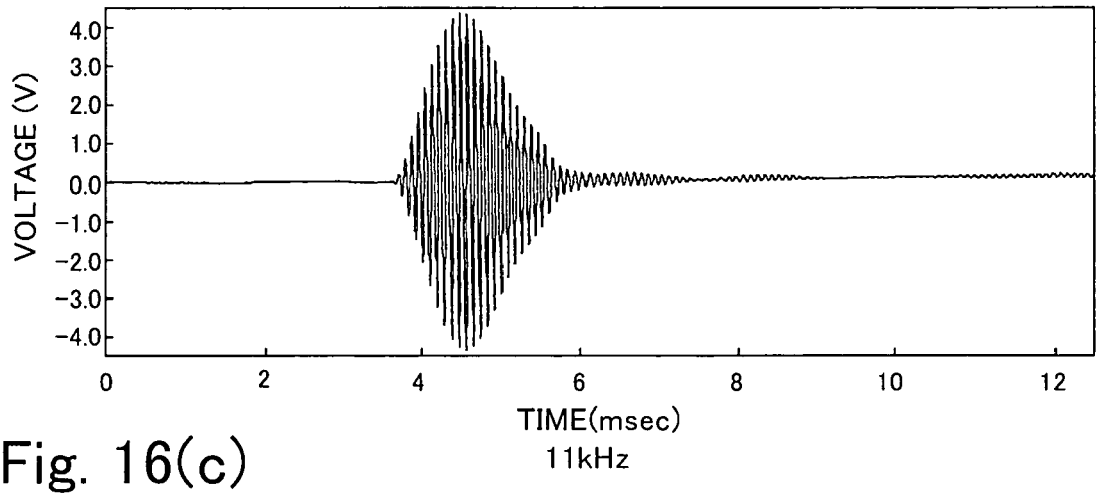
Figure 16C:
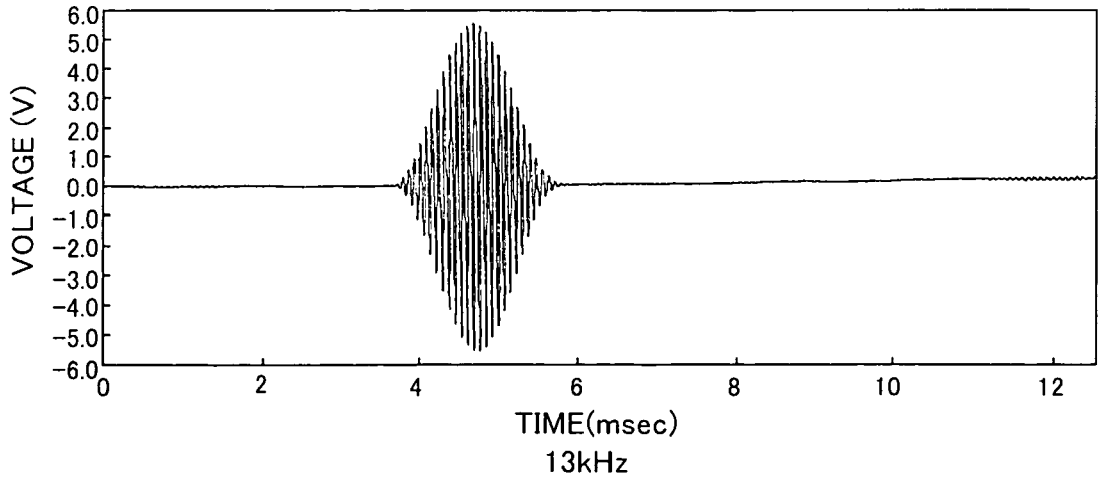

FIGS. 16(*a*) to (*c*) illustrate voltage waveforms output from the sound collector when a tone burst having a duration of 2 ms is collected using the sound collector shown in FIG. 15.

FIG. 16(*a*) to FIG. 16(*c*) show voltage waveforms when the frequency of the tone burst is 9 kHz, 11 kHz and 13 kHz respectively.

When this sound collector 200 is used in an outdoor environment with rain or snow or even indoor environment in which an atomized lubricant, etc., scatters, the diaphragm of the microphone may be soiled, which may change the mass of the diaphragm, cause fluctuations in the microphone characteristic and prevent accurate acoustic diagnosis.

Therefore, it is possible to prevent soiling of the microphone by covering the opening of the sound collection hood with a sheet-like material.

Figure 17A:
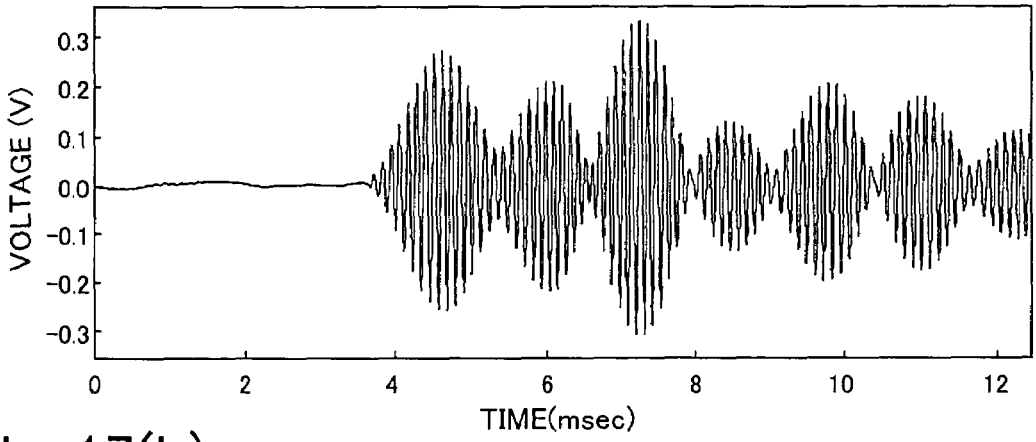
FIG. 17(*a*), FIG. 17(*b*) and FIG. 17(*c*) illustrate voltage waveforms output from the sound collector when a tone burst having a duration of 2 ms is collected.
Figure 17B:
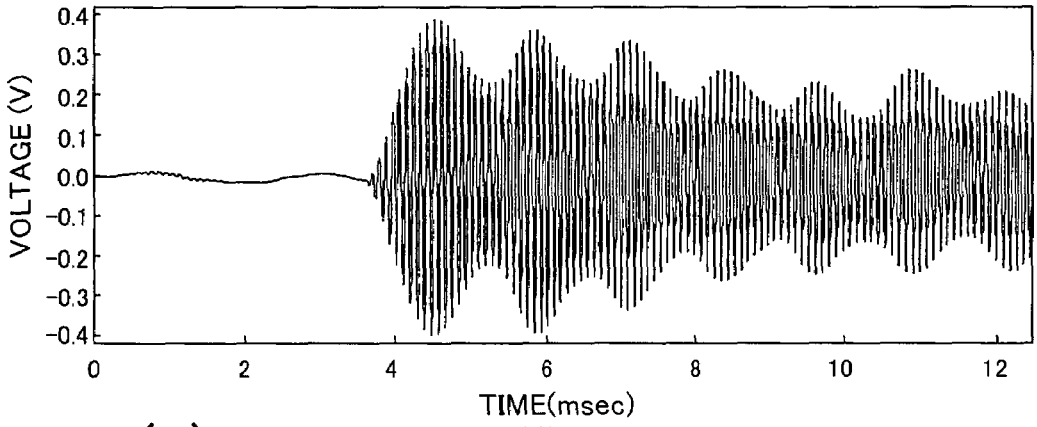
Figure 17C:
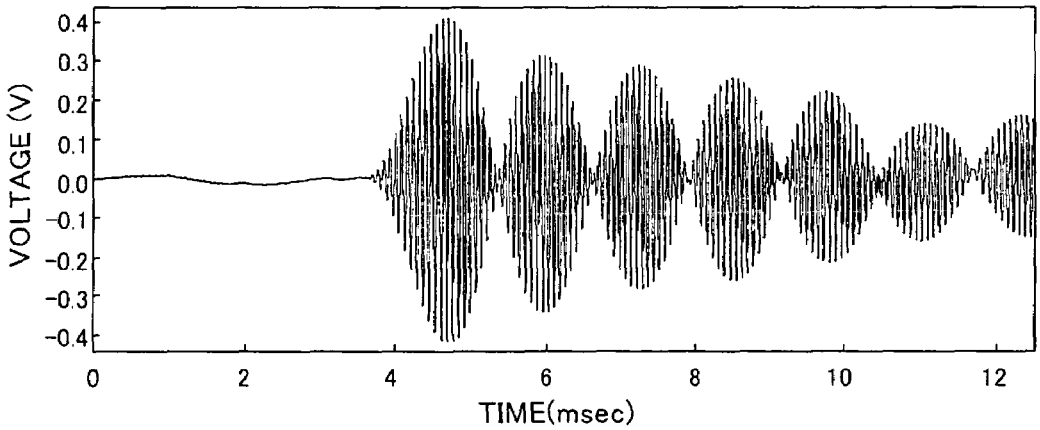

FIGS. 17(*a*) to (*c*) illustrate voltage waveforms output from the sound collector when a tone burst having a duration of 2 ms is collected with the opening of the sound collection hood of the sound collector 200 covered with a vinyl sheet of 0.1 mm in thickness.

As in the case of FIG. 16(*a*) to FIG. 16(*c*), FIG. 17(*a*) to FIG. 17(*c*) show voltage waveforms output from the sound collector due to transmission of tone bursts having frequencies of 9 kHz, 11 kHz and 13 kHz. Here, unlike the waveforms shown in FIG. 16(*a*) to FIG. 16(*c*), waveforms having a long tail are shown.

Figure 18A:
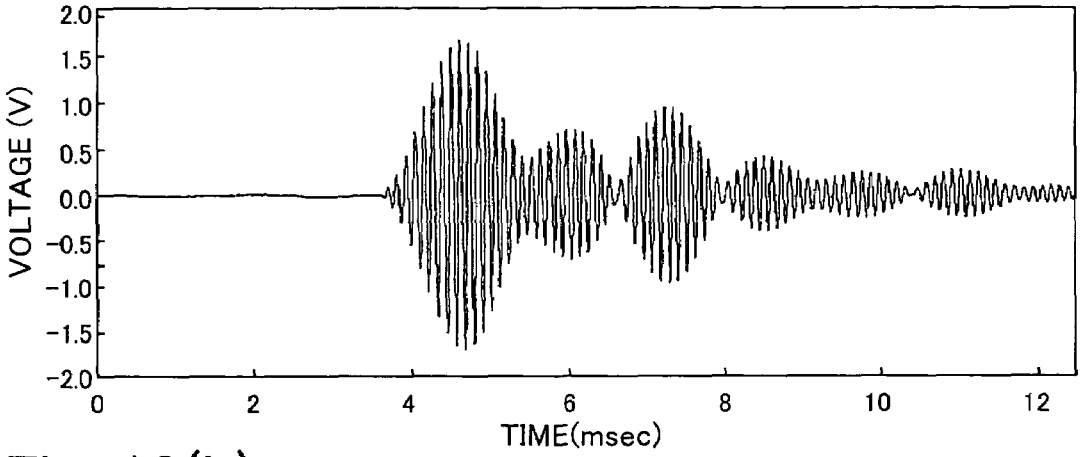
FIG. 18(*a*), FIG. 18(*b*) and FIG. 18(*c*) illustrate voltage waveforms obtained when a film thinner than the vinyl sheet used in FIG. 17 is used.
Figure 18B:
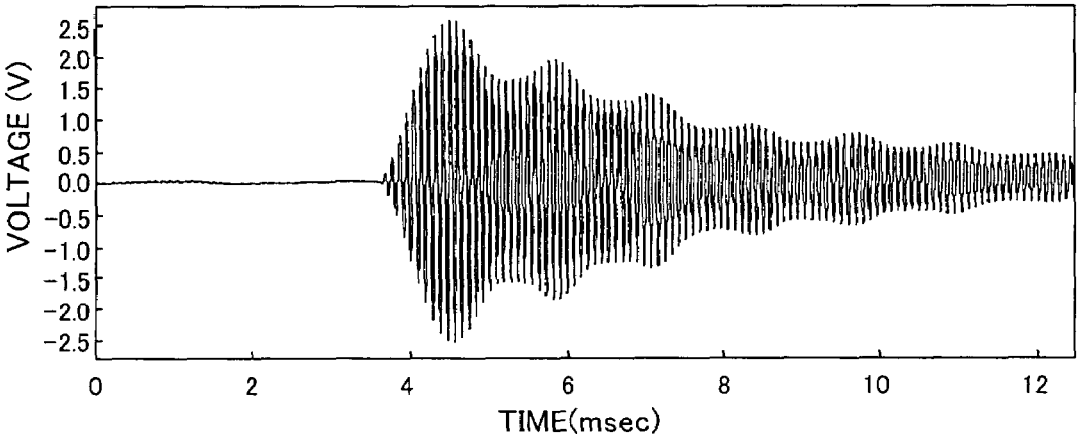
Figure 18C:
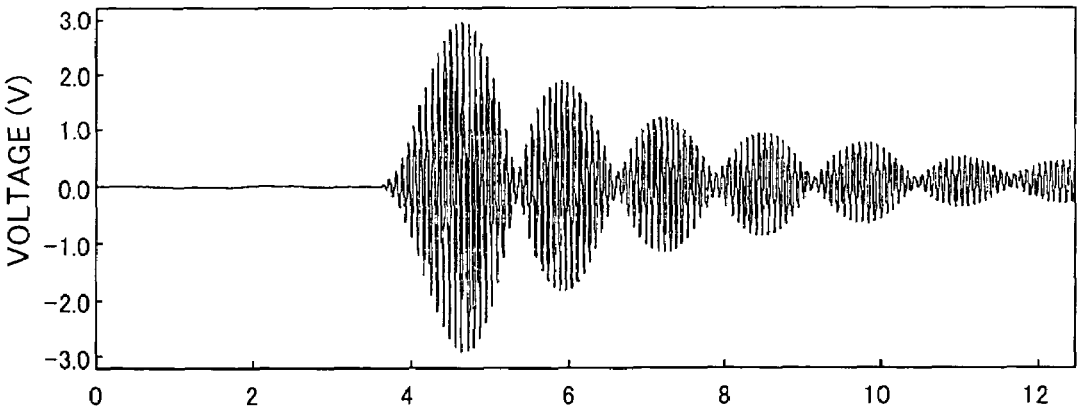

FIGS. 18(*a*) to (*c*) illustrate voltage waveforms obtained when a film thinner than the vinyl sheet used in FIGS. 17(*a*) to (*c*) is used.

FIG. 18(*a*) to FIG. 18(*c*) also show voltage waveforms output from the sound collector through transmission of tone bursts having frequencies of 9 kHz, 11 kHz and 13 kHz, but these figures show waveforms with a relatively reduced tail compared to the waveforms shown in FIG. 17(*a*) to FIG. 17(*c*).

However, the waveforms shown in FIG. 18(*a*) to FIG. 18(*c*) are also totally different from the waveforms shown in FIG. 16(*a*) to FIG. 16(*c*). This is because a sound wave which has entered the hood is multiple-reflected between the hood inner wall and vinyl sheet and has become a standing wave.

For this reason, this sheet-like material is normally used slackened instead of being tensioned in order to prevent multiple reflection. However, this results in a problem that fluttering of the sheet-like material due to wind would cause acoustic noise, preventing accurate acoustic diagnosis.

Figure 19:
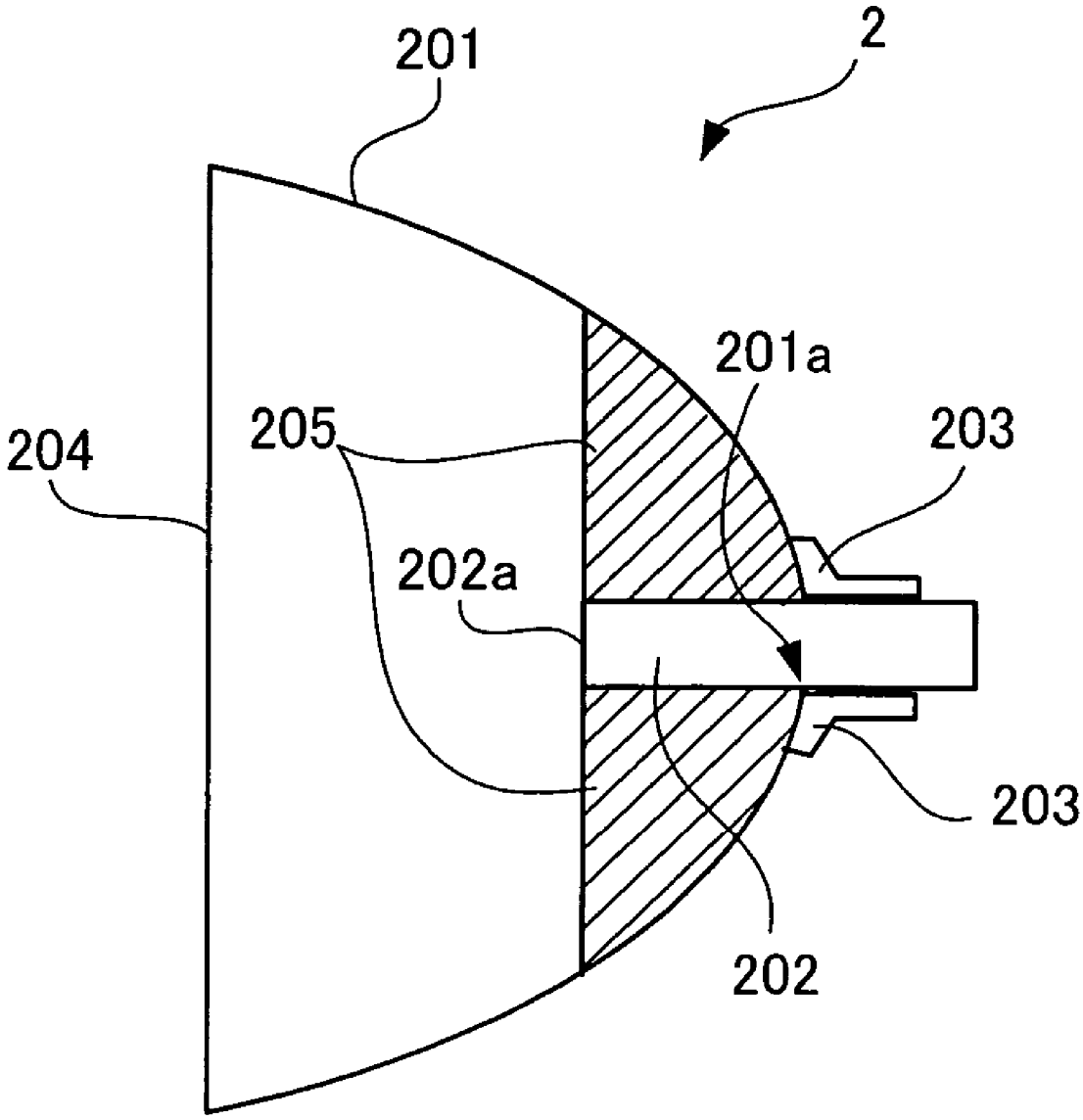
FIG. 19 is a cross-sectional view of an embodiment of a second sound collector of the present invention.

FIG. 19 is a cross-sectional view of an embodiment of the second sound collector of the present invention. The components shown in FIG. 19 of the same types as those shown in FIG. 15 are assigned the same reference numerals as those assigned in FIG. 15.

FIG. 19 shows components of the sound collector 2 making up this embodiment such as a sound collection hood 201, a microphone 202, a fixture 203, a vinyl chloride sheet 204 which covers the opening of the sound collection hood 201 and glass wool 205 disposed around the microphone 202. Compared to the conventional sound collector 200 shown in FIG. 15, the sound collector 2 of this embodiment has the glass wool 205 disposed around the microphone and the opening of the sound collection hood 201 covered with the 0.1 mm tensioned vinyl chloride sheet 204. The sound receiving face of the microphone 202 is disposed at the focus position of the sound collection hood 201.

Figure 20:
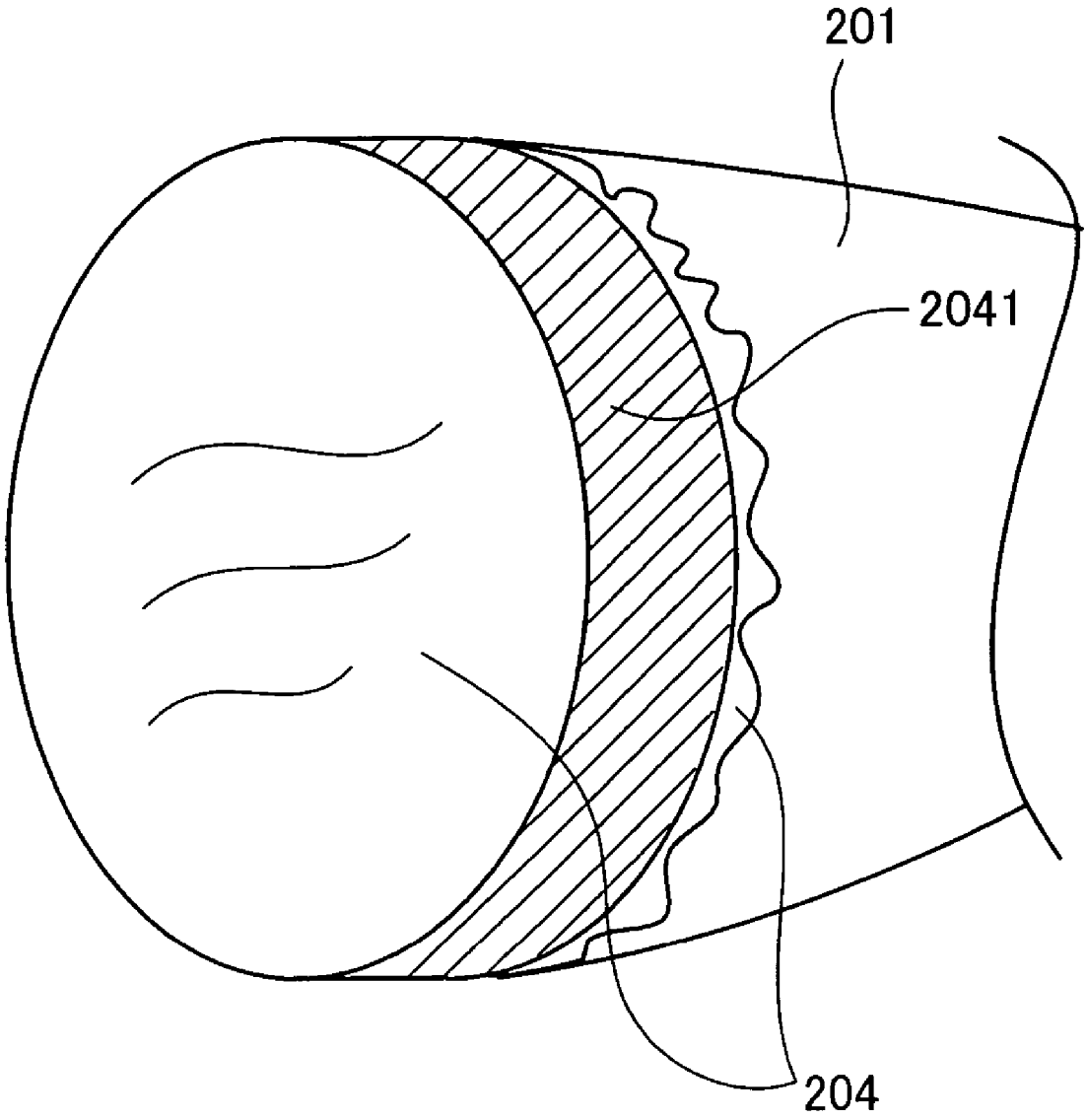
FIG. 20 illustrates a vinyl chloride sheet put on the sound collection hood.

FIG. 20 illustrates the vinyl chloride sheet put on the sound collection hood.

FIG. 20 shows how the vinyl chloride sheet 204 which is cut into the size enough to cover the opening of the sound collection hood with an adequate margin is put on the sound collection hood 201 to cover the opening of the sound collection hood with the vinyl chloride sheet 204 using a frame 2041 having a diameter slightly greater than the diameter of the opening, which can be put around the perimeter of the opening while covering the edge of the vinyl chloride sheet. The sound collector 2 of this embodiment is designed to facilitate replacement of this vinyl chloride sheet 204.

Figure 21A:
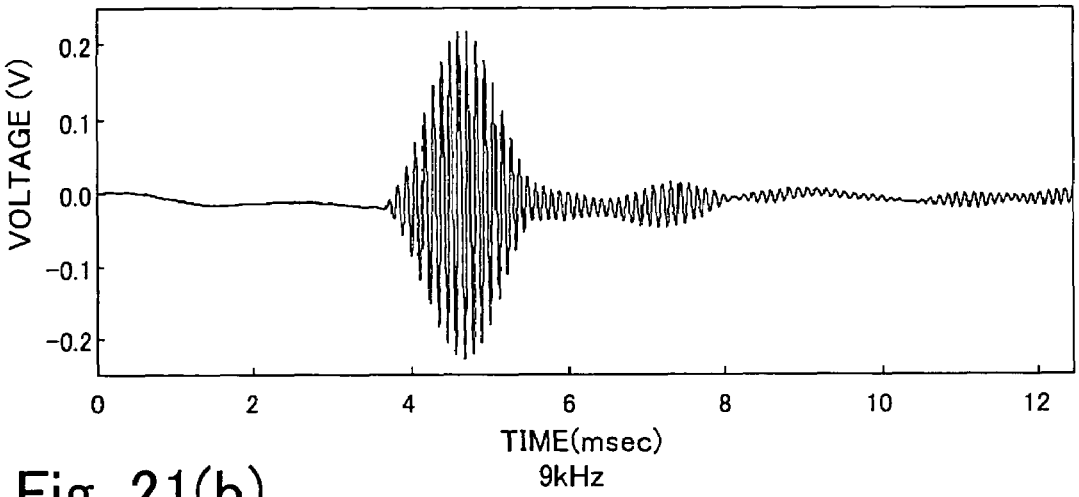
FIG. 21(*a*), FIG. 21(*b*) and FIG. 21(*c*) illustrate voltage waveforms output from the sound collector of this embodiment with the opening of the sound collection hood covered with a vinyl chloride sheet.
Figure 21B:
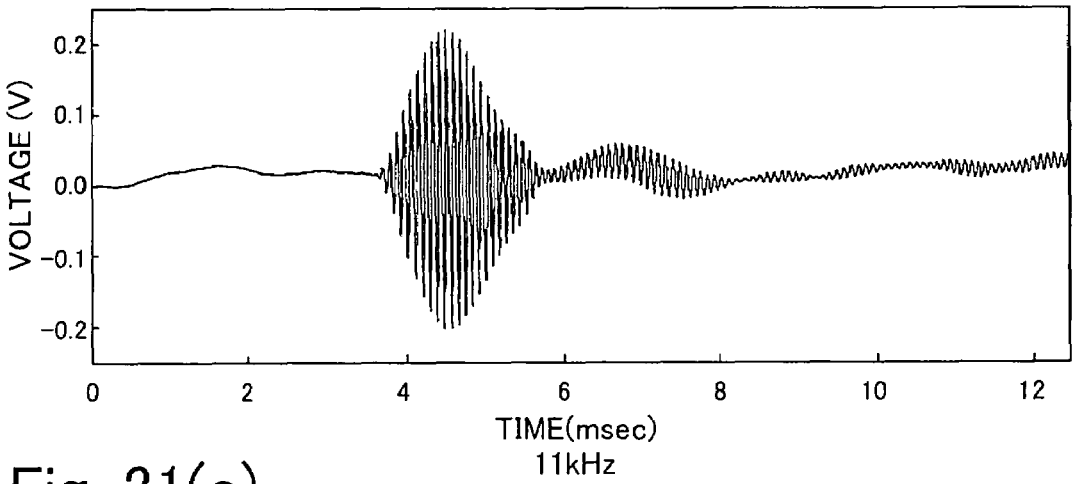
Figure 21C:
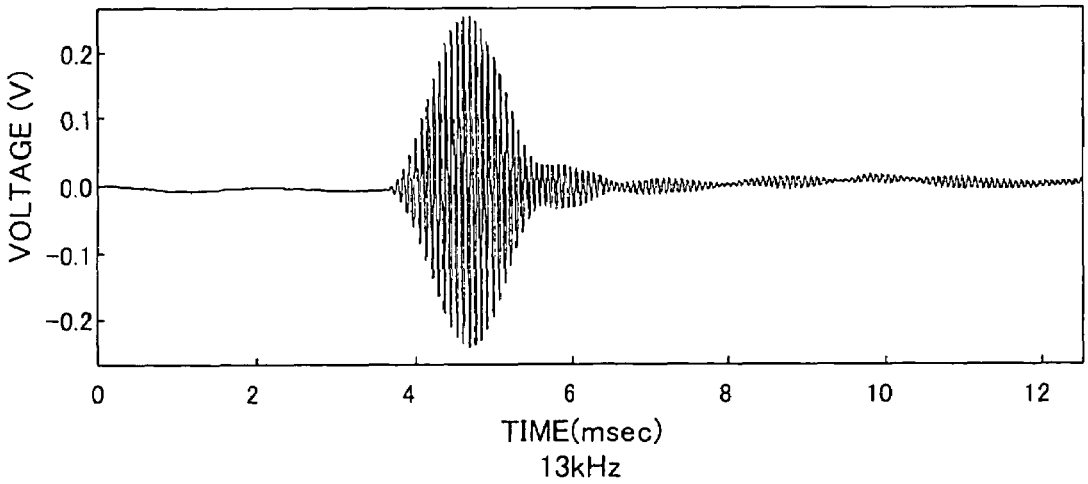

Here, FIG. 21 illustrates the sound collection performance of the sound collector 2 of this embodiment at various frequencies.

FIGS. 21(*a*) to (*c*) illustrate voltage waveforms output from the sound collector 2 when the same tone bursts as those used to obtain the voltage waveforms shown in FIGS. 16(*a*) to (*c*) to FIGS. 18(*a*) to (*c*) are collected using the sound collector 2.

Figure 22A:
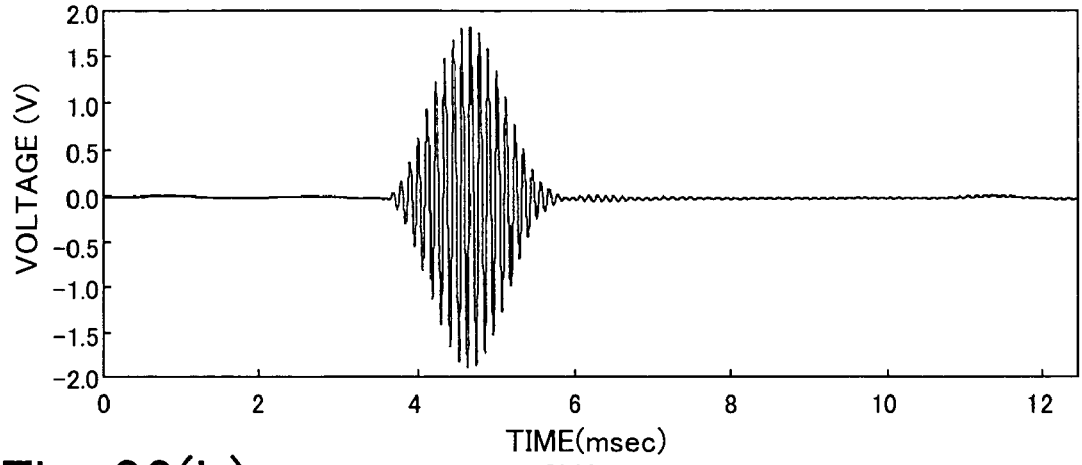
FIG. 22(*a*), FIG. 22(*b*) and FIG. 22(*c*) illustrate voltage waveforms output from the sound collector of this embodiment with the vinyl chloride sheet covering the opening of the sound collection hood removed.
Figure 22B:
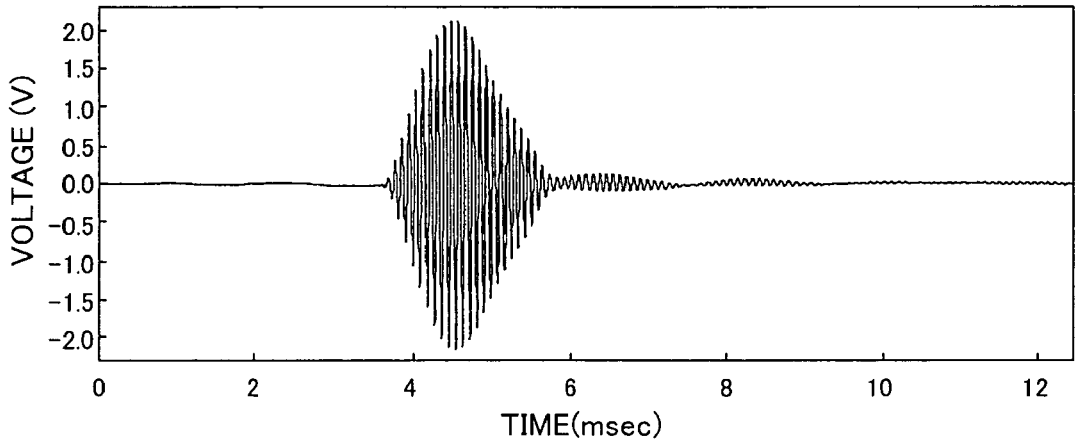
Figure 22C:
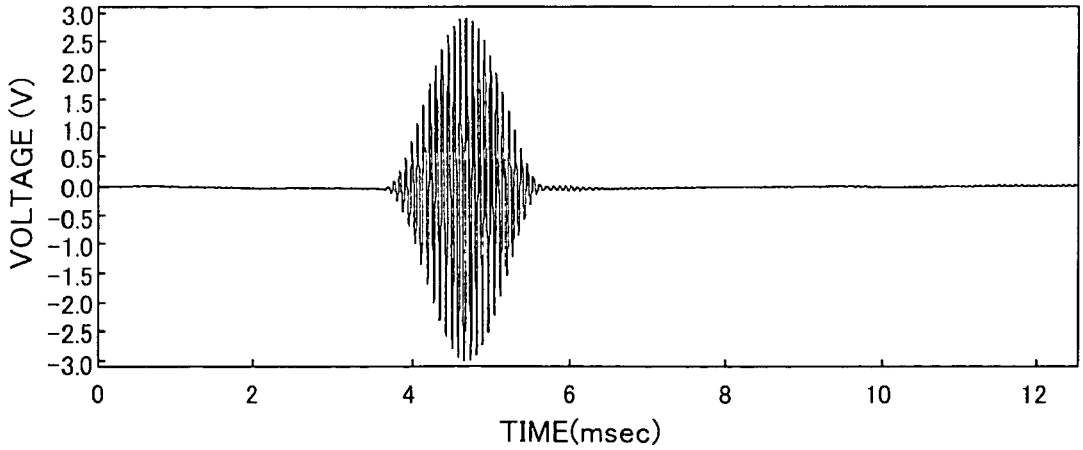

On the other hand, FIGS. 22(*a*) to (*c*) illustrate the sound collection performance of the sound collector of this embodiment with the vinyl chloride sheet covering the opening removed at various frequencies. Here, the same tone bursts as those collected in FIGS. 21(*a*) to (*c*) are collected, too.

FIGS. 22(*a*) to (*c*) illustrate that the sound collector 2 with the vinyl chloride sheet removed from the opening of the sound collection hood outputs substantially the same voltage waveform as the voltage waveform output from the conventional type sound collector 200 provided with neither the vinyl chloride sheet covering the opening of the sound collection hood nor the glass wool around the microphone. However, variations in voltage amplitude depending on the frequency are smaller than those in the conventional type.

Compared to FIGS. 22(*a*) to (*c*), it is evident from FIGS. 21(*a*) to (*c*) that though they have a certain tail, these waveforms are by far better sound pressure waveforms than the voltage waveforms output from the conventional sound collector with only the opening of the sound collection hood covered with the vinyl chloride sheet and with no glass wool provided around the microphone shown in FIGS. 17(*a*) to (*c*).

Figure 23A:
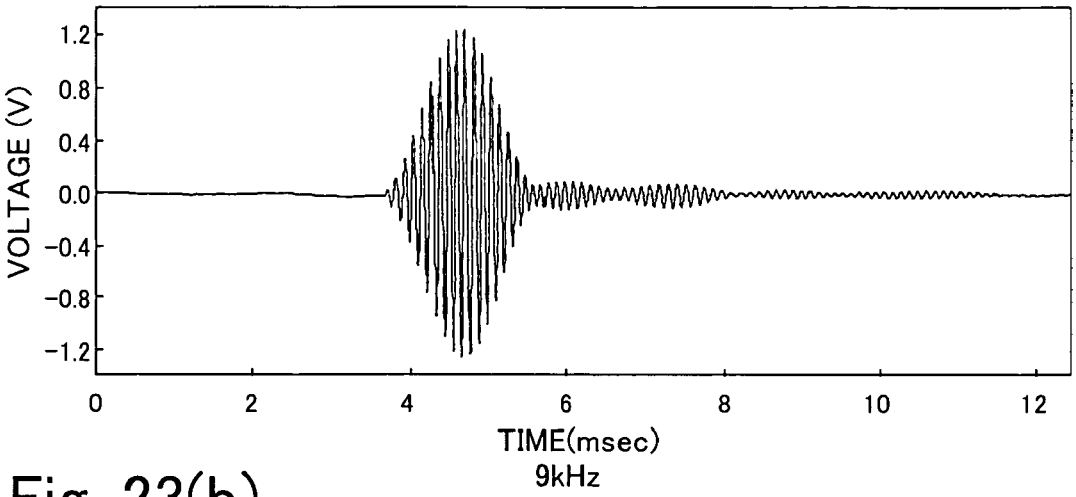
FIG. 23(*a*), FIG. 23(*b*) and FIG. 23(*c*) illustrate voltage waveforms output from the sound collector of this embodiment with the vinyl chloride sheet covering the sound collection hood replaced by a thin film.
Figure 23B:
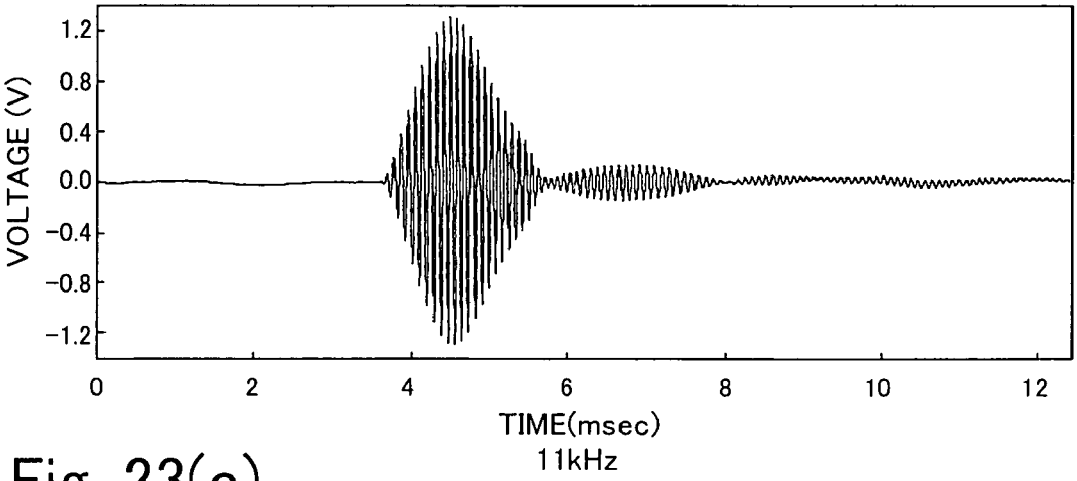
Figure 23C:
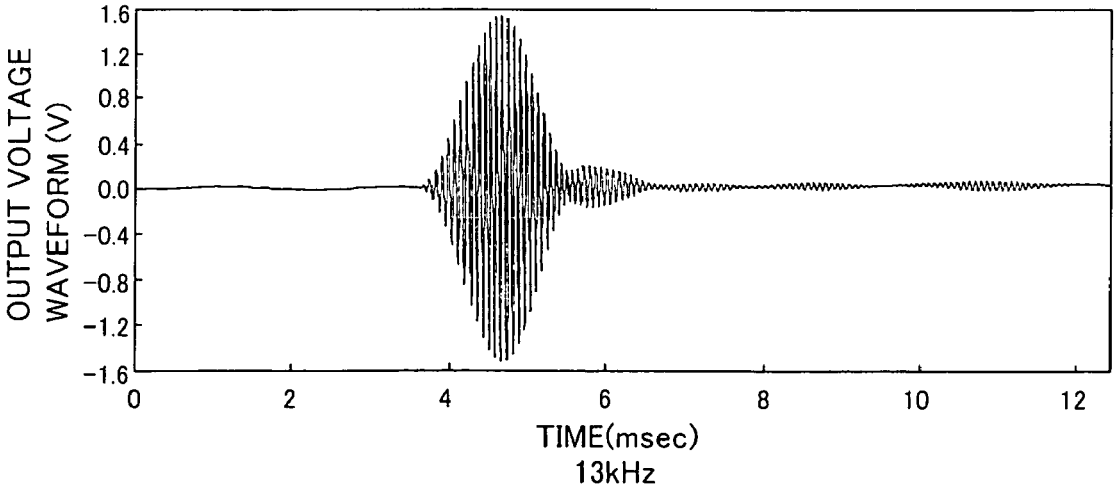

FIGS. 23(*a*) to (*c*) illustrate the sound collection performance of the sound collector of this embodiment with the vinyl chloride sheet covering the opening replaced by a film thinner than this vinyl chloride sheet at various frequencies. The same tone bursts as those collected in FIGS. 21(*a*) to (*c*) are collected here, too.

FIGS. 23(*a*) to (*c*) show better wave forms than the voltage waveform shown in FIGS. 21(*a*) to (*c*).

That is, as is obvious from a comparison between FIGS. 17(*a*) to (*c*) illustrating the voltage waveforms output from the conventional sound collector 200 and FIGS. 21(*a*) to (*c*) illustrating the voltage waveforms output from the sound collector 2 of this embodiment, according to the sound collector 2 of this embodiment, even if the opening of the sound collection hood is covered with vinyl chloride, the glass wool disposed around the sound receiving face of the microphone in the sound collection hood suppresses generation of a standing wave which would occur between the inner wall surface of the sound collection hood and the partition wall of the conventional sound collector provided with only the partition wall and with no acoustical absorbent surrounding the perimeter of the sound receiving face of the microphone. Therefore the sound collection performance of the voltage waveform output from the sound collector 2 of this embodiment is prevented from deteriorating more than the voltage waveform output from the conventional sound collector 200. Consequently, according to sound collector 2 of this embodiment, it is possible to prevent deterioration of the sound collection performance and prevent soiling of the microphone disposed in the sound collection hood simultaneously. This effect is not reduced even if the material covering the opening of the sound collection hood is switched from vinyl chloride to a film thinner than this vinyl chloride.

The above described embodiment has explained the case where the acoustical absorbent is disposed around the microphone in the sound collection hood of the sound collector as an example, but by using the sound collection hood with this acoustical absorbent also disposed around the perimeter of the opening of the sound collection hood, it is possible to attenuate sound waves arriving from the side of or behind the hood, diffracted at the edge of the opening of the hood and entering the hood and thereby suppress the very sound waves entering between the sound collection inner wall surface and the partition wall. This contributes to prevention of deterioration of the sound collection performance.

Figure 24:
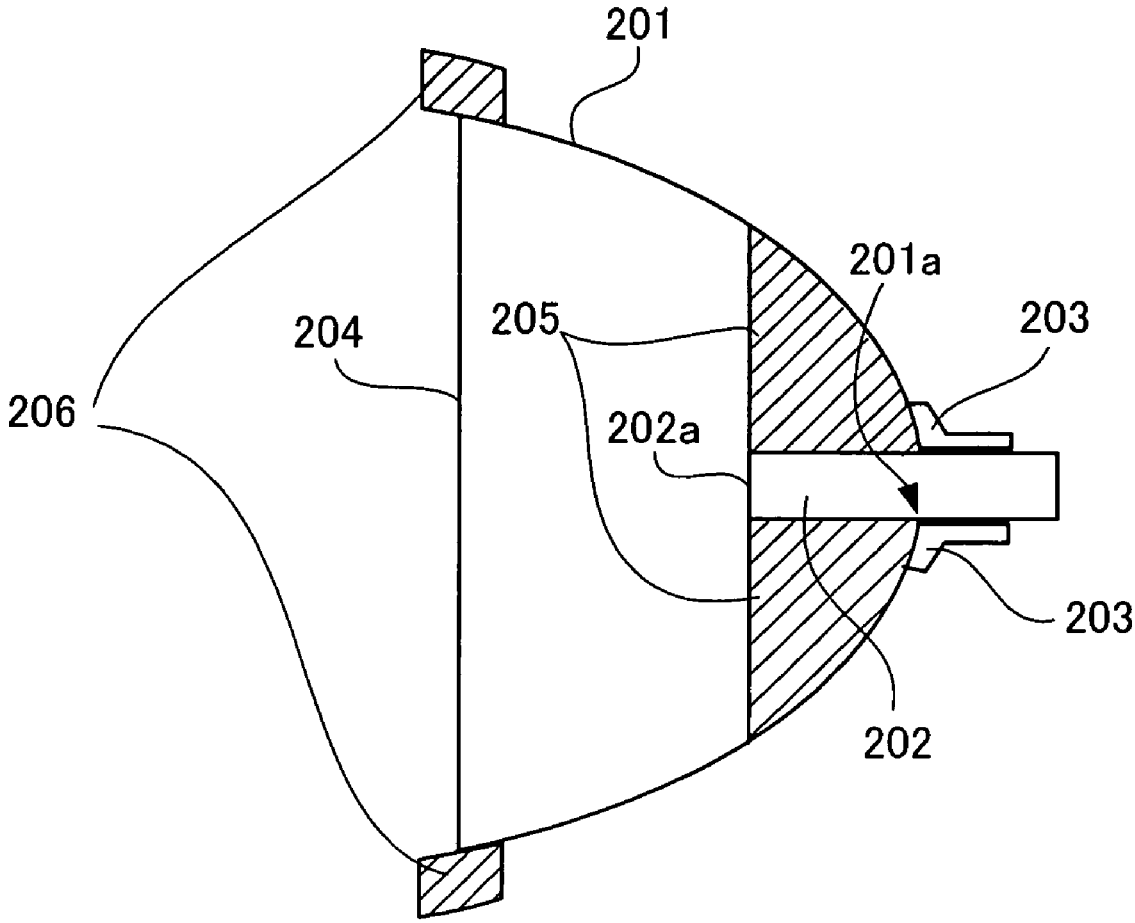
FIG. 24 is a cross-sectional view showing an example of a sound collection hood with an acoustical absorbent also disposed around the perimeter of the opening of the sound collection hood.

Here, FIG. 24 is a cross-sectional view of an example of a sound collection hood with an acoustical absorbent also disposed around the perimeter of the opening of the sound collection hood. The same types of components shown here as those used in the above described embodiment are assigned the same reference numerals as those assigned in the above described embodiment.

As described above, the sound collection hood 201 shown in FIG. 24 is also provided with glass wool 206, the acoustical absorbent, all around the perimeter of the opening in addition to the perimeter of the microphone 202. The glass wool 206 around the perimeter of the opening is not limited to the one disposed all around the perimeter as shown in FIG. 24, but the glass wool may also be disposed in a detachable manner.

Furthermore, by disposing the glass wool 206 around the perimeter of the sound collection hood opening 204 in addition to the perimeter of the microphone 202 and attenuating sound waves diffracted by the edge of the opening of the hood and entering the hood, deterioration of directivity is also suppressed.

FIG. 25(*a*) and FIG. 25(*b*) are graphs showing directional characteristics of the sound collector.

FIG. 25(*a*) shows a directional characteristic of the sound collector with the acoustical absorbent disposed only around the microphone, FIG. 25(*b*) shows a directional characteristic of the sound collector in a mode of the above described embodiment with the acoustical absorbent also disposed around the perimeter of the opening of the sound collection hood in addition to the perimeter of the microphone at various frequencies.

From FIG. 25(*a*) and FIG. 25(*b*), it is evident that disposing the acoustical absorbent around the perimeter of the opening of the sound collection hood in addition to the perimeter of the microphone improves the directional characteristic sideward or behind the sound collector at 1 kHz and noticeably improves the directivity right behind in particular, and improves the directivity in the direction close to the front of the sound collector at 10 kHz.

Furthermore, also disposing the acoustical absorbent around the perimeter of the opening of the sound collection hood lessens the impact when the opening of the sound collector contacts the test object, and can thereby provide the effect of preventing breakage of the two.

The above described embodiment has explained the case where a sheet-like material such as vinyl chloride and film is used as the partition wall as an example, but the present invention is not limited to this and can be any material having at least sound wave permeability can be applied. The position of the partition wall in the sound collection hood is not limited to the surface of the opening but can be any position which is at least ahead of the sound receiving face of the microphone. Furthermore, the above described embodiment has explained the case where the partition wall is disposed in a manner detachable from the sound collection hood as an example, but the present invention is not limited to this and even the partition wall fixed to the sound collection hood does not reduce the effects of the present invention. Furthermore, the above described embodiment has explained the case where glass wool is used as the acoustical absorbent as an example, but the acoustical absorbent is not limited to glass wool and any material at least having a sound absorbing function can be used. Furthermore, this partition wall is not limited to a flat plane but can also be a curved surface, etc.

Furthermore, it is also possible to provide a mesh-like or grid-like guard on the surface of the partition wall or on the front of the partition wall to prevent breakage of the partition wall.

Furthermore, the above described embodiment has explained the case where the acoustical absorbent is also disposed outside the perimeter of the opening as an example, but the present invention is not limited to this and the acoustical absorbent of the present invention can also be disposed inside the perimeter.

Finally, an embodiment using a sound collector provided with glass wool around the microphone for a hammering tone test system which hits a test object using a striking tool such as a hammer, collects sound generated by the hammering using a microphone and analyzes the sound to detect defects such as cavities inside the test object will be explained.

Figure 26:
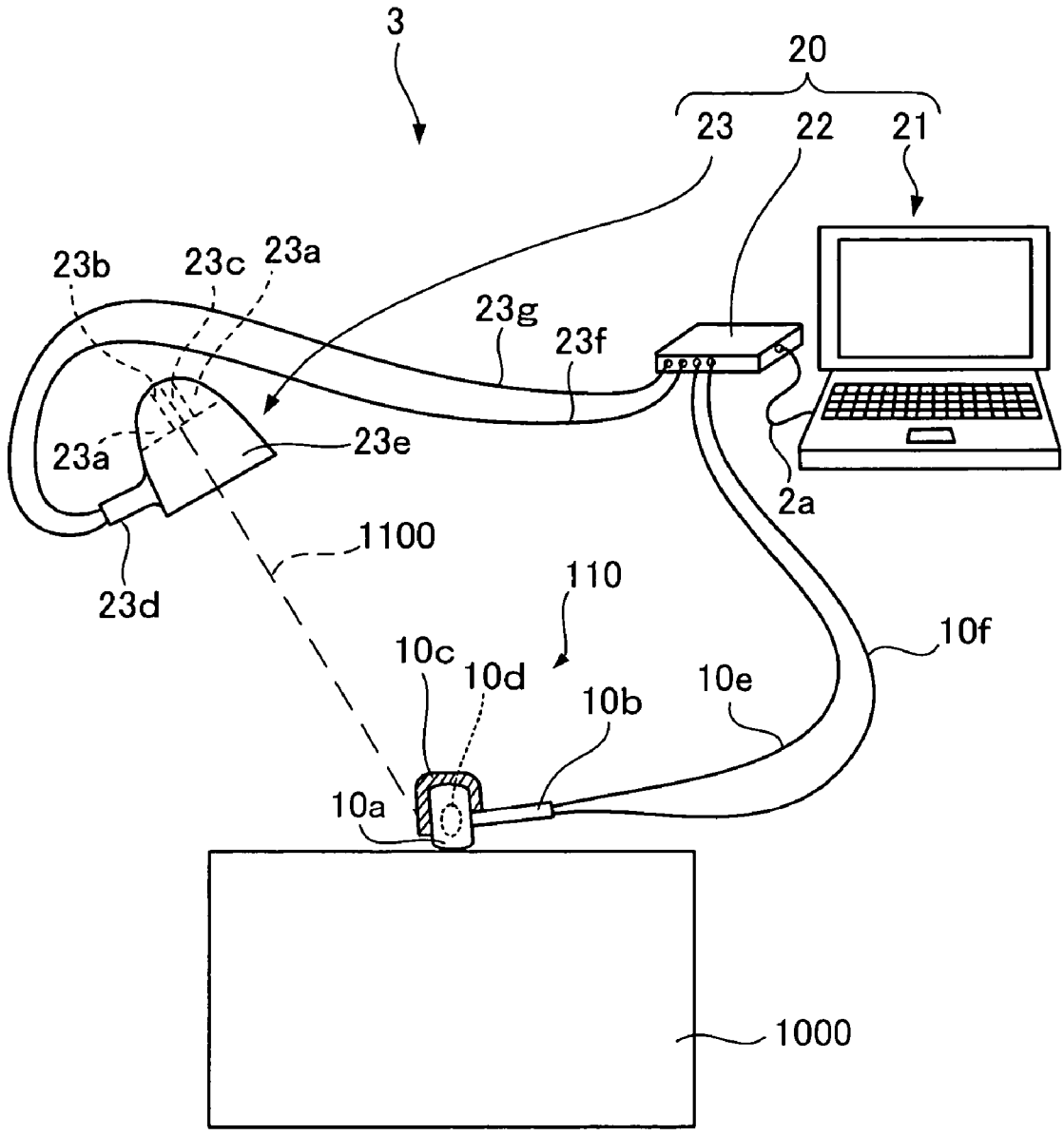
FIG. 26 is a block diagram of a first embodiment of a hammering tone test system.

FIG. 26 is a block diagram of a first embodiment of a hammering tone test system.

The hammering tone test system 3 in this embodiment shown in FIG. 26 is constructed of an impulse hammer 110 and a defect detection apparatus 20, and the defect detection apparatus 20 is constructed of a sound collector 23 which collects hammering tone, a relay 22 which collects various types of signals and converts the signals into digital signals and a personal computer 21 (hereinafter referred to as "PC") which analyzes the various types of signals from the relay 22.

The impulse hammer 110 is constructed of a handle 10*b*, a hammering section 10*a*, a first laser beam light-receiving section 10*c* which transmits a received laser beam to the relay 22, a force application output section 10*d* which outputs a voltage signal according to the hammering force, a first signal line 10*e* for transmitting the voltage signal output from the force application output section 10*d* and a first optical fiber line 10*f* for transmitting the laser beam received by the laser beam light-receiving section 10*c*.

The sound collector 23 is constructed of a microphone 23*c* which collects a hammering tone generated by hammering of the test object using the impulse hammer 110, a sound collection hood 23*e* which prevents surrounding sound from being collected by the microphone, a handle 23*d* provided outside the sound collection hood 23*e*, a laser beam emitting section 23*b* which emits a laser beam, glass wool 23*a* which is an acoustical absorbent disposed around the microphone 23*c* and a second signal line 23*g* for transmitting the hammering tone signal output from the microphone 23*c* to the relay 22. The laser beam emitting section 23*b* is constructed of a laser diode, a beam output control section which changes the beam output by changing a current applied to this laser diode and a beam splitter which splits the laser beam emitted from the laser diode into the hood opening direction and relay 22. A second optical fiber line 23*f* for transmitting one portion of the laser beam emitted from the laser diode and split by the beam splitter to the relay 22 is also a component of the sound collector 23 shown in FIG. 26.

The relay 22 is connected to the first signal line 10*e* and first optical fiber line 10*f* from the impulse hammer 110 and to the second signal line 23*g* and second optical fiber line 23*f* from the sound collector 23, which causes the laser beams transmitted from the first optical fiber line 10*f* and second optical fiber line 23*f* to interfere with each other, converts various types of signals into digital signals and transmits the digital signals to the PC 21 via a third signal line 2*a* The PC 21 corrects the various types of digital signals sent from the relay 22 and displays waveforms of the various types of digital signals on a display screen.

Figure 27:
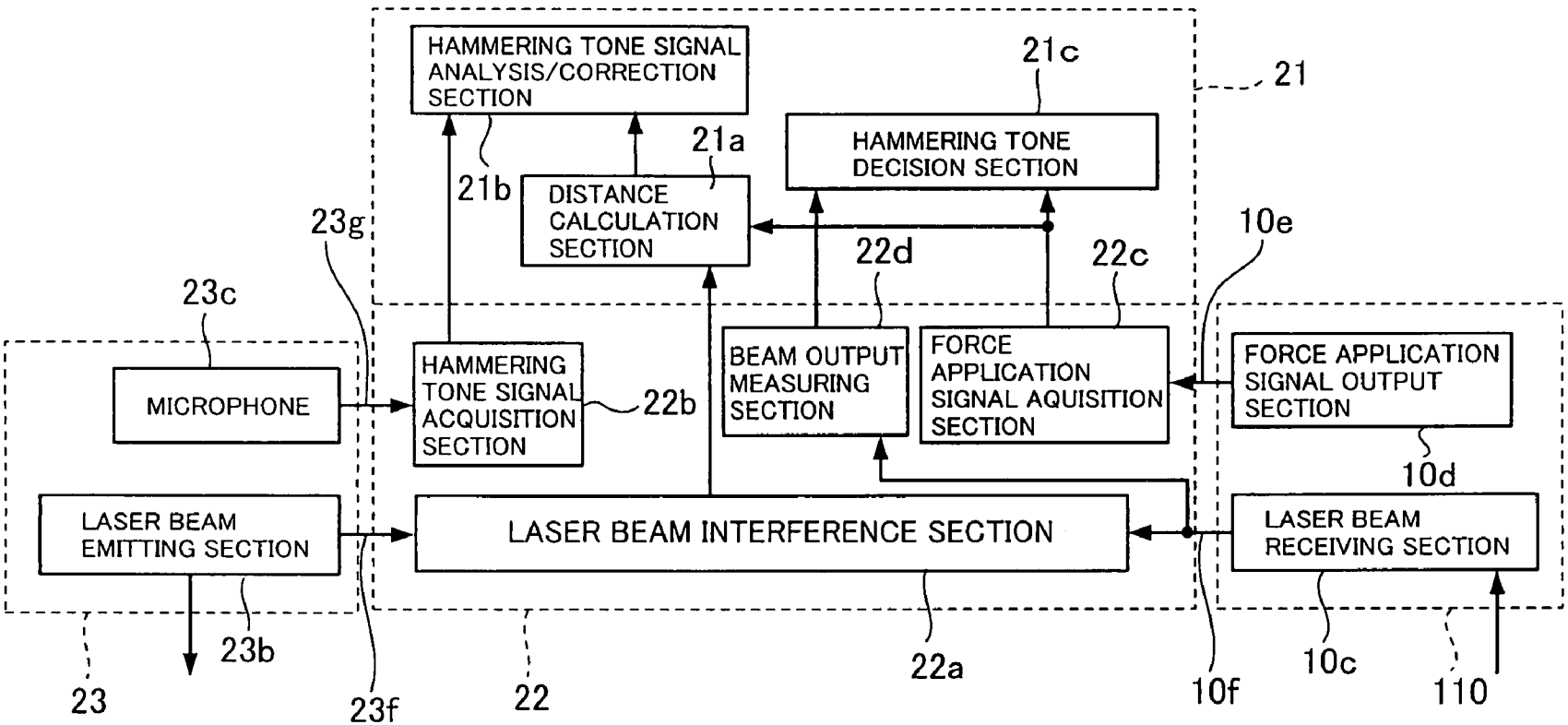
FIG. 27 is an internal block diagram of the hammering tone test system of this embodiment.

FIG. 27 is an internal block diagram of the hammering tone test system of this embodiment.

FIG. 27 shows the internal block of the sound collector 23 on the left, internal block of the PC 21 at the top center, internal block of the relay 22 at the bottom center and internal block of the impulse hammer 110 on the right.

The impulse hammer 110 shown on the right in FIG. 27 is constructed of the force application signal output section 10*d* and the laser beam light-receiving section 10*c* which receives the laser beam emitted from the laser beam emitting section 23*b* of the sound collector 23 and transmits the laser beam to the relay 22.

The sound collector 23 shown on the left in FIG. 27 is constructed of the microphone 23*c* which collects a hammering tone and outputs a hammering tone signal and the laser beam emitting section 23*b*.

The relay 22 shown at the bottom center in FIG. 27 is constructed of a hammering tone signal acquisition section 22*b* which acquires the hammering tone signal from the microphone 23*c*, a laser beam interference section 22*a* which causes the laser beam sent from the laser beam emitting section 23*b* to interfere with the laser beam sent from the laser beam light-receiving section 10*c*, a beam output measuring section 22*d* which measures the output of the laser beam from the laser beam light-receiving section 10*c* and a force application signal acquisition section 22*c* which acquires the force application signal from the impulse hammer 110.

The PC 21 shown at the top center in FIG. 27 is constructed of a distance calculation section 21*a* which calculates the distance between the microphone 23*c* and the hammering point based on the result of interference detected by the laser beam interference section 22*a* of the relay 22 and timing at which the force application signal is obtained by the force application signal acquisition section 22*c*, a hammering decision section 21*c* which decides whether the hammering has been carried out accurately at the hammering point indicated by the laser beam or not or whether the hammering force applied falls within a predetermined range or not based on the timing at which the force application signal is obtained by the force application signal acquisition section 22*c*, the output of the force application signal and the output of the laser beam obtained through the hammering, and a hammering tone signal analysis/correction section 21*b* which corrects the hammering tone signal from the hammering tone signal acquisition section 22*b* of the relay 22 based on the distance information from the distance calculation section 21*a* and analyzes the hammering tone signal.

A case where internal defects of the test object 1000 placed indoors shown in FIG. 26 are detected using the hammering tone test system 3 will be explained below.

Figure 28:
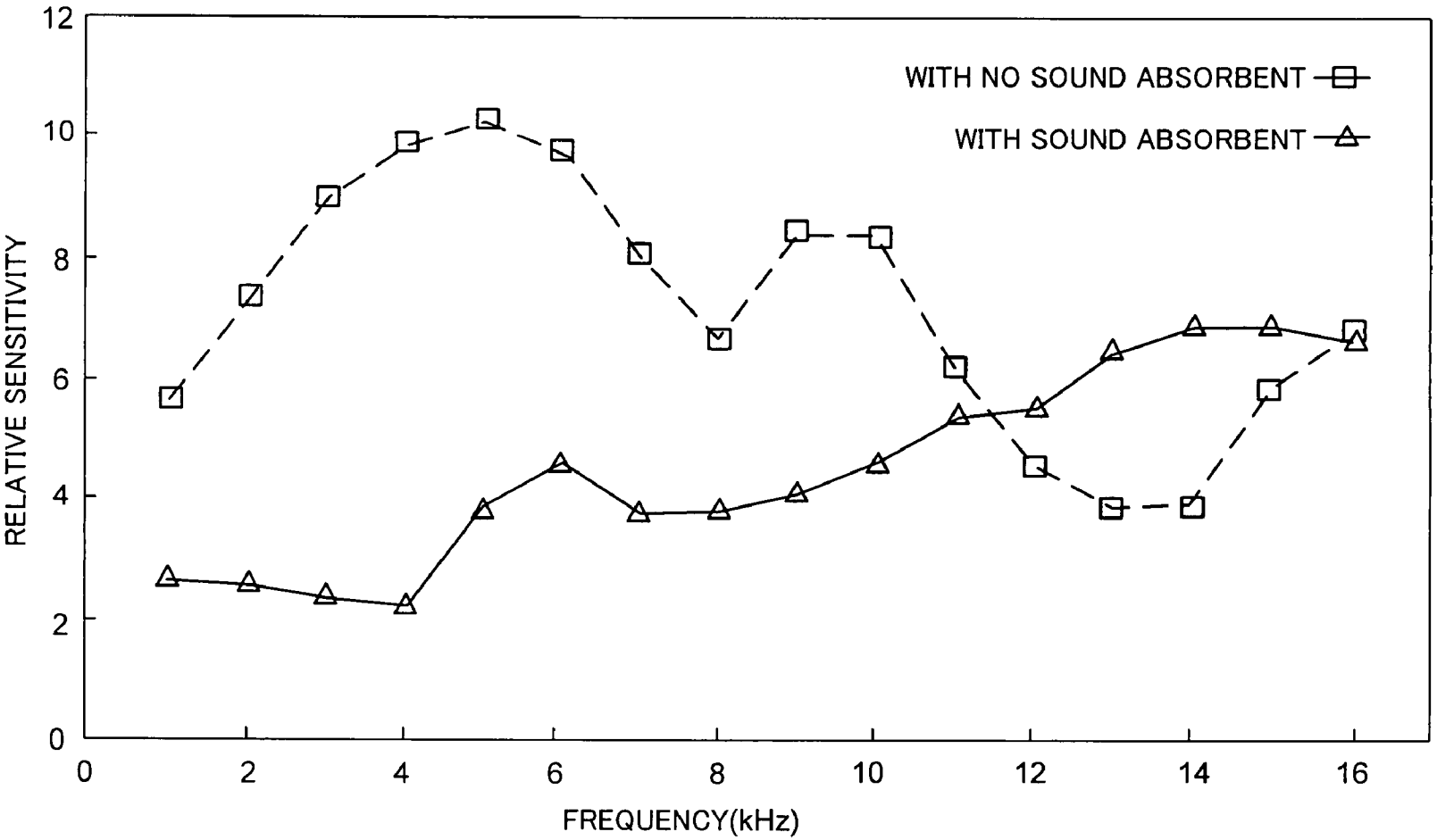
FIG. 28 is a frequency characteristic diagram corresponding to hammering tone of the sound collector of this embodiment.

Here, FIG. 28 is a frequency characteristic diagram of a hammering signal output from the microphone disposed in the sound collection hood of the sound collector of this embodiment.

FIG. 28 shows a frequency characteristic of the sound collector measured in response to the hammering. Here, the frequency characteristic is expressed by relative sensitivity with reference to a measuring capacitor microphone whose frequency characteristic is calibrated to be flat.

As shown in FIG. 28, in the case of the sound collector with no acoustical absorbent disposed at the back in the collection hood 23*e*, sensitivity reaches a peak in a frequency band of approximately 2 kHz to 6 kHz due to reflection of sound waves inside the sound collection hood and sensitivity decreases in a frequency band of approximately 11 kHz to 15 kHz. On the other hand, the sound collector 23 with the acoustical absorbent 23*a* disposed at the back in the collection hood 23*e* shows a flat characteristic over the entire measuring frequency band. From this, it is evident that the hammering tone test system 3 of this embodiment provided with the acoustical absorbent 23*a* disposed at the back in the collection hood 23*e* of the sound collector 23 can collect sound closer to the transmitted sound than the case with no acoustical absorbent 23*a* disposed. This is because with the acoustical absorbent 23*a* disposed at the back in the sound collection hood, sound waves, which would be conventionally reflected in the sound collection hood and collected by the microphone, are absorbed by the acoustical absorbent and thereby prevented from being reflected in the sound collection hood, hardly producing interference with sound waves directly collected by the microphone.

The laser beam emitting section 23*b* and microphone 23*c* are disposed at the center back in the sound collection hood 23*e* of the sound collector 23 of the hammering tone test system 3 and the above described acoustical absorbent 23*a* is attached between them and the inner wall of the sound collection hood 23*e*.

When the power supply of this hammering tone test system 3 is turned ON to start a testing on the test object 1000 shown in FIG. 26 and the laser beam emitting button (not shown) provided for the sound collector 23 is turned ON, the laser beam 1100 is emitted from the laser beam emitting section 23*b* along the axis of rotation of the sound collection hood 23*e* shaped as a rotating surface.

As described above, the beam output of this laser beam 1100 is always changed by the output control section. This is intended to prevent the distance between the microphone 23*c* and hammering point from becoming unmeasurable when the phase difference between the laser beam emitted from the laser beam emitting section 23*b* and sent to the relay 22 and the laser beam having the same phase as that of the laser beam sent to this relay 22 and emitted from the laser beam emitting section 23*b* to a test object through the opening of the sound collection hood, that is, the laser beam received by the impulse hammer 110 becomes an integer multiple of the wavelength.

Furthermore, this laser beam 1100 is emitted along the axis of rotation of the sound collection hood 23*e* shaped like a rotating surface, and therefore by irradiating a desired hammering point with this laser beam 1100 and hammering the irradiated part, the hammering tone is collected by the sound collector 23 accurately.

Figure 29A:
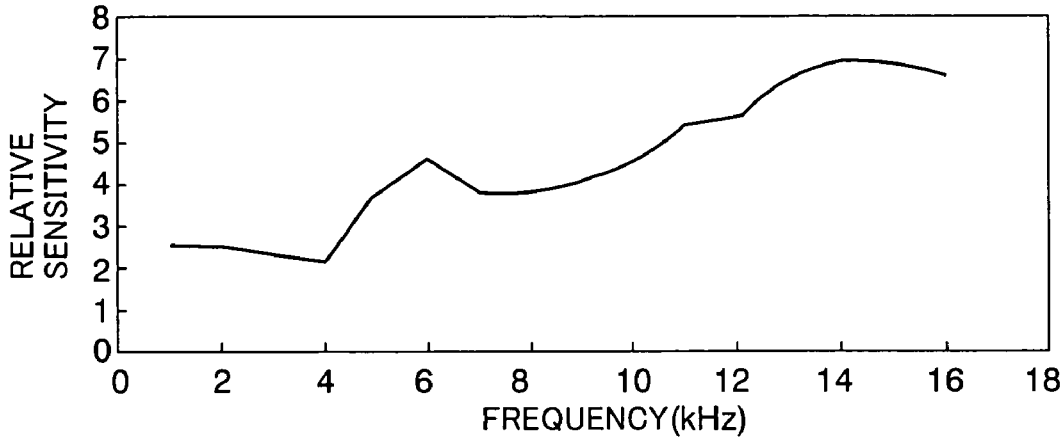
FIG. 29(*a*), FIG. 29(*b*) and FIG. 29(*c*) illustrate how the sound-collecting characteristic of the microphone of this embodiment varies depending on the angle in the sound source direction with respect to the axis of rotation of the sound collection hood shaped like a rotating surface.
Figure 29B:
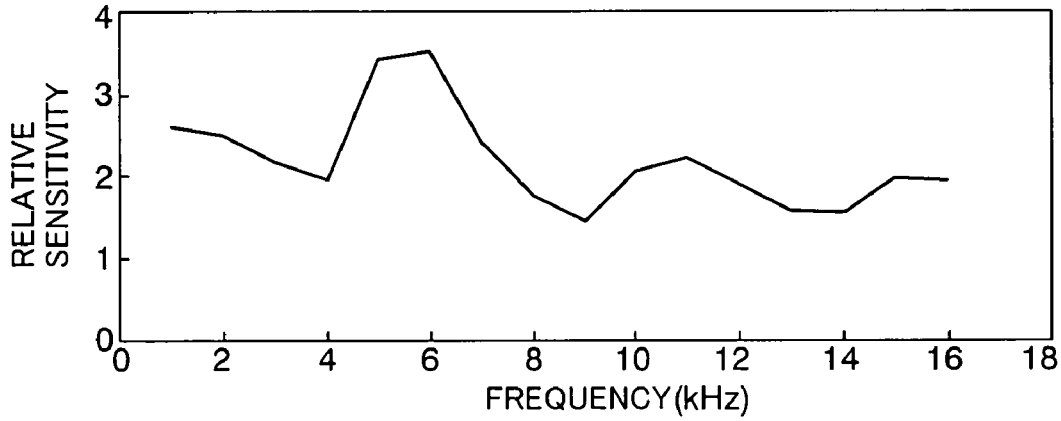
Figure 29C:
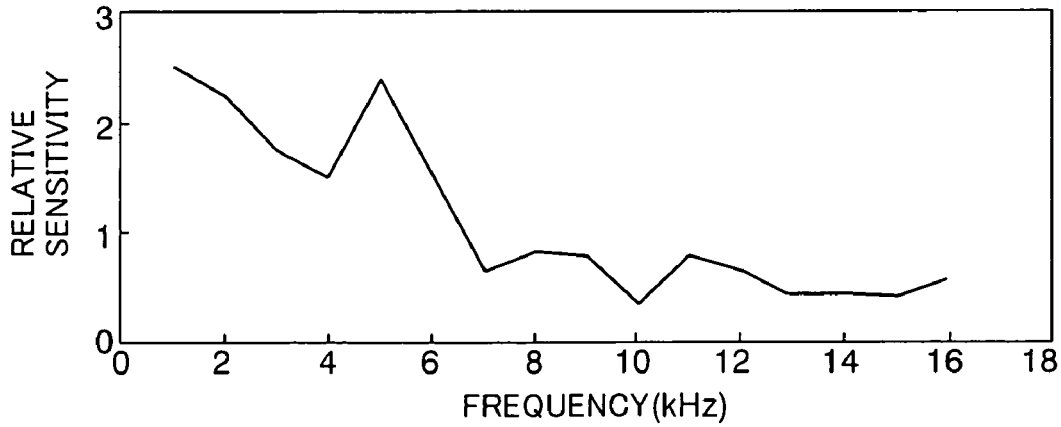

FIGS. 29(*a*) to (*c*) illustrate how the sound-collecting characteristic of the microphone of this embodiment varies depending on the angle in the sound source direction with respect to the axis of rotation of the sound collection hood shaped like a rotating surface.

FIG. 29(*a*) to FIG. 29(*c*) show relative sensitivity at various frequencies when the angle in the sound source direction with respect to the axis of rotation of the sound collection hood 23*e* which has a rotating surface is 0, 6 and 12 degrees. In the frequency range of 0 kHz to 16 kHz, FIG. 29(*a*) shows that relative sensitivity changes from 2 to 7, while FIG. 29(*b*) shows that relative sensitivity changes from 1 to 3.5 and FIG. 29(*c*) shows that relative sensitivity changes from 0.5 to 2.5, which indicates that sensitivity with respect to high frequencies dulls as the angle in the sound source direction with respect to the axis of rotation of the sound collection hood increases.

In this hammering tone test system 3, hammering on the test object is carried out while moving the sound collector 23 so as to irradiate this laser beam 1100 at hammering positions on the test object whose hammering order is predetermined and the impulse hammer 110 sends a force application signal according to the hammering force to the relay 21 every time hammering is carried out. Furthermore, the microphone 23*c* of the sound collector 23 collects the hammering tone generated by hammering on the test object using this impulse hammer 110 and the sound collector 23 sends a hammering tone signal according to this hammering tone to the relay 22.

Figure 30:
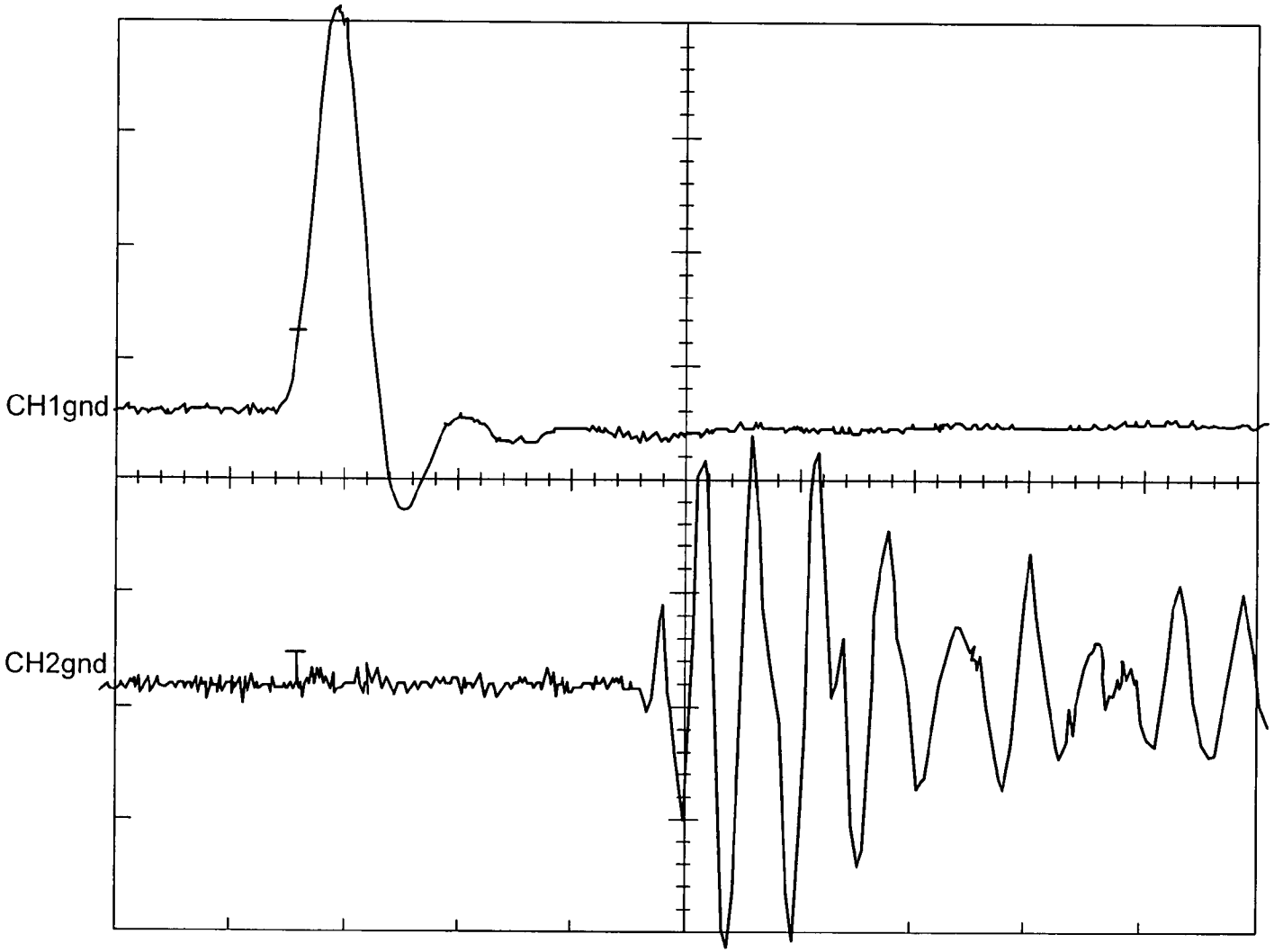
FIG. 30 illustrates a force application signal output from an impulse hammer through hammering using the impulse hammer on the upper-row and a hammering test signal of a hammering tone collected using a microphone through hammering using this impulse hammer on the lower-row.

FIG. 30 illustrates a force application signal output from the impulse hammer using the impulse hammer on the upper-row and a hammering tone signal of a hammering tone collected using the microphone by the hammering using this impulse hammer on the lower-row.

FIG. 30 shows that the hammering tone signal shown on the lower-row is detected following the force application signal shown on the upper-row and the delay of the hammering tone signal with respect to the force application signal shown in FIG. 30 varies depending on the distance between this test object and microphone.

The impulse hammer 110 is provided with not only the function of outputting a force application signal according to the hammering force but also the laser beam light-receiving section 10*c* which transmits the received laser beam to the relay 22 and by hammering the hammering point indicated by the laser beam 1100, this laser beam 1100 is received by the laser beam light-receiving section 10*c*. The laser beam 1100 received by the laser beam light-receiving section 10*c* is sent to the relay 22 through the first optical fiber line 10*f*. As described above, the laser beam 1100 emitted from the sound collector 23 to the test object 1000 is one portion of the bisected laser beam emitted from the laser diode and the other portion is transmitted to the relay 22 via the second optical fiber line 23*f* and the relay 22 causes the laser beam sent from the sound collector 23 and the laser beam sent from the impulse hammer 110 to interfere with each other and detects the result. This detection result is used to correct a hammering tone signal as indicative of the distance between the microphone 23*c* and hammering point on the test object 1000 when hammering is carried out. This correction is performed to prevent the detection accuracy of internal defects of the test object 1000 from deteriorating when sound is collected every time hammering is carried out with the distance between the microphone 23*c* and the hammering point on the test object 1000 changed.

Figure 31:
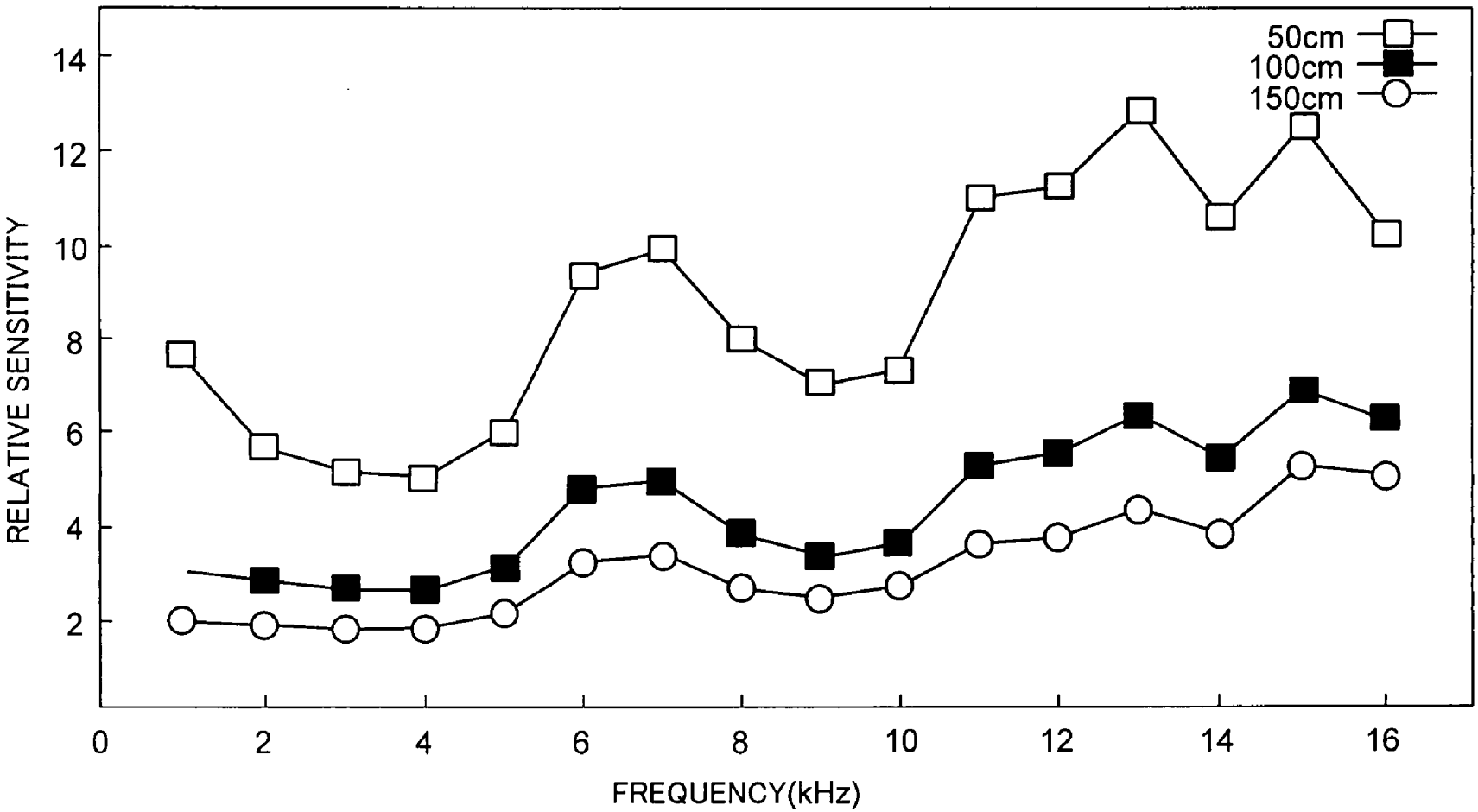
FIG. 31 illustrates how the sound-collecting characteristic of the microphone of the hammering tone test system of this embodiment varies depending on the distance from the hammering point on a test object.

Here, FIG. 31 illustrates how the sound-collecting characteristic of the microphone of the hammering tone test system of this embodiment varies depending on the distance from the hammering point on a test object.

FIG. 31 shows the sound-collecting characteristics of the sound collector when the distance between the microphone 23*c* and hammering point on the test object 1000 is 50 cm, 100 cm and 150 cm. Here, the graph shows that when the distance between the microphone 23*c* and hammering point on the test object 1000 changes between 100 cm and 150 cm, sensitivity changes but the characteristic with respect to frequencies hardly changes and it is evident from FIG. 31 that even when the distance between the microphone 23*c* and hammering point on the test object 1000 changes between 100 cm and 150 cm every time hammering is performed, corrections are possible if the distance between the two is obtained when hammering is performed. In the case of the distance of 50 cm, not only the sensitivity but also the frequency characteristic changes, but corrections are possible if the distance is known.

Furthermore, in this hammering tone test system 3, the hammering decision section 21*c* decides whether the applied force of the impulse hammer 110 when hammering on the test object is performed falls within a predetermined range or not, the beam output measuring section 22*d* detects the beam output of the laser beam received by the laser beam light-receiving section 10*c* when hammering is performed and the hammering decision section 21*c* thereby also decides whether hammering on the test object has been performed at the irradiation positions of the laser beam accurately or not.

The hammering decision section 21*c* decides whether the applied force falls within a predetermined range or not because if the hammering force drastically changes every time hammering is performed, the detection accuracy of internal defects of the test object 1000 decreases. It is decided for the same reason whether hammering has been performed at the irradiation positions of the laser beam accurately or not. When it is decided that the applied force does not fall within the predetermined range or when it is decided that hammering has not been performed at the irradiation positions of the laser beam accurately, this hammering tone test system 3 is designed to output a buzzer tone from a speaker provided for the PC 21. In this case, all the data obtained by the hammering is not recorded. Therefore, the user is allowed to apply rehammering at the hammering point.

In the PC 21, the distance calculation section 21*a* detects the distance between the hammering point and microphone for every hammering based on the interference result sent from the laser beam interference section 22*a* of the relay 22 and the force application signal sent from the force application signal acquisition section 22*c* of the relay 22 and the hammering tone signal sent from the hammering tone signal acquisition section 22*b* of the relay 22 is corrected according to the calculation result of this distance calculation section 21*a*.

Furthermore, the PC 21 displays an image of the analysis result about the hammering on the test object 1000 and the user can evaluate whether there are defects in the test object or not while observing the display.

As described above, the hammering tone test system 3 of this embodiment is provided with the sound collector 23 with the acoustical absorbent disposed at the back in the sound collection hood, and can thereby detect defects of the test object more accurately than the hammering tone test system provided with the sound collector with no acoustical absorbent disposed in the sound collection hood. Furthermore, this hammering tone test system 3 measures the distance between the microphone for collecting the hammering tone and hammering point, corrects the hammering tone signal according to the measured distance, and therefore even when sound is collected with the distance between this microphone and hammering point changed every time hammering is performed, it is possible to detect defects inside the test object with a high degree of accuracy. Furthermore, this hammering tone test system 3 decides whether the applied force falls within a predetermined range or not based on the force application signal detected for every hammering and decides whether the hammering position indicated by the laser beam emitted from the laser beam emitting section 23*b* of the sound collector 23 has been hammered or not. If any one of these decisions indicates the existence of a problem, an alarm is output using a buzzer and the data obtained by the hammering involving the problem is not recorded. That is, the factors for deteriorating the accuracy of detection of defects inside the test object are omitted. This embodiment has explained the case where it is decided whether the applied force falls within a predetermined range or not at the time of hammering or it is decided whether the hammering position indicated by the laser beam emitted from the laser beam emitting section 23*b* of the sound collector 23 has been hammered accurately or not as an example, but the effects of the present invention are not lessened even when these decisions are not made and the same applies to the case where the distance between the microphone which collects a hammering tone and hammering point is not measured for every hammering. Furthermore, when the aforementioned laser beam is not used to measure the distance between the microphone which collects a hammering tone and the hammering point, it is possible not to modulate this laser beam but use the laser beam only to indicate the hammering point and even if the sound collector 23 emits no laser beam, such a sound collector is acceptable if the acoustical absorbent is at least disposed within the sound collection hood.

Figure 32:
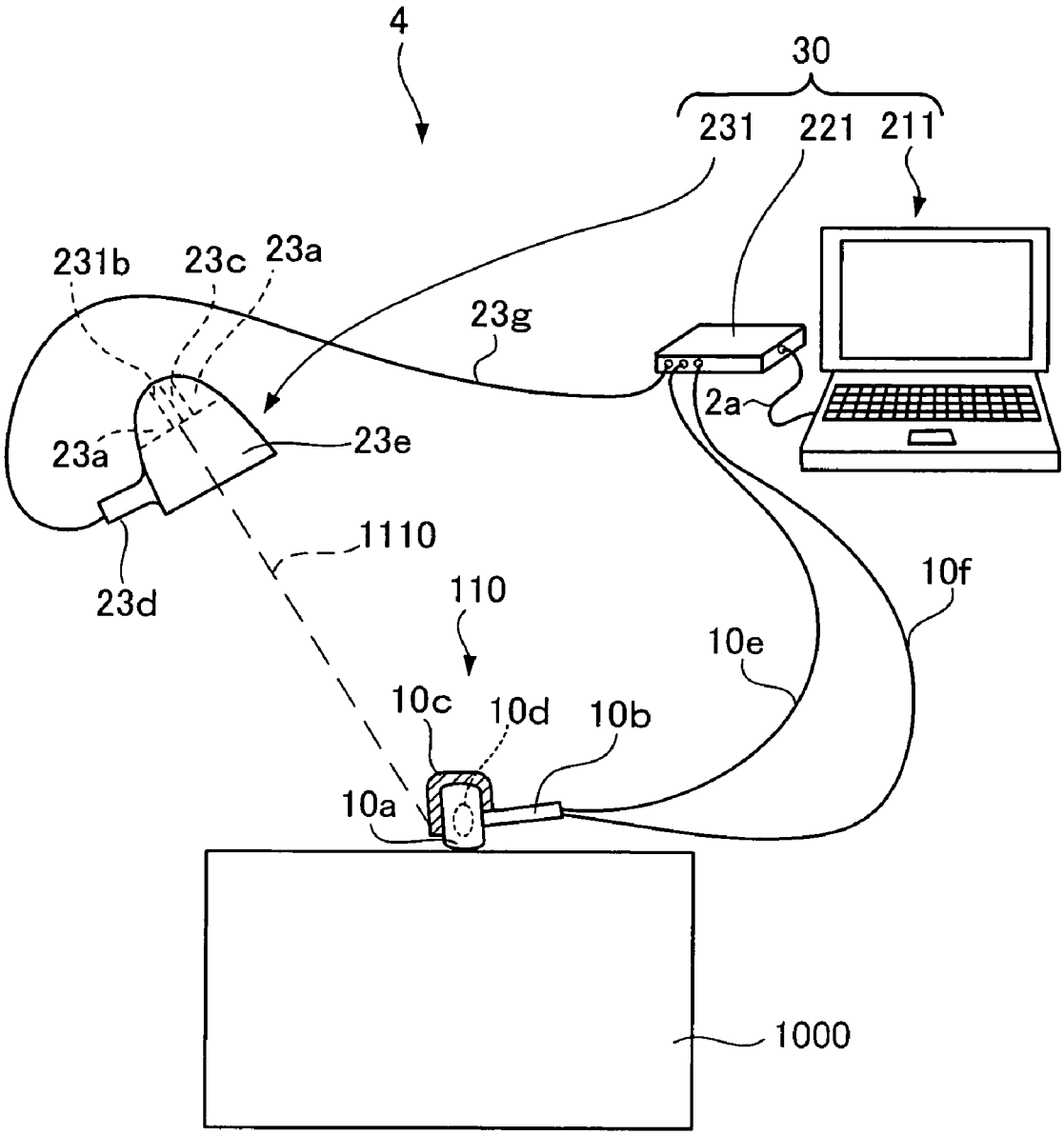
FIG. 32 illustrates a second embodiment of the hammering tone test system.

FIG. 32 illustrates a second embodiment of the hammering tone test system. The components provided in this embodiment of the same types as those provided in the first embodiment are assigned the same reference numerals as those in FIG. 26.

The hammering tone test system 4 of this embodiment shown in FIG. 32 is constructed of an impulse hammer 110 and a defect detection apparatus 30, and the defect detection apparatus 30 is constructed of a sound collector 231 which collects a hammering tone, a relay 221 which collects various signals and a PC 211 which analyzes the various signals from the relay 221. The only difference between this embodiment and the first embodiment is in the method of detecting the distance between the microphone and hammering point. According to the first embodiment, the distance is detected by causing the modulated laser beam emitted from the sound collector and the modulated laser beam emitted with the same phase to the test object and then received at the hammering point to interfere with each other. In contrast, this embodiment detects the distance based on the time difference between the hammering timing by the impulse hammer 110 and the timing at which the hammering tone generated by the hammering is collected by the microphone.

The impulse hammer 110 has the same type and function as those of the impulse hammer in the first embodiment, and therefore explanations thereof will be omitted.

The sound collector 231 is constructed of a microphone 23*c* which collects a hammering tone generated by hammering on a test object using the impulse hammer 110, a sound collection hood 23*e* for preventing the surrounding sound from being collected by the microphone, a handle 23*d* provided on the outer surface of this sound collection hood, a laser beam emitting section 231*b* which emits a laser beam, a glass wool 23*a* which is an acoustical absorbent to selectively collect sound by the microphone 23*c* and a second signal line 23*g* for transmitting the hammering tone signal from the microphone 23*c* to the relay 22. Unlike the laser beam emitting section 23*b* in the first embodiment, this laser beam emitting section 231*b* consists of only a laser diode and this embodiment does not change a current applied to the laser diode or split the laser beam emitted from the laser diode as in the case of the first embodiment.

The relay 221 is connected to a first signal line 10*e* and first optical fiber line 10*f* from the impulse hammer 110 and a second signal line 23*g* from the sound collector 231.

The PC 211 corrects various types of digital signals sent from the relay 221 and displays those digital signals on a display screen.

Figure 33:
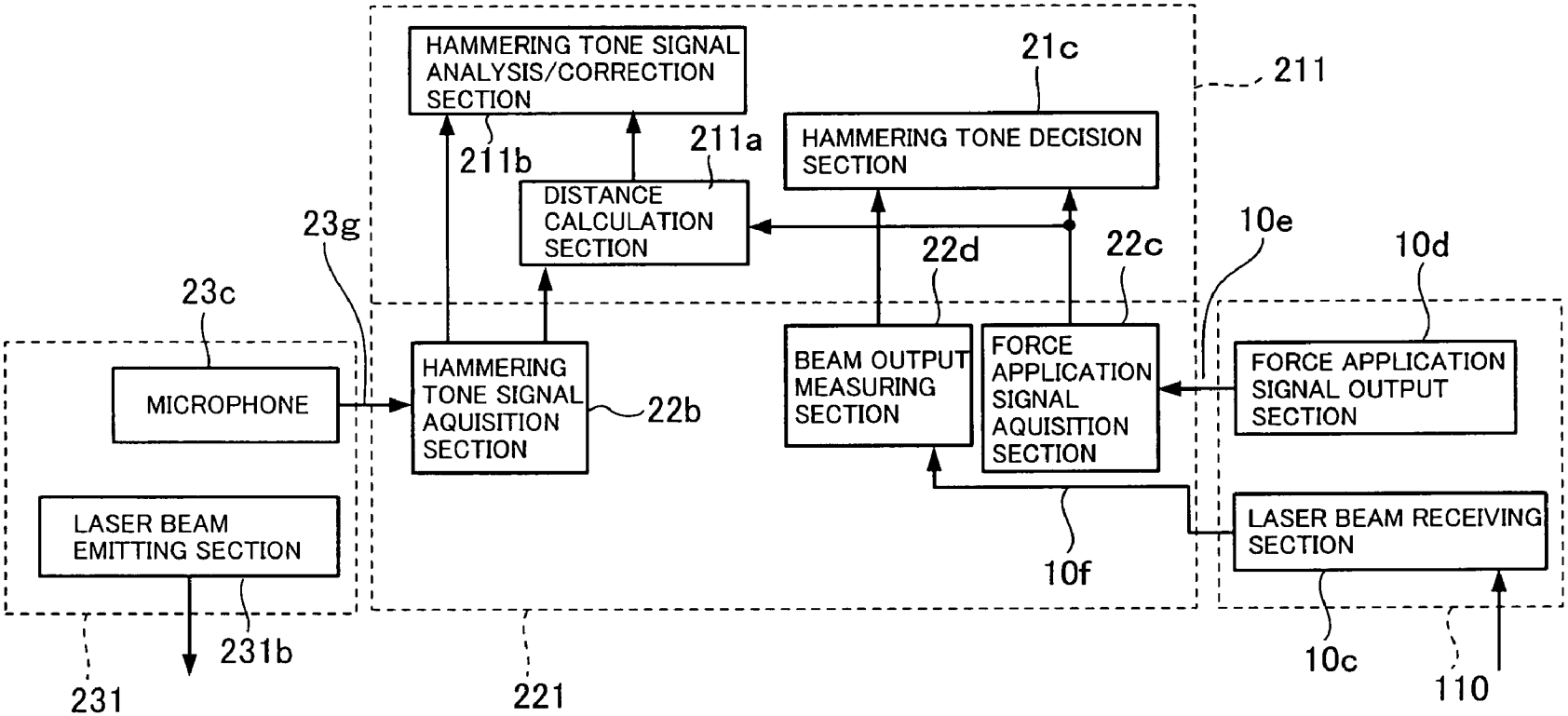
FIG. 33 is an internal block diagram of the hammering tone test system of this embodiment.

FIG. 33 is an internal block diagram of the hammering tone test system of this embodiment.

FIG. 33 shows the internal block of the sound collector 231 on the left, internal block of the PC 211 at the top center, internal block of the relay 221 at the bottom center and internal block of the impulse hammer 110 on the right.

The impulse hammer 110 shown in FIG. 33 is constructed of a force application signal output section 10*d* and a laser beam light-receiving section 10*c* which transmits the received laser beam to the relay 221.

The sound collector 231 shown in FIG. 33 is constructed of the microphone 23*c* which collects a hammering tone and outputs a hammering tone signal and the laser beam emitting section 231*b*.

The relay 221 shown in FIG. 33 is constructed of a hammering tone signal acquisition section 22*b* which acquires the hammering tone signal from the microphone 23*c*, a beam output measuring section 22*d* which measures the output of the laser beam from the laser beam light-receiving section 10*c* and a force application signal acquisition section 22*c* which acquires the force application signal from the impulse hammer 110.

The PC 211 shown in FIG. 33 is constructed of a distance calculation section 211*a* which calculates the distance between the hammering point for every hammering and the microphone based on the timing at which the force application signal is acquired from the force application signal acquisition section 22*c* of the relay 221 and the timing at which the hammering tone signal is acquired from the hammering tone signal acquisition section 22*b* of the relay 221, a hammering decision section 21*c* which decides whether the hammering has been carried out accurately at the hammering point indicated by the laser beam or not or whether the hammering force applied falls within a predetermined range or not based on the timing at which the force application signal is obtained from the force application signal acquisition section 22*c* and the output of the laser beam obtained through the hammering, and a hammering tone signal analysis/correction section 211*b* which corrects the hammering tone signal from the hammering tone signal acquisition section 22*b* of the relay 22 based on the distance information from the distance calculation section 211*a* and analyzes the hammering tone signal.

A case where internal defects of the test object 1000 placed indoors shown in FIG. 32 are detected using the hammering tone test system 4 will be explained below.

When the power supply of this hammering tone test system 4 is turned ON to start a testing on the test object and the laser beam emitting button provided for the sound collector 231 is turned ON, the laser beam 1110 is emitted from the laser beam emitting section 231*b* along the axis of rotation of the sound collection hood 23*e* shaped like a rotating surface. As described above, this laser beam 1110 is a laser beam whose output is not controlled, but this laser beam is emitted along the axis of rotation of the sound collection hood 23*e* shaped like a rotating surface as in the case of the first embodiment, and therefore irradiating this laser beam 111 at a desired hammering position allows the hammering tone by the hammering at the hammering position to be collected by the sound collector 231 accurately.

In this hammering tone test system 4, hammering on the test object is also carried out while moving the sound collector 231 so as to irradiate this laser beam 1110 at the hammering position on the test object whose hammering order is predetermined and the impulse hammer 110 transmits a force application signal according to the hammering force to the relay 211 every time hammering is performed. Furthermore, the hammering tone generated by hammering on the test object using this impulse hammer 110 is collected by the microphone 23*c* and a hammering tone signal is transmitted to the relay 221.

In addition to the function of outputting a force application signal according to the hammering force, this impulse hammer 110 is provided with the laser beam light-receiving section 10*c* which transmits the received laser beam to the relay 22 and by hammering the hammering point at which the laser beam emitted from the sound collector 231 is irradiated, the laser beam is received by the laser beam light-receiving section 10*c*. The laser beam received by the laser beam light-receiving section 10*c* is transmitted to the relay 221 through the first optical fiber line 10*f*.

Furthermore, in this hammering tone test system 4, the hammering decision section 21*c* decides whether the applied force of the impulse hammer 110 when hammering on the test object is performed falls within a predetermined range or not, and when the beam output of the laser beam received by the laser beam light-receiving section 10*c* when hammering is performed is detected by the beam output measuring section 22*d*, the hammering decision section 21*c* also decides whether the hammering on the test object has been performed at the irradiation positions of the laser beam accurately or not.

When this hammering tone test system 4 also decides that the applied force does not fall within the predetermined range or decides that the hammering has not been performed at the irradiation positions of the laser beam accurately, a buzzer tone is output from a speaker provided for the PC 211.

In the PC 211, the distance calculation section 211*a* detects the distance between the hammering point and microphone for every hammering based on the time difference between the transmission timing of a hammering tone signal from the hammering tone signal acquisition section 22*b* of the relay 221 and the transmission timing of the force application signal from the force application signal acquisition section 22*c* of the relay 221 and the hammering tone signal sent from the hammering tone signal acquisition section 22*b* of the relay 221 is corrected according to the calculation result of this distance calculation section 211*a*.

Furthermore, the PC 211 displays an image of the analysis result about the hammering on the test object 1000 and the user can evaluate whether there are defects in the test object or not.

As described above, the hammering tone test system 4 of this embodiment is also provided with the sound collector 231 with the acoustical absorbent disposed at the back in the sound collection hood, and can thereby detect defects of the test object more accurately than the hammering tone test system provided with no acoustical absorbent disposed in the sound collection hood. Furthermore, in this hammering tone test system 4, the distance calculation section 211*a* measures the distance between the microphone for collecting the hammering tone and hammering point for every hammering, based on the time difference between the transmission timing of a hammering tone signal from the hammering tone signal acquisition section 22*b* of the relay 221 and the transmission timing of the force application signal from the force application signal acquisition section 22*c* of the relay 221 and the hammering tone signal is corrected according to the distance detected here, and therefore even when sound is collected using the microphone with the distance between this microphone and hammering point changed every time hammering is performed, it is possible to detect defects inside the test object with a high degree of accuracy. Furthermore, this hammering tone test system 4 also decides whether the applied force falls within a predetermined range or not based on the force application signal detected for every hammering and decides whether the hammering position indicated by the laser beam emitted from the laser beam emitting section 231*b* of the sound collector 231 has been hammered accurately or not, and if any one of these decisions indicates the existence of a problem, an alarm is output using a buzzer, and therefore it is possible to prevent deterioration of accuracy of detecting defects inside the test object. This embodiment has also explained the case where it is decided whether the applied force at the time of hammering falls within a predetermined range or not or it is decided whether the hammering position indicated by the laser beam emitted from the laser beam emitting section 231*b* of the sound collector 231 has been hammered or not as an example, but the effects of the present invention are not lessened even when these decisions are not made and the same applies to the case where the distance between the microphone which collects a hammering tone and hammering point is not measured for every hammering. Furthermore, even when no laser beam is emitted from the sound collector 231, any sound collector with the acoustical absorbent disposed within the sound collection hood is acceptable.

Figure 34:
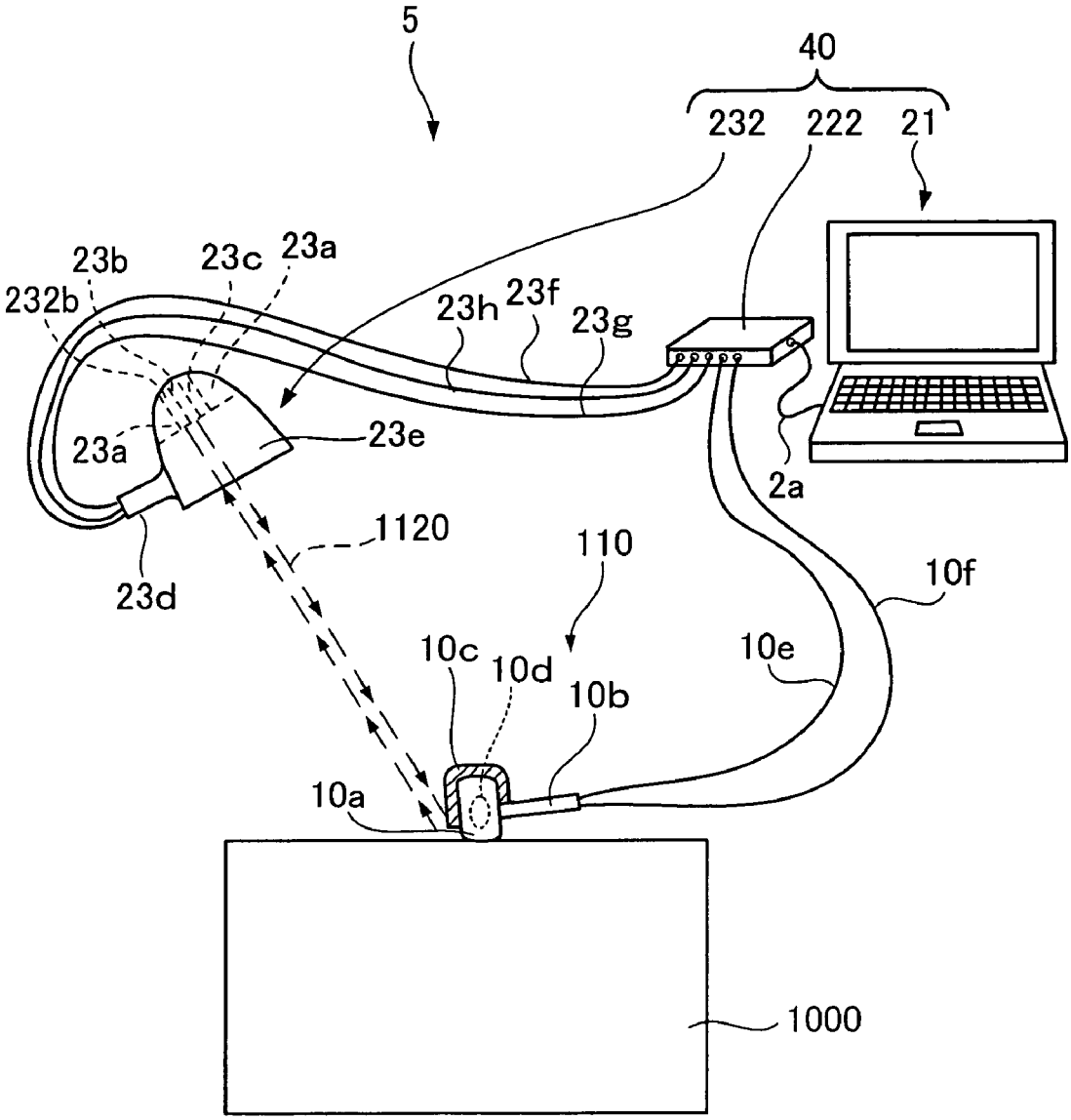
FIG. 34 illustrates a third embodiment of the hammering tone test system.

FIG. 34 illustrates a third embodiment of the hammering tone test system. The components of the same types provided in this embodiment as those provided in the first embodiment are assigned the same reference numerals as those in FIG. 26.

The hammering tone test system 5 shown in FIG. 34 is constructed of an impulse hammer 110 and a defect detection apparatus 40 and the defect detection apparatus 40 is constructed of a sound collector 232 which collects a hammering tone, a relay 222 which collects various types of signals and a PC 21 which analyzes various types of signals from the relay 222. The only difference between this embodiment and the first embodiment is in the method of detecting the distance between the microphone and hammering point and this embodiment detects the distance by causing the modulated laser beam emitted from the sound collector 232 and the modulated laser beam reflected on the test object and returned to the sound collector 232 to interfere with each other.

The impulse hammer 110 has the same type and function as those of the impulse hammer in the first embodiment, and therefore explanations thereof will be omitted.

The sound collector 232 is constructed of a microphone 23*c* which collects a hammering tone generated by hammering on a test object using the impulse hammer, a sound collection hood 23*e* for preventing the surrounding sound from being collected by the microphone, a handle 23*d* provided on the outer surface of this sound collection hood, a laser beam emitting section 23*b* which emits a laser beam, glass wool 23*a* which is an acoustical absorbent to selectively collect sound by the microphone 23*c* and a second signal line 23*g* for transmitting a hammering tone signal from the microphone 23*c* to the relay 222. This laser beam emitting section 23*b* is constructed of a laser diode, a beam output control section which changes the beam output by changing a current applied to this laser diode and a beam splitter which splits the laser beam emitted from the laser diode into a beam outside the opening of the sound collection hood and a second optical fiber line. A second optical fiber line 23*f* for transmitting one portion of the laser beam emitted from the laser diode and split by the beam splitter to the relay 222, a second laser beam light-receiving section 232*b* which receives the laser beam emitted from the laser diode, reflected on the test object and returned and a third optical fiber line 23*h* for transmitting the laser beam received by this second laser beam light-receiving section 232*b* to the relay 222 are also components of the sound collector 232 shown in FIG. 34.

The relay 222 is connected to the first signal line 10*e* and first optical fiber line 10*f* from the impulse hammer 110 and the second signal line 23*g*, second optical fiber line 23*f* and third optical fiber line 23*h* from the sound collector 232, causes the laser beams transmitted from the second optical fiber line 23*f* and third optical fiber line 23*h* to interfere with each other, converts various signals to digital signals and transmits the signals to the PC 21 via the third signal line 2*a*.

The PC 21 corrects various types of digital signals sent from the relay 222 and displays those digital signals on a display screen.

Figure 35:
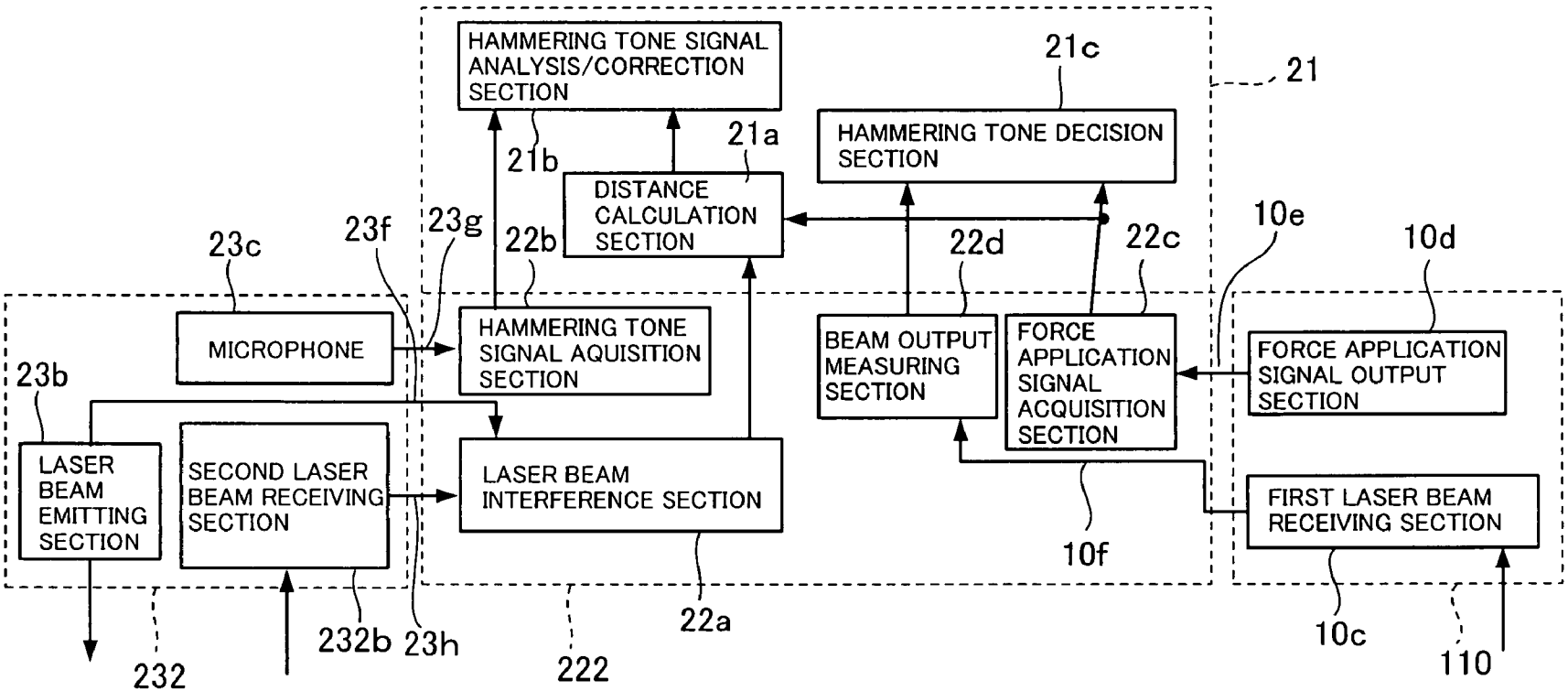
FIG. 35 is an internal block diagram of the hammering tone test system of this embodiment.

FIG. 35 is an internal block diagram of the hammering tone test system of this embodiment.

FIG. 35 shows the internal block of the sound collector 232 on the left, internal block of the PC 21 at the top center, internal block of the relay 222 at the bottom center and internal block of the impulse hammer 110 on the right.

The impulse hammer 110 shown in FIG. 35 is constructed of a force application signal output section 10*d* and a first laser beam light-receiving section 10*c* for transmitting a received laser beam to the relay 222.

The sound collector 232 shown in FIG. 35 is constructed of the microphone 23*c* which collects a hammering tone and outputs a hammering tone signal, the laser beam emitting section 23*b* and the second laser beam light-receiving section 232*b*.

The relay 222 shown in FIG. 35 is constructed of a hammering tone signal acquisition section 22*b* which acquires the hammering tone signal from the microphone 23*c*, a laser beam interference section 22*a* which causes the laser beam from the laser beam emitting section 23*b* and the laser beam from the second laser beam light-receiving section 232*b* to interfere with each other, a beam output measuring section 22*d* which measures the output of the laser beam from the first laser beam light-receiving section 10*c* and a force application signal acquisition section 22*c* which acquires the force application signal from the impulse hammer 110.

The PC 21 shown in FIG. 35 is constructed of a hammering decision section 21*c* which decides whether hammering has been carried out accurately at the hammering point indicated by a laser beam or not or whether the hammering force applied falls within a predetermined range or not based on the interference result detected by the laser beam interference section 22*a* of the relay 222 and the timing at which the force application signal is obtained from the force application signal acquisition section 22*d* and the output of the laser beam obtained through the hammering, a distance calculation section 21*a* which calculates the distance between the hammering point for every hammering and the microphone based on the acquisition timing of the force application signal from the force application signal acquisition section 22*c* of the relay 222 and the interference result from the laser beam interference section 22*a* of the relay 222 and a hammering tone signal analysis/correction section 21*b* which corrects the hammering tone signal from the hammering tone signal acquisition section 22*b* of the relay 222 based on the distance information from the distance calculation section 21*a* and analyzes the hammering tone signal.

A case where internal defects of the test object 1000 placed indoors shown in FIG. 34 are detected using the hammering tone test system 5 will be explained below.

The sound collection hood 23*e* of the sound collector 232 of the hammering tone test system 5 of this embodiment is provided with the laser beam emitting section 23*b*, second laser beam light-receiving section 232*b* and microphone 23*c* at the center back and the acoustical absorbent 23*a* is provided between these sections and the inner wall of the sound collection hood.

When the power supply of this hammering tone test system 5 is turned ON to start a testing on the test object and the laser beam emitting button provided for the sound collector 232 is turned ON, the laser beam 1120 is emitted from the laser beam emitting section 23*b* along the axis of rotation of this sound collection hood shaped like a rotating surface.

As described above, the output of this laser beam 1120 is always controlled by the output control section which changes the output. This is intended to prevent the distance between the sound-receiving surface 231*c* of the microphone 23*c* and hammering point on the test object from becoming unmeasurable when the phase difference between the laser beam sent from the laser beam emitting section 23*b* to the relay 222 and the laser beam reflected on test object and returned becomes an integer multiple of the wavelength.

In this hammering tone test system 5, hammering on the test object is carried out while moving the sound collector 232 so as to irradiate this laser beam 1120 at hammering positions on the test object whose hammering order is predetermined and the impulse hammer 110 sends a force application signal according to the hammering force to the relay 222 every time hammering is carried out. Furthermore, as in the case of the first embodiment, the sound collector 232 splits the laser beam emitted from the laser diode of the laser beam emitting section 23*b*, sends one portion to the relay 222 via the second optical fiber line and sends the other portion of the laser beam emitted from the laser beam emitting section 23*b* to the outside of the opening of the sound collection hood, reflected on the test object, returned and received by the second laser beam light-receiving section 232*b* to the relay 222 via the third optical fiber line. Furthermore, the hammering tone generated by the hammering on the test object using this impulse hammer 110 is collected by the microphone 23*c* and the microphone 23*c* sends the hammering tone signal to the relay 222 via the second signal line 23*g*.

In addition to the function of outputting a force application signal according to the hammering force, this impulse hammer 110 is provided with the first laser beam light-receiving section 10*c* which receives the laser beam from the sound collector 232, and by hammering the hammering point indicated by the laser beam, the laser beam emitted from the laser beam emitting section 23*b* is received by the first laser beam light-receiving section 10*c*. The laser beam received by the first laser beam light-receiving section 10*c* is sent to the relay 222 via the first optical fiber line 13. However, as described above, this embodiment detects the distance between the microphone 23*c* when hammering is performed and the hammering point based on the laser beam sent from the laser beam emitting section 23*b* of the sound collector 232 and second laser beam light-receiving section 232*b* to the relay 222, and the laser beam received by the first laser beam light-receiving section 10*c* of this impulse hammer 110 and sent to the relay 222 is only used by the hammering decision section 21*c* which decides whether the hammering point irradiated with the laser beam emitted from the laser beam emitting section 23*b* is hammered accurately or not.

Furthermore, in this hammering tone test system 5, the hammering decision section 21*c* decides whether the applied force of the impulse hammer 110 when hammering on the test object is performed falls within a predetermined range or not.

The PC 21 detects the distance between the aforementioned hammering point and microphone for every hammering through the distance calculation section 21*a* based on the interference result sent from the laser beam interference section 22*a* of the relay 222 and the force application signal sent from the force application signal acquisition section 22*c* of the relay 222 and corrects the hammering tone signal sent from the hammering tone signal acquisition section 22*b* of the relay 222 according to the calculation result of this distance calculation section 21*a*.

Furthermore, the PC 21 displays an image of the analysis result of the hammering on the test object 1000 and the user can evaluate whether there are defects in the test object or not.

As described above, the hammering tone test system 5 of this embodiment is provided with the sound collector 232 with the acoustical absorbent disposed at the back in the sound collection hood, and can thereby detect defects of the test object more accurately than the hammering tone test system provided with the sound collector with no acoustical absorbent disposed in the sound collection hood. Furthermore, this hammering tone test system 5 measures the distance between the microphone for collecting the hammering tone and hammering point by causing the laser beam from the laser beam emitting section 23*b* and the laser beam from the second laser beam light-receiving section 232*b* to interfere with each other for every hammering, corrects the hammering tone signal according to the measured distance, and therefore even when sound is collected with the distance between this microphone and hammering point changed every time hammering is performed, it is possible to detect defects inside the test object with a high degree of accuracy. Furthermore, this hammering tone test system 5 decides whether the applied force falls within a predetermined range or not based on the force application signal detected for every hammering and decides whether the hammering position indicated by the laser beam emitted from the laser beam emitting section 23*b* of the sound collector 232 has been hammered accurately or not, and if any one of these decisions indicates the existence of a problem, an alarm is output using a buzzer. This embodiment has explained the case where it is decided whether the applied force falls within a predetermined range or not at the time of hammering or it is decided whether the hammering position indicated by the laser beam emitted from the laser beam emitting section 23*b* of the sound collector 232 has been hammered accurately or not as an example, but the effects of the present invention are not lessened even when these decisions are not made and the same applies to the case where the distance between the microphone which collects a hammering tone and hammering point is not measured for every hammering. Furthermore, when the aforementioned laser beam is not used to measure the distance between the microphone which collects a hammering tone and the hammering point, it is possible not to modulate this laser beam but use the laser beam only to indicate the hammering point. Furthermore, any system which even does not emit any laser beam from the sound collector 232 can be used if the acoustical absorbent is at least disposed within the sound collection hood.

Furthermore the first to third embodiments have explained an example where an impulse hammer is adopted as a hammering tool, but the present invention is not limited to this and any hammering tool which outputs a signal indicating timing of hammering to the outside can be used and even the use of an ordinary hammer which can generate a hammering tone from the test object by hammering will not reduce the effects of the present invention.

Furthermore, the first to third embodiments have explained the case where the acoustical absorbent is disposed around the microphone in the sound collection hood of the sound collector as an example, and by using the sound collector with this acoustical absorbent disposed around the perimeter of the opening of the sound collection hood, it is possible to attenuate a sound wave arriving from the side of or behind the hood, diffracted at the edge of the opening of the hood and entering the hood, further suppress interference among sound waves and thereby further improve the accuracy of detecting internal defects of the test object.

Figure 36:
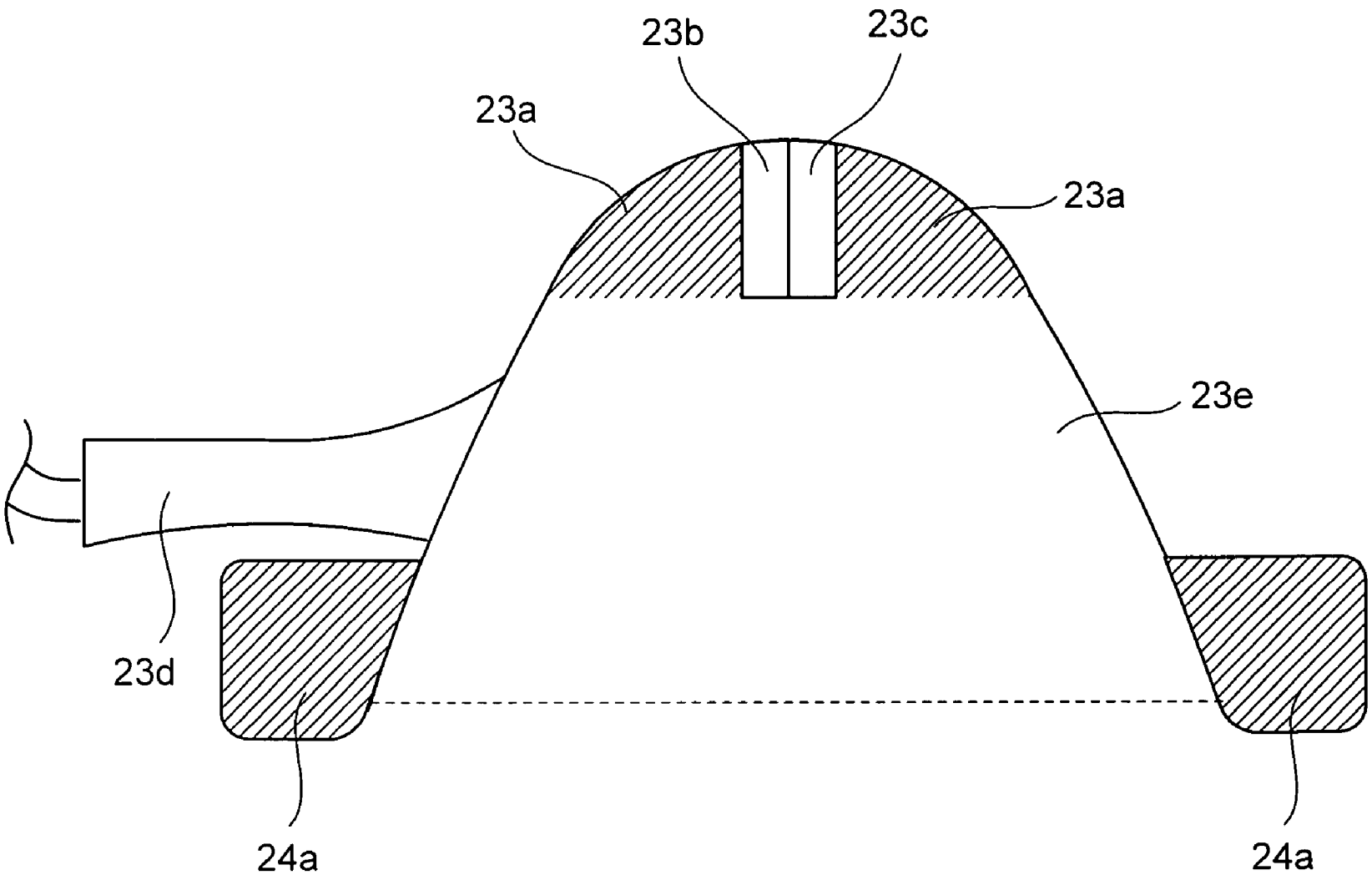
FIG. 36 is a cross-sectional view of an example of a sound collection hood with an acoustical absorbent also disposed around the perimeter of the opening of the sound collection hood.

FIG. 36 is a cross-sectional view of an example of a sound collection hood with an acoustical absorbent also disposed around the perimeter of the opening of the sound collection hood. The components shown here of the same types as those shown in the first embodiment are assigned the same reference numerals as those in the first embodiment.

As described above, in the sound collection hood 23*e* shown in FIG. 36, glass wool 24*a*, the acoustical absorbent, is disposed not only around the microphone but also all around the perimeter of the opening. This glass wool 24*a* around the perimeter of the opening is not limited to the one disposed all around the perimeter of the opening as shown in FIG. 36 and may also be disposed in a detachable manner.

Furthermore, disposing the glass wool not only around the microphone but also around the perimeter of the opening of the sound collection hood and attenuating a sound wave diffracted at the edge of the opening of the hood and entering the hood also suppresses deterioration of directivity.

FIG. 37(*a*) and FIG. 37(*b*) are graphs illustrating directional characteristics of the sound collector.

FIG. 37(*a*) shows a directional characteristic of a sound collector with an acoustical absorbent only disposed around a microphone and FIG. 37(*b*) shows a directional characteristic of the sound collector which is a mode of the above described embodiment with the acoustical absorbent disposed not only around the microphone but also around the perimeter of the opening of the sound collection hood at various frequencies.

It is evident from FIG. 37 that disposing the acoustical absorbent not only around the microphone but also around the perimeter of the opening of the sound collection hood improves the directional characteristic sideward or behind the sound collector at 1 kHz and noticeably improves the directivity right behind in particular, and improves the directivity in the direction close to the front of the sound collector at 10 kHz.

Furthermore, also disposing the acoustical absorbent around the perimeter of the opening of the sound collection hood lessens the impact when the opening of the sound collector contacts the test object, and can thereby provide the effect of preventing breakage of the two. As the acoustical absorbent, any material other than glass wool may also be used if it has at least sound absorptivity. This embodiment has explained the case where the acoustical absorbent is disposed outside the perimeter of the opening of the sound collection hood as an example, but the present invention is not limited to this and may also dispose the acoustical absorbent inside the perimeter.

What is claimed is:

1. A sound collector comprising:

a sound collection hood having an opening at the front end and a sound reflective inner wall shaped like a rotating surface having a focus behind the opening at least provided on the opening side, thus forming an inner space;

a microphone placed inside the sound collection hood with at least a sound receiving face oriented forward for receiving a sound wave entering the sound collection hood; and an acoustical absorbent body, independent of the sound reflective inner wall, formed in front of the sound receiving face so as to form an incident path for sound to enter the sound receiving face, shaped so as to surround the incident path, and wherein an angle of the incident path is in the range 150°±15°.

2. The sound collector according to claim 1, wherein at least one of the front of the acoustical absorbent body and the surface contacting the sound collection hood is formed comprising a plurality of irregularly shaped surfaces so as to reflect sound waves diffusely.

3. The sound collector according to claim 1, wherein the acoustical absorbent body is provided with an acoustical absorbent member and a cover which spreads over the surface of the acoustical absorbent member and covers the acoustical absorbent member in such a way that the shape of the acoustical absorbent member remains.

4. The sound collector according to claim 3, wherein the cover is made of a jersey cloth.

5. The sound collector according to claim 1, wherein the acoustical absorbent body consists of two longitudinally detachable portions.

6. A sound collector comprising:

a sound collection hood having an opening at the front end and a sound reflective inner wall shaped like a rotating surface having a focus behind the opening at least provided on the opening side, thus forming an inner space;

a microphone placed inside the sound collection hood with at least a sound receiving face oriented forward for receiving a sound wave entering the sound collection hood;

an acoustical absorbent member, independent of the sound reflective inner wall, disposed inside the sound collection hood so as to surround the sound receiving face of the microphone, forming an incident path for sound to enter the sound receiving face, wherein an angle of the incident path is in the range 150°±15°; and a partition wall which is disposed ahead of the acoustical absorbent member and separates the inner space including the sound receiving face from the outside of the sound collection hood.

7. The sound collector according to claim 1 or 6, wherein the sound collection hood is provided with an acoustical absorbent around the perimeter of the opening.

8. The sound collector according to claim 6, wherein the partition wall is made of a sound-penetrable sheet.

9. The sound collector according to claim 6 or 8, wherein the partition wall is detachable from the sound collection hood.

10. A sound collector comprising:

a sound collection hood having an opening at the front end and a sound reflective inner wall shaped like a rotating surface having a focus behind the opening at least provided on the opening side, thus forming an inner space;

a microphone placed inside the sound collection hood with at least a sound receiving face oriented forward; and an acoustical absorbent body, independent of the sound reflective inner wall, formed in front of the sound receiving face so as to form an incident path for sound to enter the sound receiving face, and wherein an angle of the incident path is in the range 150°±15°.

11. The sound collector according to claim 1 or 6, wherein the sound collection hood is provided with an acoustical absorbent around the outer perimeter of the opening.

12. The sound collector according to claim 1 or 10, wherein the sound collection hood is further provided with a second acoustical absorbent body formed entirely behind the sound receiving face, adjacent to and separate from, the acoustical absorbent body formed in front of the sound receiving face.

* * * * *